US006958209B2

(12) United States Patent
Morita et al.

(10) Patent No.: US 6,958,209 B2
(45) Date of Patent: Oct. 25, 2005

(54) PHOTOTHERMOGRAPHIC MATERIAL AND IMAGE FORMING METHOD

(75) Inventors: Kiyokazu Morita, Kokubunji (JP); Narito Goto, Sagamihara (JP); Ayumu Nishijima, Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/336,920

(22) Filed: Dec. 27, 2002

(65) Prior Publication Data

US 2003/0215756 A1 Nov. 20, 2003

(30) Foreign Application Priority Data

Jan. 8, 2002 (JP) ..... P2002-001345
Mar. 22, 2002 (JP) ..... P2002-079853

(51) Int. Cl.[7] ..... G03C 1/498

(52) U.S. Cl. ..... 430/619; 430/264; 430/531; 430/621; 430/622

(58) Field of Search ..... 430/619, 264, 430/567, 531, 621, 622

(56) References Cited

U.S. PATENT DOCUMENTS 3,100,704 A * 8/1963 Coles
4,102,312 A * 7/1978 Sashihara et al.
6,376,166 B1 * 4/2002 Oya et al. ..... 430/619
2001/0029000 A1 10/2001 Yoshioka et al.

FOREIGN PATENT DOCUMENTS

EP 0274402 * 7/1988

OTHER PUBLICATIONS

European Search Report EP 03 25 0055.
One sheet of Patent Abstracts of Japan, Publication No. 2001209145, Publication date: Aug. 3, 2001.
English Abastract only.
One sheet of English Abstract only of XP–002266557, Fuji Photo Film Co., Ltd.
Two sheets of English Abstract only of XP–002266558, Konica Corp.

* cited by examiner

*Primary Examiner*—Thorl Chea
(74) *Attorney, Agent, or Firm*—Lucas & Mercanti, LLP

(57) ABSTRACT

A photothermographic material comprising a support and having thereon an image forming layer containing an organic silver salt, light-sensitive silver halide grains, binder and a reducing agent, wherein the reducing agent comprises: a reducing agent A containing at least a bisphenol derivative represented by following Formula (A-1); and a reducing agent B containing at least a bisphenol derivative not represented by the Formula (A-1), and the amount of reducing agent A is 5 to 45 weight % of the total weight of the reducing agent A and reducing agent B.

Formula (A-1)

19 Claims, 1 Drawing Sheet

PHOTOTHERMOGRAPHIC MATERIAL AND IMAGE FORMING METHOD

TECHNICAL FIELD

The present invention relates to photothermographic materials, and in particular to photothermographic materials exhibiting high photographic density, improved silver tone and image stability.

BACKGROUND OF THE INVENTION

In the field of graphic arts and medical diagnosis, there have been concerns in processing of photographic film with respect to effluent produced from wet-processing of image forming materials, and recently, reduction of the processing effluent is strongly demanded in terms of environmental protection and saving of floor space. A photothermographic dry imaging material for photographic use, capable of forming images by adding only heat, has been made practicable, and rapidly put into wide use.

A photothermographic material itself (hereinafter, referred to as thermodevelopable material or photosensitive material) has been proposed for a long time. For example, in U.S. Pat. Nos. 3,152,904 and 3,457,075, and by D. Morgan, "Dry Silver Photographic Material" in IMAGING PROCESSES and MATERIALS, Neblette's Eighth Edition, edited by J. M. Sturge, V. Walworth, and A. Shepp (1989) page 279, a photothermographic materials comprising a support provided thereon a organic silver salt, light-sensitive silver halide grains and a reducing agent are described. The photothermographic material provides a simply and environment-friendly system for users, without using any processing solution.

These photothermographic materials comprise a light-sensitive layer containing light-sensitive silver halide grains as a photosensor and an organic silver salt as a silver ion source, which are thermally developed with a reducing agent at a temperature of 80 to 140° C. to form images, with no need to be subjected to fixing.

In photothermographic materials containing an organic silver salt, however, silver halide grains together with a reducing agent easily results in fogging during storage time prior to thermal development. Furthermore, there are problems in that the photothermographic materials, after exposure, are usually developed without being fixed and the silver halide, organic silver salt and reducing agent concurrently remain in the layer so that metallic silver is thermally or photolytically produced, and after storage over a long period of time, deteriorating image quality, such as silver image tone, results.

Techniques have been disclosed for solving such problems in JP-A Nos. 6-208192 and 8-267934 (hereinafter, the term JP-A refers to an unexamined, published Japanese Patent Application); U.S. Pat. No. 5,714,311 and references cited therein. These disclosed techniques have desired effects to some extent but are not sufficient as a technique satisfying the level required in the market.

The photothermographic material is usually processed by a thermal development apparatus forming images under applied stable heat to the photothermographic material by a so-called a thermal developing processor. As described above, a large number of these thermal development apparatuses have been supplied to the market with the recent trend toward photothermographic material. However slip property between the photothermographic material and conveyance rollers or parts of a developing machine for the material may change by the condition of temperature and humidity, resulting in problems of inferior transportability and unevenness in developing. There is also a problem of density variation over time in the photothermographic material. It has been proved that these problems are observed markedly on the photothermographic material which is image exposed by a laser light and developed by heat to form images. Further, in recent years it has been demanded to miniturize laser imagers and to speed up the processing.

Thus, it is desired to improve the performance of the photothermographic material. A heated drum method has the advantage easily miniturizing a thermal development apparatus compared to a horizontal conveyance method, but it tends to produce problems of powder dust, unevenness in developing and roller marks. The use of minute average grain size silver halide enhances covering power as described in JP-A 11-295844 and 11-352627, and the use of a contrast increasing agent, such as a hydrazine compound and a vinyl compound, are also effective to obtain sufficient density on the photothermographic material for high-speed processing. However, problems of a wider density variation (printout property) in thermal development and a more pronounced unevenness after developing are observed when said technique is applied. Although printout performance is possible to be improved by decreasing the amount of a reducing agent or decreasing of silver coverage, the problem of reduction of image density over time has been noted. Further, a problem in which the silver image color tone differs from that of the current wet type X-ray film has also occurred due to the use of miniturized silver halide grains.

In addition thereto, further enhanced image quality has been desired as a perpetual theme for photothermographic materials. Specifically in the field of medical diagnostic imaging, further enhanced image quality is desired to enable more precise diagnosis.

SUMMARY OF THE INVENTION

The present invention has been made in light of the foregoing problems. Thus, it is an aspect of the invention to provide a photothermographic material with a relatively low silver coverage, exhibiting enhanced image quality and superior silver tone, image lasting quality and physical property of the layer. Another aspect of the present invention is to provide a photothermographic material with high photographic density, improved silver tone and image stability under light exposure.

The above aspects of the invention can be accomplished by the following constitutions.

An embodiment of the present invention is a photothermographic material comprising a support and having thereon an image forming layer containing an organic silver salt, light-sensitive silver halide grains, binder and a reducing agent. The reducing agent in the photothermographic material comprises: a reducing agent A containing at least a bisphenol derivative represented by following Formula (A-1); and a reducing agent B containing at least a bisphenol derivative not represented by the General Formula (A-1), and the amount of reducing agent A is 5 to 45 weight % of the total weight of the reducing agent A and reducing agent B, Formula (A-1)

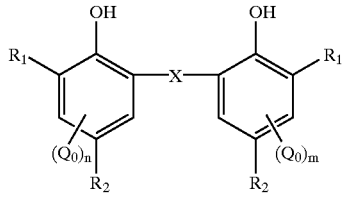

wherein each of $R_1$ is alkyl group, and at least one of them is a secondary or tertiary alkyl group; each of $R_2$ is a hydrogen atom or a group capable of substituted on a benzen ring; $Q_0$ is a group capable of being substituted on a benzen ring; n and m are each an integer of 0 to 2; plural $R_1$s, $R_2$s or $Q_0$s may be the same or different from each other; and X is a chalcogen atom or CHR, in which R is a hydrogen atom, a halogen atom or an alkyl group.

It is preferable that the bisphenol derivative in the reducing agent B is represented by following Formula A-2, Formula (A-2)

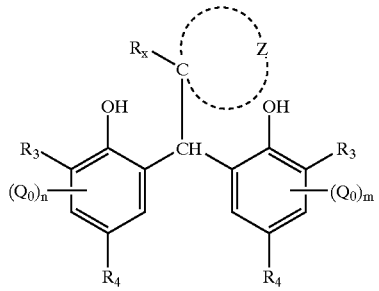

wherein Z is an atom group necessary to form a 3- to 10-membered non-aromatic ring together with a carbon atom; $R_x$ is a hydrogen atom or an alkyl group; $R_3$ and $R_4$ are a hydrogen atom, an alkyl group, an aryl group or a heterocyclic group; $Q_0$ is a group capable of being substituted on a benzen ring; n and m are each an integer of 0 to 2; and plural $R_3$s, $R_4$s or $Q_0$s may be the same or different from each other. Further, it is more preferable that the non-aromatic ring formed by z in Formula (A-2) is a 6-membered non-aromatic ring.

It is also preferable that the bisphenol derivative in the reducing agent B is represented by following Formula (A-3), Formula (A-3)

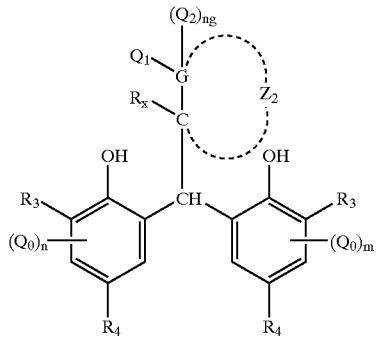

wherein $Q_1$ is a halogen atom, an alkyl group, an aryl group or a heterocyclic group; $Q_2$ is a hydrogen atom, a halogen atom, an alkyl group, an aryl group or a heterocyclic group; G is a nitrogen atom or a carbon atom; ng is 0 when G is a nitrogen atom; ng is 0 or 1 when G is a carbon atom; $Z_2$ is an atom group necessary to form a 3- to 10-membered non-aromatic ring together with a carbon atom; $R_x$ is a hydrogen atom or an alkyl group; $R_3$ and $R_4$ are a hydrogen atom, an alkyl group, an aryl group or a heterocyclic group; $Q_0$ is a group capable of being substituted on a benzene ring; n and m are each an integer of 0 to 2; and plural $R_3$s, $R_4$s or $Q_0$s may be the same or different from each other. Further, it is more preferable that the non-aromatic ring formed by $Z_2$ in Formula (A-3) is a non-aromatic 6-membered ring.

Especially, in the present invention, the photothermographic material preferably comprises a layer containing at least a silver-saving agent selected from the group consisting of a vinyl compound, a hydrazine derivative and a a quaternary onium salt. The average diameter of the silver halide grain is preferably 10 to 35 nm. Further, it is more preferable that the photothermographic material comprises a silver halide grains having an average diameter of 10 to 35 nm and a silver halide grains having an average diameter of 45 to 100 nm. It is preferable that the silver halide grains are chemically sensitized by utilizing a chalcogen compound. The silver amount contained in the image forming layer is preferably 0.3 to 1.5 g/$m^2$.

Another embodiment of the present invention is a photothermographic material comprising a support and having thereon an image forming layer containing an organic siver salt, light-sensitive silver halide grains, a reducing agent, a binder and a cross-linking agent. The cross-linking agent in the photothermographic material contains at least a poly-functional carbodiimide compound. It is preferable that the silver amount of the photothermographic material is 0.5 to 1.5 g/$m^2$. It is also preferable that the image forming layer has a thermal transition point of 46 to 200° C. after the photothermographic material being subjected to developing at a temperature of not less than 100° C. Further, it is more preferable that the poly-functional carbodiimide compound is a poly-functional aromatic carbodiimide.

It is preferable that the poly-functional carbodiimide compound is represented by following $$R_1\text{-}J_1\text{-}N{=}C{=}N\text{-}J_2\text{-}(L)_n\text{-}(J_3\text{-}N{=}C{=}N\text{-}J_4\text{-}R_2)_v \qquad \text{Formula (CI)}$$

wherein $R_1$ and $R_2$ are each an aryl group or an alkyl group; $J_1$ and $J_4$ are each a bivalent linkage group; $J_2$ and $J_3$ are each an arylene group or an alkylene group; L is an alkyl group, an alkenyl group, an aryl group, or a heterocyclic group which is (v+1)-valent, or a bond; v is an integer of 1 or more; and n is 1 or 2.

Another embodiment is an image forming method utilizing a thermal development apparatus comprising a photothermographic material supplying section, an image exposing section, and a thermally developing section. The image forming method comprises the steps of: transporting the photothermographic material of the present invention from the photothermographic material supplying section to the image exposing section at transporting rate of 20 to 200 mm/sec; exposing the photothermographic material to light at the image exposing section while transporting the photothermographic material at transporting rate of 20 to 200 mm/sec; and thermally developing the photothermographic material at the thermally developing section while transporting the photothermographic material at transporting rate of 20 to 200 mm/sec.

DETAILED DESCRIPTION OF THE INVENTION

Figure 1:
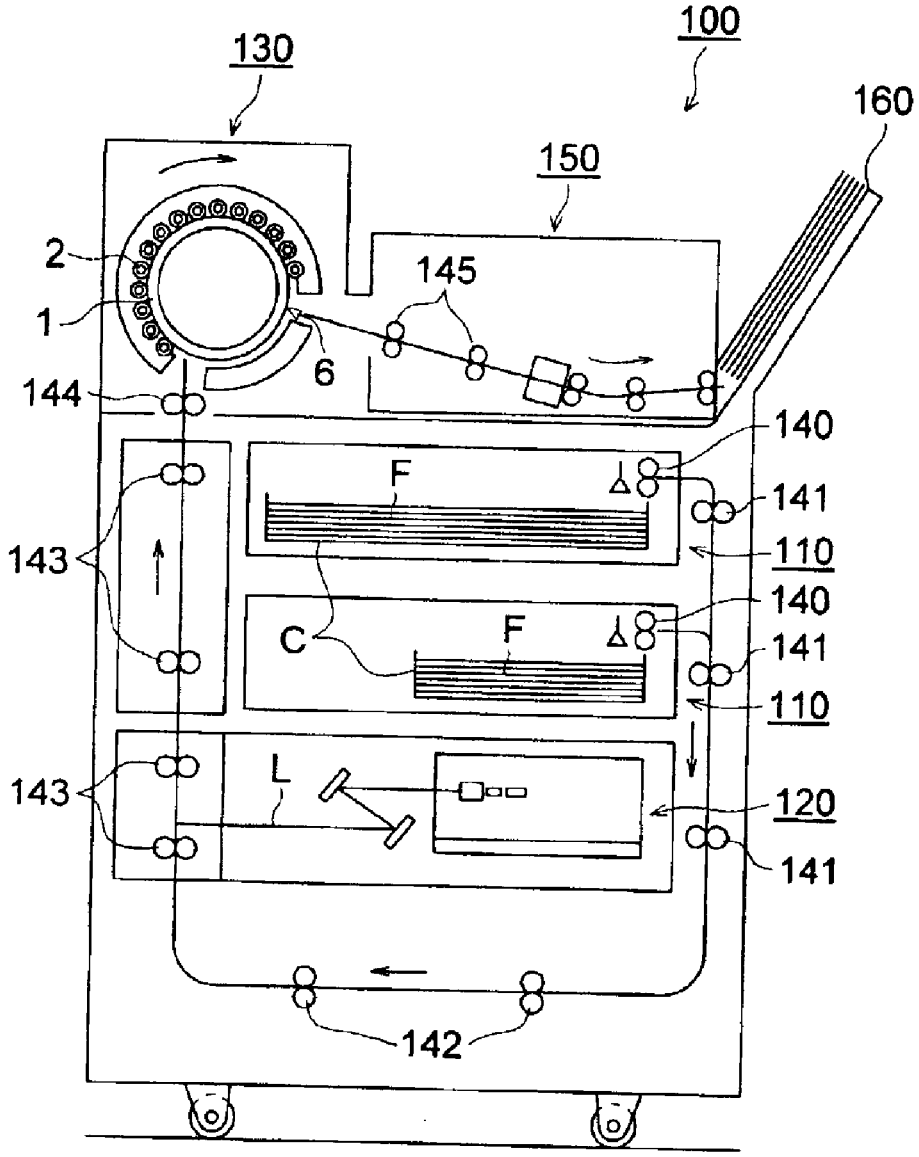
FIG. 1 is a specific example of a thermal development apparatus.

In the following, the present invention will be detailed.

In the present invention, the percentage of the reducing agent, represented by formula (A-1) is preferably 5 to 45% by weight based on the total amount of the reducing agents comprising bisphenol derivatives, more preferably is 10 to 40% by weight, and still more preferably 15 to 35% by weight. In cases when the percentage of the reducing agent represented by formula (A-1) is less than 5% by weight based on the total amount of the reducing agents comprising bisphenol derivatives, the improvement of silver color tone tends to be not sufficient and is usually tinged bluish. On the other hand, in cases when the percentage of the reducing agent represented by formula (A-1) exceeds 45% by weight based on the total amount of the reducing agents comprising bisphenol derivatives, the silver color tone exhibits an extremely yellowish image, being unpreferable.

In the present invention, the reducing agent of formula (A-1) is preferably used together with the reducing agent of formula (A-2). The ratio of simultaneous use is preferably {weight of the reducing agent of formula (A-1)}:{weight of the reducing agent of formula (A-2)}=10:90 to 40:60, more preferably 15:85 to 35:65.

In the present invention, the reducing agent of formula (A-1) is preferably used together with the reducing agent of formula (A-3), also. The ratio of simultaneous use is preferably {weight of the reducing agent of formula (A-1)}:{weight of the reducing agent of formula (A-3)}= 10:90 to 40:60, more preferably 15:85 to 35:65.

In the present invention, the average grain size of silver halide is preferably 10 to 35 nm. In cases when the average grain size of silver halide is less than 10 nm, the image density may be lowered, or the image stability under light may deteriorate. In cases when it is more than 35 nm, the image density may also be lowered. The average grain size as described herein is defined as an average edge length of silver halide grains, in cases where they are so-called regular crystals such as a cube or octahedron. Furthermore, in cases where grains are tabular grains, the grain size refers to the diameter of a circle having the same area as the projected area of the major face. In cases where grains are not regular crystals, for example, spherical grains or bar-like grains, the average grain size is determined from the diameter of a sphere regarding the grain size, the sphere volume of which is the same as the grain volume. Measurement is conducted with an electron microscope and the average grain size is determined by averaging 300 measured grains.

In the present invention, the image density may be enhanced and the lowered image density over time may be improved when silver halide having an average grain size of 45 to 100 nm is used together with silver halide having an average grain size of 10 to 35 nm. The weight ratio of silver halide having an average grain size of 10 to 35 nm and silver halide having an average grain size of 45 to 100 nm is preferably 95:5 to 50:50, and more preferably 90:10 to 60:40.

Further, the transfer speed in the thermo-development section using a heated drum in a thermal processing apparatus is preferably 20 to 200 mm/sec., is more preferably 25 to 150 mm/sec., and is still more preferably 30 to 100 mm/sec.

The transfer speed between the light-sensitive material feeding section and the image exposure section in a thermal processing apparatus is preferably 20 to 200 mm/sec., is more preferably 25 to 150 mm/sec., and is still more preferably 30 to 100 mm/sec.

The transfer speed in the image exposure section in a thermal processing apparatus is preferably 20 to 200 mm/sec., is more preferably 25 to 150 mm/sec., and is still more preferably 30 to 100 mm/sec.

The organic silver salts used in this invention are reducible silver source, and silver salts of organic acids or organic heteroacids are preferred, and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligand having a total stability constant to silver ions of 4.0 to 10.0 are preferred, as described in Research Disclosure (hereinafter, referred to as RD) 17029 and 29963. Exemplary preferred silver salts are described below.

Exemplary preferred organic silver salts include; organic acid salts (e.g., salts of gallic acid, oxalic acid, behenic acid, stearic acid, arachidic acid, palmitic acid, lauric acid, etc.); carboxyalkylthiourea silver salts (e.g., 1-(3-carboxypropyl) thiourea, 1-(3-caroxypropyl)-3,3-dimethylthiourea, etc.); silver complexes of polymer reaction products of aldehyde with hydroxy-substituted aromatic carboxylic acid (e.g., aldehydes such as formaldehyde, acetaldehyde, butylaldehyde), hydroxy-substituted acids (e.g., salicylic acid, benzoic acid, 3,5-dihydroxybenzoic acid, 5,5-thiodisalicylic acid, silver salts or complexes of thiones (e.g., 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. Of these organic silver salts, silver salts of long-chain fatty acids (10 to 30 carbon atoms, but preferably 15 to 25 carbon atoms) such as silver salts of behenic acid, arachidic acid and stearic acid are specifically preferred.

A mixture of two or more kinds of organic silver salts is preferably used, which usually result in enhanced developability and forming silver images exhibiting relatively high density and high contrast. For example, preparation by adding a silver ion solution to a mixture of two or more kinds of organic acids is preferable.

Organic silver salt compounds can be obtained by mixing an aqueous-soluble silver compound with a compound capable of forming a complex. Normal precipitation, reverse precipitation, double jet precipitation and controlled double jet precipitation, as described in JP-A 9-127643 are preferably employed. For example, to an organic acid can be added an alkali metal hydroxide (e.g., sodium hydroxide, potassium hydroxide, etc.) to form an alkali metal salt soap of the organic acid (e.g., sodium behenate, sodium arachidinate, etc.), thereafter, the soap and silver nitrate are mixed by a controlled double jet method to form organic silver salt crystals. In this case, silver halide grains may be concurrently present.

Organic silver salt grains may be of almost any shape but are preferably tabular grains. Tabular organic silver salt grains are specifically preferred, exhibiting an aspect ratio of 3 or more and a needle form ratio of not less than 1.1 and less than 10.0 of a needle form ratio measured from the major face direction, thereby lessening anisotropy of substantially two parallel faces having the largest area (so-called major faces). The more preferred needle form ratio is between 1.1 and 5.0.

The expression "comprises tabular organic silver salt grains exhibiting an aspect ratio of 3 or more" means that at least 50% by number of the total organic silver salt grains is accounted for by such tabular grains having an aspect ratio of 3 or more. The organic silver salt grains having an aspect ratio of 3 or more account for more preferably at least 60% by number, still more preferably at least 70% by number, and specifically preferably at least 80% by number.

Tabular organic silver salt particles having an aspect ratio of 3 or more refer to organic salt grains exhibiting a ratio of grain diameter to grain thickness, a so-called aspect ratio (also denoted as AR) of 3 or more, which is defined below:

AR=diameter ($\mu$m)/thickness ($\mu$m)

The aspect ratio of tabular organic silver salt grain is preferably within the range of 3 to 20, and more preferably 3 to 10. In the case of an aspect ratio of less than 3, the organic salt particles easily form densest packing and in the case of the aspect ratio being excessively high, organic silver salt grains are easily superposed and dispersed in a coating layer when brought into contact with each other, easily causing light scattering and leading to deterioration in transparency of the photothermographic material.

Grain diameter is determined in the following manner. An organic silver salt dispersion was diluted, dispersed on a grid provided with a carbon support membrane, and then photographed at a direct magnification of 5,000 times using a transmission type electron microscope (TEM, 2000 FX type, available from Nihon Denshi Co., Ltd.). The thus obtained negative electron micrographic images were read as a digital image by a scanner to determine the diameter (circular equivalent diameter) using appropriate software. At least 300 grains were so measured to determine an average diameter.

Grain thickness is determined in the following manner using a transmission type electron microscope.

First, a light-sensitive layer, coated onto a support, is pasted onto a suitable holder employing an adhesive and cut perpendicular to the support surface employing a diamond knife to prepare an ultra-thin 0.1 to 0.2 $\mu$m slice. The thus prepared ultra-thin slice is supported on a copper mesh, and placed onto a carbon membrane, which has been made hydrophilic by means of a glow discharge. Then, while cooling the resulting slice to not more than −130° C. using liquid nitrogen, the image in a bright visual field is observed at a magnifications of 5,000 to 40,000 employing a transmission electron microscope (hereinafter referred to as TEM), and then images are quickly recorded employing an image plate, a CCD camera, etc. In such cases, it is recommended to suitably select a portion of said slice in the visual field for observation, which has neither been torn nor distorted.

The carbon membrane, which is supported by an organic film such as an extremely thin collodion, Formvar, etc., is preferably employed, and a film composed of only carbon, which is obtained by forming the film on a rock salt substrate and then dissolving away the substrate or by removing the foregoing organic film, employing an organic solvent or ion etching, is more preferably employed. The acceleration voltage of said TEM is preferably 80 to 400 kV, and is most preferably 80 to 200 kV.

The TEM image, recorded in an appropriate medium, is decomposed to at least 1024×1024 pixels or preferably at least 2048×2048 pixels, and is then subjected to image processing employing a computer. In order to carry out image processing, an analogue image recorded on a film strip is converted into a digital image employing a scanner etc., and the resulting image is preferably subjected to shading correction, contrast-edge enhancement, etc., based on specific requirements. Thereafter, a histogram is prepared and the portions corresponding to organic silver are extracted employing binary processing.

At least 300 grains of the organic silver salt were manually measured with respect to the thus extracted thickness, employing appropriate software.

The average of the needle ratio of the tabular organic silver salt grains is determined according to the procedures described below.

First, a light sensitive layer, comprising tabular organic silver salt grains, is allowed to swell by employing an organic solvent which is capable of dissolving the binder of said light sensitive layer, and said layer is then peeled from the support. The operation is repeated five times, in which the peeled layer is subjected to ultrasonic cleaning with the above-mentioned solvent, and centrifugal separation, after which the supernatant is removed. Further, the above-mentioned process is carried out under a photographic safelight. Subsequently, dilution is carried out employing MEK (methyl ethyl ketone) so that the concentration of the organic silver solid portion becomes 0.01 percent. After carrying out ultrasonic dispersion, the resulting dispersed solution is dropped onto a polyethylene terephthalate film which has been made to be hydrophilic employing a glow discharge, and is subsequently dried. The film, on which said grains are placed, is subjected to oblique evaporation of 3 nm thickness Pt-C by an electron beam, from a 30° angle to the film surface, employing a vacuum evaporation unit, and thereafter, is preferably employed for observation.

Details of other means such as electron microscopic technology and sample preparation techniques can be referred to in "Igaku.Seibutsugaku Denshikenbikyo Kansatsuho (Medical and Biological Electron Microscopy", edited by Nippon Denshikenbikyo Gakkai, Kanto-Shibu, (Maruzen), and in "Denshikenbikyo Seibutsu Shiryo Sakuseiho (Preparation Method of Biological Samples for Electron Microscopy)", edited by Nippon Denshikenbikyo Gakkai, Kanto-Shibu, (Maruzen).

The prepared sample is observed through a secondary electron image, obtained by employing a field emission scanning electron microscope (hereinafter referred to as PE-SEM) under a magnification of 5,000 to 20,000 at an acceleration voltage of 2 to 4 kV, and the resulting image is stored on suitable recording media.

For the above-mentioned processing, it is convenient to use a device which is capable of directly recording the image data as digital information, which is obtained by AD converting image signals from the electron microscope body. However, analogue images if desired, can be recorded onto Polaroid film etc. converted to digital images employing a scanner etc., and the resulting images may be employed upon carrying out shading correction, contrast enhancement as well as edge enhancement, etc.

One image recorded in a suitable medium is decomposed to at least 1024×1024 pixels and preferably decomposed to 2048×2048 pixels. Said decomposed image is preferably subjected to image processing employing a computer.

Procedures of the above-mentioned image processing are as follows. First, a histogram is prepared and portions corresponding to tabular organic silver salt grains having an aspect ratio of 3 or more are extracted employing binary processing. Inevitable coagulated grains are cut employing a suitable algorithm or a manual operation and are subjected to boarder extract. Thereafter, both maximum length (MX LNG) and minimum width (WIDTH) between two parallel lines are measured for at least 1,000 grains, and the needle ratio of each grain is obtained employing the formula described below. The maximum length (MX LNG) is the maximum value of the straight length between two points within a grain. The minimum width between two parallel lines is the minimum distance of two parallel lines drawn circumscribing the grain.

Needle ratio=(MX LNG)/(WIDTH)

Thereafter, the number average of the needle ratio is calculated for all measured particles. When measurements are carried out employing the above-mentioned procedures, it is desirable that in advance, employing a standard sample, the length correction (scale correction) per pixel as well as two-dimensional distortion correction of the measurement system is adequately carried out. As standard samples, Uniform Latex Particles (DULP) marketed by Dow Chemical Co. in the USA are suitable. Polystyrene particles having a variation coefficient of less than 10 percent for a diameter of 0.1 to 0.3 $\mu$m are preferred. Specifically, a type having a particle diameter of 0.212 $\mu$m as well as a standard deviation of 0.0029 $\mu$m is commercially available.

Details of image processing technology may be had by referring to "Gazoshori Oyogijutsu (Applied Technology in Image Processing)", edited by Hiroshi Tanaka, (Kogyo Chosa Kai). Image processing programs or apparatuses are not particularly restricted, as long as the above-mentioned operation is possible. Cited as one example is Luzex-III, manufactured by Nireko Co.

Methods to prepare organic silver salt grains having the above-mentioned shape are not particularly restricted. The optimization of various conditions such as maintaining the mixing state during the formation of an organic acid alkali metal salt soap and/or the mixing state during the addition of silver nitrate to said soap.

After tabular organic silver salt grains employed in the present invention are preliminarily dispersed together with binders, surface active agents, etc., then if desired, the resulting mixture is preferably dispersed and pulverized by a media homogenizer, a high pressure homogenizer, or the like. During said preliminary dispersion, ordinary stirrers such as an anchor type, a propeller type, etc., a high speed rotation centrifugal radial type stirrer (Dissolver), as a high speed shearing stirrer (homomixer), may be employed.

Furthermore, employed as said media homogenizers may be rolling mills such as a ball mill, a satellite ball mill, a vibrating ball mill, medium agitation mills such as a bead mill, an atriter, and other types such as a basket mill. Employed as high pressure homogenizers may be various types such as a type in which collision occurs against a wall or a plug, a type in which liquid is divided into a plurality of portions and said portions are subjected to collision with each other, a type in which liquid is forced to pass through a narrow orifice, etc.

Examples of ceramics employed as the ceramic beads include $Al_2O_3$, $BaTiO_3$, $SrTiO_3$, MgO, ZrO, BeO, $Cr_2O_3$, $SiO_2$, $SiO_2$—$Al_2O_3$, $Cr_2O_3$—MgO, MgO—CaO, MgO—C, MgO—$Al_2O_3$ (spinel), SiC, $TiO_2$, $K_2O$, $Na_2O$, BaO, PbO, $B_2O_3$, $BeAl_2O_4$, $Y_3Al_5O_{12}$, $ZrO_2$—$Y_2O_3$ (cubic zirconia), 3BeO—$Al_2O_3$-6$SiO_2$ (artificial emerald), C (artificial diamond), $SiO_2$-n$H_2O$, silicone nitride, yttrium-stabilized-zirconia, and zirconia-reinforced-alumina. Yttrium-stabilized-zirconia and zirconia-reinforced-alumina (hereinafter referred to as zirconia for short which ceramics contain zirconia) are preferably employed in view that little impurity is generated by friction among the beads or the classifier during classifying them.

In devices employed for dispersing the tabular organic silver salt grains employed in the present invention, preferably employed as members which are in contact with the organic silver salt grains are ceramics such as zirconia, alumina, silicone nitride, boron nitride, or diamond. Of these, zirconia is the one most preferably employed.

While carrying out the above-mentioned dispersion, a binder is preferably added so as to achieve a concentration of 0.1 to 10 wt % with reference to the weight of the organic silver salt, and the temperature is preferably maintained at no less than 45° C. from the time of preliminary dispersion to the main dispersion process. An example of the preferable operation conditions of a homogenizer, when employing high-pressure homogenizer as the dispersing machine, is two or more operations at 29.42 to 98.06 MPa. In cases when a media-dispersing machine is employed, a circumferential speed of 6 to 13 m/sec. is preferable.

One preferable embodiment of the photothermographic material of the invention is the light-sensitive emulsion coated material of the organic silver salt particles and the light-sensitive silver halide, of which when the organic salt particle cross section being vertical to the support of the photothermographic material, is observed through an electron microscope, organic silver salt particles exhibiting a grain projected area of less than 0.025 $\mu m^2$ account for at least 70% of the total grain projected area and organic silver salt particles exhibiting a grain projected area of not less than 0.2 $\mu m^2$ account for not more than 10% of the total grain projected area. In such cases, coagulation of the organic silver salt grains is minimized in the light-sensitive emulsion, resulting in a more homogeneous distribution thereof.

Conditions for preparing the light sensitive emulsion having such features are not specifically limited but include, for example, mixing at the time of forming an alkali metal soap of an organic acid and/or mixing at the time of adding silver nitrate to the soap being maintained in a favorable state, optimization of the ratio of soap to silver nitrate, the use of a media dispersing machine or a high pressure homogenizer for dispersing pulverization, wherein dispersion is conducted preferably in a binder content of 0.1 to 10% by weight, based on the organic silver salt, the dispersion including the preliminary dispersion is carried out preferably at a temperature of not higher than 45° C., and a dissolver as a stirrer, is preferably operated at a circumferential speed of at least 2.0 m/sec.

The projected area of organic silver salt grains having a specified projection area and the desired proportion thereof, based on the total grain projection area can be determined a the method using a transmission type electron microscope (TEM) in a similar manner, as described in the determination of the average thickness of tabular grains.

In this case, coagulated grains are regarded as a single grain when determining the grain area (AREA). At least 1000 grains, and preferably at least 2000 grains are measured to determine the area and classified into three groups, i.e., A: less than 0.025 $\mu m^2$, B: not less than 0.025 $\mu m^2$ but less than 0.2 $\mu m^2$, and C: more than 0.2 $\mu m^2$. In this invention, it is preferable that the total projected area of grains falling within the range of "A" accounts to at least 70% of the projected area of the total grains, and the total projected area of grains falling within the range of "C" accounts to not more than 10% of the projected area of the total grains.

When measurements are carried out employing the above-mentioned procedures, it is desirable that in advance, employing a standard sample, length correction (scale correction) per pixel as well as two-dimensional distortion correction of the measurement system is adequately carried out, as described in the determination of the average of the needle ratio.

As mentioned earlier, details of image processing technology may be seen by referring to "Gazoshori Oyogijutsu (Applied Technology in Image Processing)", edited by Hiroshi Tanaka, (Kogyo Chosa Kai). Image processing programs or apparatuses are not particularly restricted, as long as the above-mentioned operation is possible. Cited as one example is Luzex-III, manufactured by Nireko Co.

The organic silver salt grains used in this invention are preferably monodispersed. The degree of monodispersion is preferably 1 to 30% and monodispersed particles in this range lead to the desired high density images. The degree of monodispersion is defined below:

$$\text{Degree of monodispersion}=\{(\text{standard deviation of particle size})/(\text{average particle size})\}\times 100\ (\%)$$

The average particle size of organic silver salt is preferably 0.01 to 0.3 $\mu$m, and more preferably 0.02 to 0.2 $\mu$m. The particle size refers to the diameter of a circle having an area equivalent to the projected area of the particle (i.e., circular equivalent diameter).

To prevent hazing of the light-sensitive material, the total amount-of silver halide and organic silver salt is preferably equivalent to 0.3 to 1.5 g when converted to silver per $m^2$, thereby leading to high contrast images. Desirable images for medical use can be obtained when the amount is within this range. The image density may be too low when the amount is less than 0.3 g/m2. When it is more than 1.5 g/m2, fogging density may increase and sensitivity of printing to PS plates may be decreased.

A compound functioning as a crystal growth retarder or a surfactant of this invention is a compound having a function and effect of miniaturizing and monodispersing in a production process of aliphatic carboxyl acid silver salt grains, of which function and effect are exhibited much effectively under the presence of this compound compared to the production without the presence of the compound. Examples include monohydric alcohols having less than 10 carbon atoms, and preferred examples are secondary alcohols, tertiary alcohols, glycols e.g., ethylene glycol, propylene glycol), polyethers (e.g., polyethylene glycol), and glycerine. The preferred added amount is 10 to 200 wt % of the aliphatic carboxyl acid silver salt.

On the other hand, a branched aliphatic carboxylic acid including each isomer may also be preferably used, those being isoheptanoic acid, isodecanoic acid, isotridecanoic acid, isomyristic acid, isoparmitic acid, isostearic acid, isoarachidic acid, isobehenic acid, and isohexanoic acid. In this case, a preferred side chain is an alkyl group or an alkenyl group having fewer than 4 carbon atoms. An unsaturated aliphatic carboxyl acid such as palmitoleic acid, oleic acid, linolenic acid, moloctinoic acid, eicosanoic acid, arachidonic acid, eicosenic acid, erucic acid, docosapentaenoic acid, docosahexaenoic acid, or celacholeic acid, is also acceotable. The preferred added amount is 0.5 to 10 mol % of the aliphatic carboxylic acid silver salt.

Examples of the preferred compounds include glycosides (e.g., glucoside, galactoside, fructoside), trehalose-type disaccharides (e.g., treharose, sucrose), polysaccharides (e.g., glycogen, dextrin, dextran, alginic acid), cellosolves (methyl cellosolve, ethyl cellosolve), water-soluble organic solvent (e.g., sorbitan, sorbit, ethyl acetate, methyl acetate, dimethylformamide), and water-soluble polymers (e.g., polyvinyl alcohol, poliacrylic acid, acrylic acid copolymer, maleic acid copolymer, carboxymethyl cellulose, hydroxypropyl cellulose, hydroxypropylmethyl cellulose, polyvinyl pyrrolidone, and gelatin). The preferred added amount is 0.1 to 20 wt % of the aliphatic carboxylic acid silver salt.

Alcohols having fewer than 10 carbon atoms, preferably secondary alcohols and tertiary alcohols, function form the monodispersed and miniaturized (small grain diameter) silver salt grains with increased stirring efficiency by decreasing solution viscosity due to the increased solubility of sodium aliphatic carboxyl acid in an emulsification process. A branched aliphatic carboxylic acid and unsaturated aliphatic carboxylic acid exhibit higher stearic hindrance and bigger crystal lattice deterioration compared to a main component of a straight chain aliphatic carboxylic acid when the aliphatic carboxylic acid silver salt grains are crystallized. Consequently, large grains tend not to be generated and primarily minute grains are produced as a result.

The silver halide (hereinafter, referred to as also light-sensitive silver halide grain or silver halide grain) will now be detailed. Silver halide means the silver halide grain prepared so as to generate chemicophysical changes inside and/or on the surface of the silver halide crystal with absorption of any region of light of wave length from the ultra violet region to the infrared region, of which silver halide can naturally absorb light as a specific characteristic of silver halide crystals, or can absorb visible rays or infrared rays by artificial chemicophysical methods.

The silver halide grains used in the invention can be prepared according to the methods described in P. Glafkides, Chimie Physique Photographique (published by Paul Montel Corp., 1967); G. F. Duffin, Photographic Emulsion Chemistry (published by Focal Press, 1966); V. L. Zelikman et al., Making and Coating of Photographic Emulsion (published by Focal Press, 1964). Any one of acidic precipitation, neutral precipitation and ammoniacal precipitation is applicable and the reaction mode of aqueous soluble silver salt and halide salt includes single jet addition, double jet addition and a combination thereof. Specifically, preparation of silver halide grains with controlling the grain formation condition, so-called controlled double-jet precipitation is preferred. The halide composition of silver halide is not specifically limited and may be any one of silver chloride, silver chlorobromide, silver iodochlorobromide, silver bromide, silver iodobromide and silver iodide.

The grain forming process is usually classified into two stages of formation of silver halide seed crystal grains (nucleation) and grain growth. These stages may continuously be conducted, or the nucleation (seed grain formation) and grain growth may be separately performed. The controlled double-jet precipitation, in which grain formation is undergone with controlling grain forming conditions such as pAg and pH, is preferred to control the grain form or grain size. In cases when nucleation and grain growth are separately conducted, for example, a soluble silver salt and a soluble halide salt are homogeneously and promptly mixed in an aqueous gelatin solution to form nucleus grains (seed grains), thereafter, grain growth is performed by supplying soluble silver and halide salts, while being controlled at a pAg and pH to prepare silver halide grains. After completing the grain formation, the resulting silver halide grain emulsion is subjected to desalting to remove soluble salts by commonly known washing methods such as a noodle washing method, a flocculation method, a ultrafiltration method, or electrodialysis to obtain desired emulsion grains.

In order to minimize cloudiness after image formation and to obtain excellent image quality, the smaller the average grain size, the better, in addition the average grain size is preferably between 0.035 and 0.055 μm, while grains less than 0.02 μm were not measured. The average grain size as described herein is defined as an average edge length of silver halide grains, in cases where they are so-called regular crystals in the form of a cube or an octahedron. Furthermore, in cases where grains are tabular grains, the grain size refers to the diameter of a circle having the same area as the average projected area of the major face.

In the invention, silver halide grains are preferably monodisperse grains. The monodisperse grains as described herein refer to grains having a coefficient of variation of grain size obtained by the formula described below of not more than 30%, more preferably not more than 20%, still more preferably not more than 15%.

Coefficient of variation of grain size (%)=(standard deviation of grain diameter/average grain diameter)×100

The grain form can be of almost any one, including cubic, octahedral or tetradecahedral grains, tabular grains, spherical grains, bar-like grains, and potato-shaped grains. Of these, cubic grains, octahedral grains, tetradecahedral grains and tabular grains are specifically preferred.

The aspect ratio of tabular grains is preferably 1.5 to 100, and more preferably 2 to 50. These grains are described in U.S. Pat. Nos. 5,264,337, 5,314,798 and 5,320,958 and desired tabular grains can be readily obtained. Silver halide grains having rounded corners are also preferably employed.

Crystal habit of the outer surface of the silver halide grains is not specifically limited, but in cases when using a spectral sensitizing dye exhibiting crystal habit (face) selectivity in the adsorption reaction of the sensitizing dye onto the silver halide grain surface, it is preferred to use silver halide grains having a relatively high proportion of the crystal habit meeting the selectivity. In cases when using a sensitizing dye selectively adsorbing onto the crystal face of a Miller index of [100], for example, a high ratio accounted for by a Miller index [100] face is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

It is preferred to use low molecular gelatin having an average molecular weight of not more than 50,000 in the preparation of silver halide grains used in the invention, specifically, in the stage of nucleation.

Thus, the low molecular gelatin has an average molecular eight of not more than 50,000, preferably 2,000 to 40,000, and more preferably 5,000 to 25,000. The average molecular weight can be determined by means of gel permeation chromatography. The low molecular weight gelatin can be obtained by subjecting an aqueous gelatin conventionally used and having an average molecular weight of ca. 100, 000, to enzymatic hydrolysis, acid or alkali hydrolysis, thermal degradation at atmospheric pressure, under high pressure, or ultrasonic degradation or the combination thereof.

The concentration of dispersion medium used in the nucleation stage is preferably not more than 5% by weight, and more preferably 0.05 to 3.0% by weight.

In the preparation of silver halide grains, it is preferred to use a compound represent by the following formula, specifically in the nucleation stage:

$$YO(CH_2CH_2O)m(CH(CH_3)CH_2O)p(CH_2CH_2O)nY \quad \text{General Formula}$$

where Y is a hydrogen atom, —$SO_3M$ or —CO—B—COOM, in which M is a hydrogen atom, alkali metal atom, ammonium group or ammonium group substituted by an alkyl group having carbon atoms of not more than 5, and B is a chained or cyclic group forming an organic dibasic acid; m and n each are 0 to 50; and p is 1 to 100.

Polyethylene oxide compounds represented by foregoing formula have been employed as a defoaming agent to inhibit marked foaming occurred when stirring or moving emulsion raw materials, specifically in the stage of preparing an aqueous gelatin solution, adding a water-soluble silver and halide salts to the aqueous gelatin solution or coating an emulsion on a support during the process of preparing silver halide photographic light sensitive materials. A technique of using these compounds as a defoaming agent is described in JP-A No. 44-9497. The polyethylene oxide compound represented by the foregoing formula also functions as a defoaming agent during nucleation.

The compound represented by the foregoing formula is used preferably in an amount of not more than 1%, and more preferably 0.01 to 0.1% by weight, based on silver.

The compound is to be present at the stage of nucleation, and may be added to a dispersing medium prior to or during nucleation. Alternatively, the compound may be added to an aqueous silver salt solution or halide solution used for nucleation. It is preferred to add it to a halide solution or both silver salt and halide solutions in an amount of 0.01 to 2.0% by weight. It is also preferred to make the compound represented by formula present over a period of at least 50% (more preferably, at least 70%) of the nucleation stage. The compound represented by the foregoing formula mat be added in the form of powder or methanol solution.

The temperature during the stage of nucleation is preferably 5 to 60° C., and more preferably 15 to 50° C. Even when nucleation is conducted at a constant temperature, in a temperature-increasing pattern (e.g., in such a manner that nucleation starts at 25° C. and the temperature is gradually increased to reach 40° C. at the time of completion of nucleation) or its reverse pattern, it is preferred to control the temperature within the range described above.

Silver salt and halide salt solutions used for nucleation are preferably in a concentration of not more than 3.5 mol/l, and more preferably 0.01 to 2.5 mol/l. The flow rate of aqueous silver salt solution is preferably $1.5\times10^{-3}$ to $3.0\times10^{-1}$ mol/min per lit. of the solution, and more preferably $3.0\times10^{-3}$ to $8.0\times10^{-2}$ mol/min. per lit. of the solution.

The pH during nucleation is within a range of 1.7 to 10, and since the pH at the alkaline side broadens the grain size distribution, the pH is preferably 2 to 6. The pBr during nucleation is 0.05 to 3.0, preferably 1.0 to 2.5, and more preferably 1.5 to 2.0.

Silver halide may be incorporated into an image forming layer by any means, in which silver halide is arranged so as to be as close to reducible silver source as possible.

It is general that silver halide grain, which has been prepared in advance, added to a solution used for preparing an organic silver salt grain. In this case, preparation of silver halide grain and that of an organic silver salt grain are separately performed, making it easier to control the preparation thereof. Alternatively, as described in British Patent 1,447,454, silver halide grain and an organic silver salt grain can be simultaneously formed by allowing a halide component to be present together with an organic silver salt-forming component and by introducing silver ions thereto.

Silver halide grain can also be prepared by reacting a halogen containing compound with an organic silver salt through conversion of the organic silver salt. Thus, a silver halide-forming component is allowed to act onto a preformed organic silver salt solution or dispersion or a sheet material containing an organic silver salt to convert a part of the organic silver salt to photosensitive silver halide.

The silver halide-forming components include inorganic halide compounds, onium halides, halogenated hydrocarbons, N-halogeno compounds and other halogen containing compounds. These compounds are detailed in U.S. Pat. Nos. 4,009,039, 3,457,075 and 4,003,749, British Patent 1,498,956 and JP-A 53-27027 and 53-25420. Exemplary examples thereof include inorganic halide compound such as a metal halide and ammonium halide; onium halides, such as trimethylphenylammonium bromide, cetylethyldimethylammonium bromide, and trimethylbenzylammonium bromide; halogenated hydrocarbons, such as iodoform, bromoform, carbon tetrachloride and 2-brom-2-methylpropane; N-halogenated compounds, such as N-bromosucciimde, N-bromophthalimide, and N-bromoacetoamide; and other halogen containing compounds, such as triphenylmethyl chloride, triphenylmethyl bromide, 2-bromoacetic acid, 2-bromoethanol and dichlorobenzophenone. As described above, silver halide can be formed by converting a part or all of an organic silver salt to silver halide through reaction of the organic silver salt and a halide ion. The silver halide separately prepared may be used in combination with silver halide grain prepared by conversion of at least apart of an organic silver salt.

Silver halides used in the invention preferably include ions of metals belonging to Groups 6 to 11 of the Periodic Table. Preferred as the metals are W, Fe, Co, Ni, Cu, Ru, Rh, Pd, Re, Os, Ir, Pt and Au. These metals may be introduced into the silver halide in the form of a complex. In the present invention, regarding the transition metal complexes, six-coordinate complexes represented by the general formula described below are preferred:

General Formula: $(ML_6)^m$:

wherein M represents a transition metal selected from elements in Groups 6 to 11 of the Periodic Table; L represents a coordinating ligand; and m represents 0, 1-, 2-, 3- or 4-. Exemplary examples of the ligand represented by L include halides (fluoride, chloride, bromide, and iodide), cyanide, cyanato, thiocyanato, selenocyanato, tellurocyanato, azido and aquo; nitrosyl, thionitrosyl, etc., of which aquo, nitrosyl and thionitrosyl are preferred. When the aquo ligand is present, one or two ligands are preferably coordinated. L may be the same or different.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. These compounds may be added several times by dividing the added amount. Uniform content in the interior of a silver halide grain can be carried out. As disclosed in JP-A No. 63-29603, 2-306236, 3-167545, 4-76534, 6-110146, 5-273683, the metal can be distributively occluded in the interior of the grain.

These metal compounds can be dissolved in water or a suitable organic solvent (e.g., alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

Silver halide grain emulsions used in the invention may be desalted after the grain formation, using the methods known in the art, such as the noodle washing method, flocculation process, ultrafiltration and electrodialysis. However, in the photothermographic material, the silver halide grain emulsion can be used without subjecting to desalting.

Silver halide grains used in the invention can be subjected to chemical sensitization. In accordance with methods described in Japanese Patent Application Nos. 2001-249428 and 2001-249426, for example, a chemical sensitization center (chemical sensitization speck) can be formed using compounds capable of releasing chalcogen such as sulfur or noble metal compounds capable of releasing a noble metal ion such as a gold ion. In the invention, it is preferred to conduct chemical sensitization using the foregoing compound containing chalcogen atom together with chemical sensitization using the noble metal compound.

In the invention, it is preferred to conduct chemical sensitization with an organic sensitizer containing a chalcogen atom, as described below.

Such a chalcogen atom-containing organic sensitizer is preferably a compound containing a group capable of being adsorbed onto silver halide and a labile chalcogen atom site.

These organic sensitizers include, for example, those having various structures, as described in JP-A Nos. 60-150046, 4-109240 and 11-218874. Specifically preferred of these is at least a compound having a structure in which a chalcogen atom is attached to a carbon or phosphorus atom through a double bond.

The amount of a chalcogen compound added as an organic sensitizer is variable, depending on the chalcogen compound to be used, silver halide grains and a reaction environment when subjected to chemical sensitization and is preferably $10^{-8}$ to $10^{-2}$ mol, and more preferably $10^{-7}$ to $10^{-3}$ mol per mol of silver halide. In the invention, the chemical sensitization environment is not specifically limited but it is preferred to conduct chemical sensitization in the presence of a compound capable of eliminating a silver chalcogenide or silver specks formed on the silver halide grain or reducing the size thereof, or specifically in the presence of an oxidizing agent capable of oxidizing the silver specks, using a chalcogen atom-containing organic sensitizer. To conduct chemical sensitization under preferred conditions, the pAg is preferably 6 to 11, and more preferably 7 to 10, the pH is preferably 4 to 10 and more preferably 5 to 8, and the temperature is preferably not more than 30° C.

In photothermographic materials used in the invention, it is preferred to use a light sensitive emulsion, in which light sensitive silver halide has been subjected to chemical sensitization using a chalcogen atom-containing organic sensitizer at a temperature of 30° C. or lower, concurrently in the presence of an oxidizing agent capable of oxidizing silver specks formed on the silver halide grains, then, mixed with an organic silver salt, dehydrated and dried.

Chemical sensitization using the foregoing organic sensitizer is also preferably conducted in the presence of a spectral sensitizing dye or a heteroatom-containing compound capable of being adsorbed onto silver halide grains. Thus, chemical sensitization in the present of such a silver halide-adsorptive compound results in prevention of dispersion of chemical sensitization center specks, thereby achieving enhanced sensitivity and minimized fogging. Although there will be described spectral sensitizing dyes used in the invention, preferred examples of the silver halide-adsorptive, heteroatom-containing compound include nitrogen containing heterocyclic compounds described in JP-A No. 3-24537. In the heteroatom-containing compound, examples of the heterocyclic ring include a pyrazolo ring, pyrimidine ring, 1,2,4-triazole ring, 1,2,3-triazole ring, 1,3,4-thiadiazole ring, 1,2,3-thiadiazole ring, 1,2,4-thiadiazole ring, 1,2,5-thiadiazole ring, 1,2,3,4-tetrazole ring, pyridazine ring, 1,2,3-triazine ring, and a condensed ring of two or three of these rings, such as triazolotriazole ring, diazaindene ring, triazaindene ring and pentazaindene ring. Condensed heterocyclic ring comprised of a monocycic hetero-ring and an aromatic ring include, for example, a phthalazine ring, benzimidazole ring indazole ring, and benzthiazole ring.

Of these, an azaindene ring is preferred and hydroxy-substituted azaindene compounds, such as hydroxytriazaindene, tetrahydroxyazaindene and hydroxypentazaundene compound are more preferred.

The heterocyclic ring may be substituted by substituent groups other than hydroxy group. Examples of the substituent group include an alkyl group, substituted alkyl group, alkylthio group, amino group, hydroxyamino group, alkylamino group, dialkylamino group, arylamino group, carboxy group, alkoxycarbonyl group, halogen atom and cyano group.

The amount of the heterocyclic ring containing compound to be added, which is broadly variable with the size or composition of silver halide grains, is within the range of $10^{-6}$ to 1 mol, and preferably $10^{-4}$ to $10^{-1}$ mol per mol silver halide.

As described earlier, silver halide grains can be subjected to noble metal sensitization using compounds capable of releasing noble metal ions such as a gold ion. Examples of usable gold sensitizers include chloroaurates and organic gold compounds.

In addition to the foregoing sensitization, reduction sensitization can also be employed and exemplary compounds for reduction sensitization include ascorbic acid, thiourea dioxide, stannous chloride, hydrazine derivatives, borane compounds, silane compounds and polyamine compounds. Reduction sensitization can also conducted by ripening the emulsion while maintaining the pH at not less than 7 or the pAg at not more than 8.3.

Silver halide to be subjected to chemical sensitization may be one which has been prepared in the presence of an organic silver salt, one which has been formed under the condition in the absence of the organic silver salt, or a mixture thereof.

Light sensitive silver halide grains used in the invention are preferably subjected to spectral sensitization by allowing a spectral sensitizing dye to adsorb to the grains. Examples of the spectral sensitizing dye include cyanine, merocyanine, complex cyanine, complex merocyanine, holo-polar cyanine, styryl, hemicyanine, oxonol and hemioxonol dyes, as described in JP-A Nos. 63-159841, 60-140335, 63-231437, 63-259651, 63-304242, 63-15245; U.S. Pat. Nos. 4,639,414, 4,740,455, 4,741,966, 4,751,175 and 4,835,096. Usable sensitizing dyes are also described in Research Disclosure (hereinafter, also denoted as RD) 17643, page 23, sect. IV-A (December, 1978), and ibid 18431, page 437, sect. X (August, 1978). It is preferred to use sensitizing dyes exhibiting spectral sensitivity suitable for spectral characteristics of light sources of various laser imagers or scanners. Examples thereof include compounds described in JP-A Nos. 9-34078, 9-54409 and 9-80679.

Useful cyanine dyes include, for example, cyanine dyes containing a basic nucleus, such as thiazoline, oxazoline, pyrroline, pyridine, oxazole, thiazole, selenazole and imidazole nuclei. Useful merocyanine dyes preferably contain, in addition to the foregoing nucleus, an acidic nucleus such as thiohydatoin, rhodanine, oxazolidine-dione, thiazolinedione, barbituric acid, thiazolinone, malononitrile and pyrazolone nuclei.

In the invention, there are also preferably used sensitizing dyes having spectral sensitivity within the infrared region. Examples of the preferred infrared sensitizing dye include those described in U.S. Pat. Nos. 4,536,478, 4,515,888 and 4,959,294.

The infrared sensitizing dye according to the invention is preferably a dye characterized in that the dye is a long chain polymethine dye, in which a sulfinyl group is substituted on the benzene ring of the benzothiazole ring.

The infrared sensitizing dyes and spectral sensitizing dyes described above can be readily synthesized according to the methods described in F. M. Hammer, The Chemistry of Heterocyclic Compounds vol. 18, "The cyanine Dyes and Related Compounds" (A. Weissberger ed. Interscience Corp., New York, 1964).

The infrared sensitizing dyes can be added at any time after preparation of silver halide. For example, the dye can be added to a light sensitive emulsion containing silver halide grains/organic silver salt grains in the form of by dissolution in a solvent or in the form of a fine particle dispersion, so-called solid particle dispersion. Similarly to the heteroatom containing compound having adsorptivity to silver halide, after adding the dye prior to chemical sensitization and allowing it to be adsorbed onto silver halide grains, chemical sensitization is conducted, thereby preventing dispersion of chemical sensitization center specks and achieving enhanced sensitivity and minimized fogging.

These sensitizing dyes may be used alone or in combination thereof. The combined use of sensitizing dyes is often employed for the purpose of supersensitization.

A super-sensitizing compound, such as a dye which does not exhibit spectral sensitization or substance which does not substantially absorb visible light may be incorporated, in combination with a sensitizing dye, into the emulsion containing silver halide grains and organic silver salt grains used in photothermographic materials of the invention.

Useful sensitizing dyes, dye combinations exhibiting super-sensitization and materials exhibiting supersensitization are described in RD17643 (published in December, 1978), IV-J at page 23, JP-B 9-25500 and 43-4933 (herein, the term, JP-B means published Japanese Patent) and JP-A 59-19032, 59-192242 and 5-341432. In the invention, an aromatic heterocyclic mercapto compound represented by the following formula is preferred as a supersensitizer:

Ar—SM General Formula wherein M is a hydrogen atom or an alkali metal atom; Ar is an aromatic ring or condensed aromatic ring containing a nitrogen atom, oxygen atom, sulfur atom, selenium atom or tellurium atom. Such aromatic heterocyclic rings are preferably benzimidazole, naphthoimidazole, benzthiazole, naphthothiazole, benzoxazole, naphthooxazole, benzoselenazole, benzotellurazole, imidazole, oxazole, pyrazole, triazole, triazines, pyrimidine, pyridazine, pyrazine, pyridine, purine, and quinoline. Other aromatic heterocyclic rings may also be included.

A mercapto derivative compound which is capable of forming a mercapto compound when incorporated into a dispersion of an organic silver salt or a silver halide grain emulsion is also included in the invention. In particular, a preferred example thereof is a mercapto derivative compound represented by the following formula:

Ar—S—S—Ar General Formula wherein Ar is the same as defined in the mercapto compound represented by the formula described earlier.

The aromatic heterocyclic rings described above may be substituted with a halogen atom (e.g., Cl, Br, I), a hydroxy group, an amino group, a carboxy group, an alkyl group (having one or more carbon atoms, and preferably1 to 4 carbon atoms) or an alkoxy group (having one or more carbon atoms, and preferably1 to 4 carbon atoms).

In addition to the foregoing supersensitizers, a compound described in Japanese Patent Application No. 2001-330918, represented by the following formula (1) and a macrocyclic compound can also employed as a supersensitizer in the invention:

Formula (1)

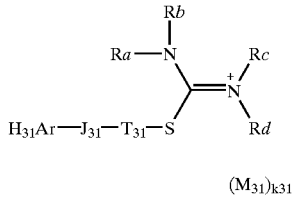

In the formula, $H_{31}Ar$ is an aromatic hydrocarbon group or an aromatic heterocyclic group, and $T_{31}$ is a bivalent, aliphatic hydrocarbon linkage group or a linkage group, and J31 is a bivalent linkage group containing at least one of an oxygen atom, a sulfur atom and a nitrogen atom or a linkage group. Each of Ra, Rb, Rc and Rd is a hydrogen atom, an acyl group, an aliphatic hydrocarbon group, an aryl group or a heterocyclic group, and a nitrogen containing heterocyclic group may be formed by combination of Ra and Rb, Rc and Rd, Ra and Rc, or Rb and Rd. $M_{31}$ is the ion necessary to neutralize an intramolecular charge, and $k_{31}$ is the number of the ion necessary to neutralize an intramolecular charge.

In the formula (1), the bivalent, aliphatic hydrocarbon linkage group represented by $T_{31}$ include a straight-chain, branched cyclic alkylene group (preferably having 1 to 20 carbon atoms, more preferably 1 to 16 carbon atoms, and still more preferably 1 to 12 carbon atoms), an alkenylene group (preferably having 2 to 20 carbon atoms, more preferably 2 to 16 carbon atoms, and still more preferably 2 to 12 carbon atoms), an alkynylene group (preferably having 2 to 20 carbon atoms, more preferably 2 to 16 carbon atoms, and still more preferably 2 to 12 carbon atoms).

Each of the foregoing groups may be substituted by substituent group(s). The examples of the substituent group include; an aliphatic hydrocarbon group such as a strait-, branched-chain or cyclic alkyl group (preferably having 1 to 20 carbon atoms, more preferably 1 to 16 carbon atoms and still more preferably 1 to 12 carbon atoms), an alkenyl group (preferably having 2 to 20 carbon atoms, more preferably 2 to 16 carbon atoms, and still more preferably 2 to 12 carbon atoms), an alkynyl (preferably having 2 to 20 carbon atoms, more preferably 2 to 16 carbon atoms, and still more preferably 2 to 12 carbon atoms); an aryl group such as an aryl group of a monocyclic ring or a condensed ring (preferably having 6 to 20 carbon atoms, e.g., phenyl, naphthyl, more preferably phenyl), and a heterocyclic group such as 3- to 10-membered saturated or unsaturated heteri-cyclic group (e.g., 2-thiazolyl, 1-piperadynyl, 2-pyridyl, 3-pyridyl, 2-furyl, 2-thienyl, 2-benzimidazolyl, carbazolyl, etc.).

The heterocyclic group may be a monocyclid ring or a ring condensed with other ring.

These groups each may be substituted at any position. Examples of such substituent groups include an alkyl group (including a cycloalkyl group and an aralkyl group, and preferably having 1 to 20 carbon atoms, more preferably 1 to 12 carbon atoms and still more preferably 1 to 8 carbon atoms, such as methyl, ethyl, n-propyl, isopropyl, n-butyl, tert-butyl, n-heptyl, n-octyl, n-decyl, n-undecyl, n-hexadecyl, cyclopropyl, cyclopentyl, cyclohexyl, benzyl, phenethyl), an alkenyl group (preferably having 2 to 20 carbon atoms, more preferably 2 to 12 carbon atoms, and still more preferably 2 to 8 carbon atoms, e.g., vinyl, allyl, 2-butenyl, 3-pentenyl, etc.), an alkynyl (preferably having 2 to 20 carbon atoms, more preferably 2 to 12 carbon atoms, and still more preferably 2 to 8 carbon atoms, e.g., propargyl, 3-pentynyl, etc.), aryl group (preferably having 6 to 30 carbon atoms, more preferably 6 to 20 carbon atoms, and still more preferably 6 to 12 carbon atoms, e.g., phenyl, p-tolyl, o-aminophenyl, naphthyl), an amino group (preferably having 0 to 20 carbon atoms, more preferably 0.10 carbon atoms, and still more preferably 0 to 6 carbon atoms, e.g., amino, methylamino, ethylamino, dimethylamino, diethylamino, diphenylamino, dibenzylamino, etc.), an imino group (preferably having 1 to 20 carbon atoms, more preferably 1 to 18 carbon atoms, and still more preferably 1 to 12 carbon atoms, e.g., methylimono, ethylimono, propylimino, phenylimino), an alkoxy group (preferably having 1 to 20 carbon atoms, more preferably 1 to 12 carbon atoms, and still more preferably 1 to 8 carbon atoms, e.g., methoxy, ethoxy, butoxy, etc.), an aryloxy group (preferably having 6 to 20 carbon atoms, more preferably 6 to 16 carbon atoms, and still more preferably 6 to 12 carbon atoms, e.g., phenyloxy, 2-naphthyloxy, etc.), an acyl group (preferably having 1 to 20 carbon atoms, more preferably 1 to 16 carbon atoms, and still more preferably 1 to 12 carbon atoms, e.g., acetyl, formyl, pivaloyl, benzoyl, etc.), an alkoxycarbonyl group (preferably having 2 to 20 carbon atoms, more preferably 2 to 16 carbon atoms, and still more preferably 2 to 12 carbon atoms, e.g., methoxycarbonyl, ethoxycarbonyl, etc.), an aryloxycarbonyl group (preferably having 7 to 20 carbon atoms, more preferably 7 to 16 carbon atoms, and still more preferably 7 to 10 carbon atoms, e.g., phenyloxycarbonyl, etc.), an acyloxy group (preferably having 1 to 20 carbon atoms, more preferably 1 to 16 carbon atoms, and still more preferably 1 to 10 carbon atoms, e.g., acetoxy, benzoyloxy, etc.), an acylamino group (preferably having 1 to 20 carbon atoms, more preferably 1 to 16 carbon atoms, and still more preferably 1 to 10 carbon atoms, e.g., acetylamino, benzoylamino, etc.), an alkoxycarbonylamino group (preferably having 2 to 20 carbon atoms, more preferably 2 to 16 carbon atoms, and still more preferably 2 to 12 carbon atoms, e.g., methoxycarbonylamino, etc.), an aryloxycarbonylamino group (preferably having 7 to 20 carbon atoms, more preferably 7 to 16 carbon atoms, and still more preferably 7 to 12 carbon atoms, e.g., phenyloxycarbonylamino, etc.), a sulfonylamino group (preferably having 1 to 20 carbon atoms, more preferably 1 to 16 carbon atoms, and still more preferably 1 to 12 carbon atoms, e.g., methanesulfonylamino, benzenesulfonylamino, etc.), a sulfamoyl group (preferably having 0 to 20 carbon atoms, more preferably 0 to 16 carbon atoms, and still more preferably 0 to 12 carbon atoms, e.g., sulfamoyl, methylsulfamoyl, dimethylsulfamoyl, phenylsulfamoyl, etc.), a carbamoyl group (preferably having 1 to 20 carbon atoms, more preferably 1 to 16 carbon atoms, and still more preferably 1 to 12 carbon atoms, e.g., carbamoyl, methylcarbamoyl, diethylcarbamoyl, phenylcarbamoyl, etc.), an alkylthio group (preferably having 1 to 20 carbon atoms, more preferably 1 to 16 carbon atoms, and still more preferably 1 to 12 carbon atoms, e.g., methylthio, ethylthio, etc.), arylthio group (preferably having 6–20 carbon atoms, more preferably 6 to 16 carbon atoms and still more preferably 6 to 12 carbon atoms, e.g., phenylthio), a sulfonyl group (preferably having 1 to 20 carbon atom, more preferably 1 to 16 carbon atoms, and still more preferably 1 to 12 carbon atoms, e.g., methanesulfonyl, tosyl), a sulfinyl group (preferably having 1 to 20 carbon atoms, more preferably 1 to 16 carbon atoms, and still more preferably 1 to 12 carbon atoms, e.g., methanesulfinyl, benzenesulfinyl, etc.), a ureido group (preferably having 1 to 20 carbon atoms, more preferably 1 to 16 carbon atoms, and still more preferably 1 to 12 carbon atoms, e.g., ureido, methylureido, phenylureido, etc.), a phosphoric acid amido group (preferably having 1 to 20 carbon atoms, more preferably 1 to 16 carbon atoms, and still more preferably 1 to 12 carbon atoms, e.g., diethylphosphoric acid amido, phenylphosphoric acid amido, etc.), hydroxyl group, mercapto group, a halogen atom (e.g., fluorine atom, chlorine atom, bromine atom, iodine atom), cyano group, sulfo group, sulfino group, carboxy group, phosphono group, phosphino group, nitro group, hydroxamic acid group, hydrazino group, and a heterocyclic group (e.g., imidazolyl, benzimidazolyl, thiazolyl, benzothiazolyl, carbazolyl, pyridyl, furyl, piperidyl, morphoryl. etc.).

Of these substituent groups described above, hydroxyl group, mercapto group, sulfo group, sulfino group, carboxyl group, phosphono group, and phosphino group include their salts. The substituent group may be further substituted. In this case, plural substituent may be the same or different. The preferred substituent groups include an alkyl group, aralkyl group, alkoxy group, aryl group, alkylthio group, acyl group, acylamino group, imino group, sulfamoyl group, sulfonyl group, sulfonylamino group, ureido group, amino group, halogen atom, nitro group, heterocyclic group, alkoxycarbonyl group, hydroxyl group, sulfo group, carbamoyl group, and carboxyl group. Specifically, an alkyl group, alkoxy group, aryl group, alkylthio group, acyl group, acylamino group, imino group, sulfonylamino group, ureido group, amino group, halogen atom, nitro group, heterocyclic group, alkoxycarbonyl group, hydroxyl group, sulfo group, carbamoyl group and carboxyl group are more preferred; and an alkyl group, alkoxy group, aryl group, alkylthio group, acylamino group, imino group, ureido group, amino group, heterocyclic group, alkoxycarbonyl group, hydroxyl group, sulfo group, carbamoyl group and carboxyl group are still more preferred. The amidino group (an oxo group in a carboxyl group is substituted with an imino group and a hydroxyl group is substituted with an amino group) include a substituted one and examples of the substituent group include an alkyl group (e.g., methyl, ethyl, pyridylmethyl, benzyl, phenethyl, carboxybenzyl, aminophenylmethyl, etc.), an aryl group (e.g., phenyl, p-tolyl, naphthyl, o-aminophenyl, o-methoxyphenyl, etc.), and a heterocyclic group (e.g., 2-thiazolyl, 2-pyridyl, 3-pyridyl, 2-furyl, 3-furyl, 2-thieno, 2-imidazolyl, benzothiazolyl, carbazolyl, etc.).

Examples of a bivalent linking group containing at least one of an oxygen atom, sulfur atom and nitrogen atom, represented by $J_{31}$ include the following groups, which may be combined:

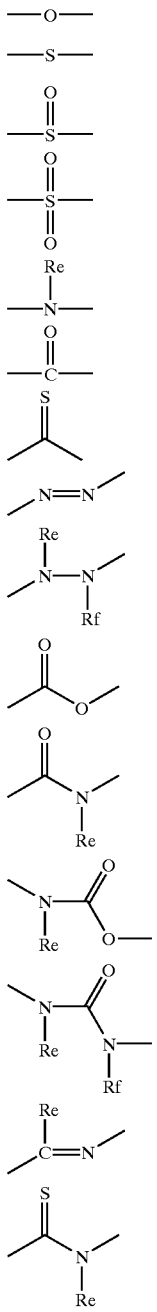

-continued

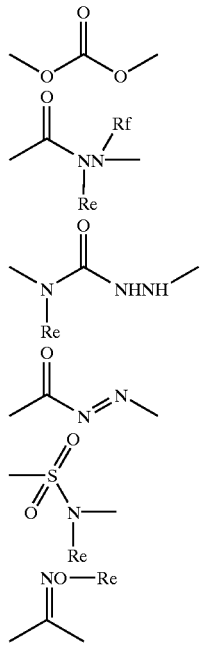

wherein Re and Rf are the same as defined in Ra through Rd.

H31 is an aromatic hydrocarbon group or an aromatic heterocyclic group. The aromatic hydrocarbon group represented by $ArH_{31}$ is a monocyclic or condensed aryl group (preferably having 6 to 30 carbon atoms, and more preferably 6 to 20 carbon atoms). Examples thereof include phenyl and naphthyl, and phenyl is specifically preferred. The aromatic heterocyclic group represented by $ArH_{31}$ is a 5- to 10-membered unsaturated heterocyclic group containing at least one of N, O and S, which may be monocyclic or condensed with other ring. A heterocyclic ring of the heterocyclic group is preferably a 5- or 6-membered aromatic heterocyclic ring or its benzo-condensed ring, more preferably a nitrogen-containing, 5- or 6-membered aromatic heterocyclic ring or its benzo-condensed ring, and still more preferably one or two nitrogen- containing, 5- or 6-membered aromatic heterocyclic ring or its benzo-condensed ring.

Examples of the aromatic heterocyclic group include groups derived from thiophene, furan, pyrrole, imidazole, pyrazolo, pyridine, pyrazine, pyridazine, triazole, triazine, indole, indazole, purine, thiadiazole, oxadiazole, quinoline, phthalazine, naphthylizine, quinoxaline, quinazoline, cinnoline, pteridine, acrydine, phenanthroline, phenazine, tetrazole, thiazole, oxazole, benzimidazole, benzoxazole, benzthiazole, benzothiazoline, benzotriazole, tetrazaindene, and carbazole. Of these, groups derived from imidazole, pyrazolo, pyridine, pyrazine, indole, indazole, thiadiazole, oxadiazole, quinoline, phenazine, tetrazole, thiazole, oxazole, benzimidazole, benzoxazole, benzthiazole, benzothiazoline, benzotriazole, tetrazaindene, and carbazole are preferred; and groups derived from imidazole, pyridine, pyrazine, quinoline, phenazine, tetrazole, thiazole, benzoxazole, benzoimidazole, benzthiazole, benzothiazoline, benzotriazole, and carbazole are more preferred.

The aromatic hydrocarbon group and aromatic heterocyclic group represented by $ArH_{31}$ may be substituted. The substituent group is the same as the substituent groups defined in $T_{31}$. The substituent group may be further substituted, and plural substituting group may be the same or different. Further, the group represented by $ArH_{31}$ is preferably an aromatic heterocyclic group.

The aliphatic hydrocarbon group, the aryl group and the heterocyclic group represented by Ra, Rb, Rc and Rd include, for example, the same groups defined in $T_{31}$. The acyl group represented by Ra, Rb, Rc and Rd include an aliphatic or aromatic group having 1 to 12 carbon atoms, such as acetyl, benzoyl, formyl, and pivaloyl. The nitrogen containing heterocyclic group formed by combination of Ra and Rb, Rc and Rd, Ra and Rc, or Rb and Rd includes a 3- to 10-membered, saturated or unsaturated heterocyclic ring (e.g., ring groups such as piperidine ring, piperazine ring, acridine ring, pyrrolidine ring, pyrrol ring and morpholine ring).

Examples of acid anions used as the ion necessary to neutralize an intramolecular charge, represented by $M_{31}$ include a halide ion (e.g., chloride ion, bromide ion, iodide ion, etc.), p-toluenesulfonate ion, perchlorate ion, tetrafluoroborate ion, sulfate ion, methylsulfate ion, ethylsulfate ion, methansufonic acid ion and trifluoromethanesulfonic acid ion.

Macrocyclic compounds containing hetero atom(s) are 9- or more membered macrocyclic compounds containing at least one heteroatom such as a nitrogen atom, oxygen atom, sulfur atom and selenium atom. The specific compound is crown ether which Pedersen synthesized 1967 and reported the specific characteristics. Since then, many compounds have been synthesized. These compounds are detailed in Journal of American Chemical Society vol. 86 (2495) pages 7017 to 7036 (1967) by C. J. Pedersen; "Macrocyclic Polyether Synthesis" Springer-Verlag. (1982) by G. W. Gokel and S. H. Korzeniowski; "Kuraun Eteru no Kagaku" (Chemistry of Crown Ether) Kagakudojin (1978) edited by Oda, Shouno and Tafuse; "Hosuto-Gesuto" (Host-Guest) Kyoritsu Shuppan (1979) by Tafuse, et al.; "Yuuki Gousei Kagaku" (Organic Synthesis Chemistry) vol. 45 (6), pages 571 to 582 (1987) by Sasaki and Koga. Examples of heterocyclic compounds containing a heteroatom include compounds described in JP-A 2000-347343, paragraph 0030 to 0037.

The supersensitizer is incorporated into the emulsion layer containing an organic silver salt and silver halide grains, preferably in an amount of 0.001 to 1.000 mol, and more preferably 0.01 to 0.50 mol per mol of silver.

In the present invention, at least one reducing agent of a bisphenol derivative compound is preferably used alone or together with another reducing agents having a different chemical structure as a reducing agent (a silver ion reducing agent). Performance degradation such as fogging increase during CP storage of the photothermographic material and the degradation of the silver image color tone over time are unexpectedly restrained by use of the above reducing agent in the photothermographic material of this invention.

A bisphenol derivative compound is preferably used in the invention, and specifically the reducing agent is represented by foregoing formula (A-1).

In said formula (A-1), X is a chalcogen atom or CHR. Chalcogen atoms include sulfur, celenium and tellurium, and said sulfur atom is the preferable chalcogen atom. In CHR, R is a hydrogen atom, a halogen atom or an alkyl group. A halogen atom is a fluorine atom, a chlorine atom or a bromine atom, and an alkyl group is preferably a substituted or unsubstituted alkyl group having 1 to 20 carbon atoms. Examples of an alkyl group include a methyl group, ethyl group, propyl group, butyl group, hexyl group, heptyl group, vinyl group, aryl group, butenyl group, hexadienyl group, ethenyl-2-propenyl group, 3 butenyl group, 1-methyl-3-propenyl group, 3-pentenyl group, and 1-methyl-3-butenyl group.

These groups may be substituted by a substituent group, and examples of such a substituent group include, for example, a halogen atom (e.g., fluorine atom, chlorine atom, bromine atom); a cycloalkyl group (e.g., cyclohexyl group, cycloheptyl group); a cycloalkenyl group (e.g., 1-cycloalkenyl group, 2-cycloalkenyl); an alkoxyl group (e.g., methoxy group, ethoxy group, propoxy group); an alkylcarbonyloxy group (e.g., acetyloxy group); an alkylthio group (e.g., methylthio group, trifluoromethylthio group); a carbokyl group; an alkylcarbonylamino group (e.g., acetylamino group); a ureido group (e.g., methylaminocarbonylamino group); an alkylsulfonylamino group (e.g., methanesulfonylamino group); an alkylsulfonyl group (e.g., methanesulfonyl group, trifuluoromethanesulfonyl); a carbamoyl group (e.g., carbamoyl group, N,N'-dimethylcarbamoyl group, N-morpholinocarbonyl group); a sulfamoyl group (e.g., sulfamoyl group, N,N'-dimethylsulfamoyl group, morpholinosulfamoyl group); a trifuluoromethyl group; a hydroxyl group; a nitro group; a cyano group; an alkylsulfonamide group (e.g., methanesulfonamide group, butanesulfonamide group); an alkylamino group (e.g., amino group, N,N'-dimethylamino group, N,N'-diethylamino group); a sulfo group; a phosphono group; a sulfite group; a sulfino group; an alkylsulfonylaminocarbonyl group (e.g., methanesulfonylaminocarbonyl group, ethanesulfonylaminocarbonyl group); an alkylcarbonylaminosulfonyl group (e.g., acetamidosulfonyl group, methoxyacetamidosulfonyl group); an alkynylaminocarbonyl group (e.g., acetamidocarbonyl group, methoxyacetamidocarbonyl group); and an alkylsulfinylaminocarbonyl group (e.g., methanesulfinylaminocarbonyl group, ethanesulfinylaminocarbonyl group). The plural substituent groups may be the same or different from each other.

$R_1$ are alkyl groups, and may be the same or different, but at least one is a secondary or tertiary alkyl group. Examples of an alkyl group include preferably a substituted or unsubstituted alkyl group having 1 to 20 carbon atoms such as a methyl group, ethyl group, propyl group, isopropyl group, butyl group, isobutyl group, t-butyl group, t-amyl group, t-octyl group, cyclohexyl group, cyclopentyl group, 1-methylcyclohexyl group, or 1-methylcyclopropyl group.

The substituent group of an alkyl group is not specifically limited, and the examples include an aryl group, a hydroxyl group, an alkoxyl group, an aryloxy group, an alkylthio group, an arylthio group, an acylamino group, a sulfonamide group, a sulfonyl group, a phosphonyl group, a phosphoril group, an acyl group, a carbamoyl group, an ester group, and a halogen atom. Further, the substituent group may combine with $(Q_0)n$ and $(Q_0)m$ to form a saturated ring. $R_1$ are each preferably a secondary or tertiary alkyl group, having 2 to 20 carbon atoms, however a tertiary alkyl group is more preferable. Still more preferably are t-butyl group, t-amyl group, and 1-methylcyclohexyl group, with optimally preferably one being 1-methylcyclohexyl group.

$R_2$ are hydrogen atoms or groups capable to be substituted for a benzene ring. Examples of these groups include, for example, a halogen atom such as fluorine atom, chlorine atom and bromine atom; an alkyl group, an aryl group, a cycloalkyl group, an alkenyl group, a cycloalkenyl group, an alkynyl group, an amino group, an acyl group, an acyloxy group, an acylamino group, a sulfonylamino group, a sulfamoyl group, a carbamoyl group, an alkylthio group, a sulfonyl group, an alkylsulfonyl group, a sulfinyl group, a cyano group, and a heterocyclic group. Plural $R_1$ and $R_2$ may be the same or different from each other.

$R_2$ have preferably 1 to 5 carbon atoms, and more preferably 1 to 2 carbon atoms. The groups may be substituted by substituent groups such as a halogen atom (e.g., fluorine atom, chlorine atom, bromine atom), an alkyl group (e.g., a methyl group, ethyl group, propyl group, butyl group, pentyl group, iso-pentyl group, 2-ethylhexyl group, octyl group, decyl group); a cycloalkyl group (e.g., cyclohexyl group, cycloheptyl group); an alkenyl group (e.g., ethenyl-2-propenyl group, 3-butenyl group, 1-methyl-3-propenyl group, 3-pentenyl group, 1-methyl-3-butenyl group); a cycloalkenyl group (e.g., 1-cycloalkenyl group, 2-cycloalkenyl group); an alkynyl group (e.g., ethynyl group, 1-propynyl group); an alkoxyl group (e.g., methoxy group, ethoxy group, propoxy group); an alkylcarbonyloxy group (e.g., acetyloxy group); an alkylthio group (e.g., methylthio group, trifluoromethylthio group); a carbokyl group; an alkylcarbonylamino group (e.g., acetylamino group); a ureido group (e.g., methylaminocarbonylamino group); an alkylsulfonylamino group (e.g., methanesulfonylamino group); an alkylsulfonyl group (e.g., methanesulfonyl group, trifuluoromethanesulfonyl); a carbamoyl group (e.g., carbamoyl group, N,N'-dimethylcarbamoyl group, N-morpholinocarbonyl group); a sulfamoyl group (e.g., sulfamoyl group, N,N'-dimethylsulfamoyl group, morpholinosulfamoyl group), a trifuluoromethyl group; a hydroxyl group; a nitro group; a cyano group; an alkylsulfonamide group (e.g., methanesulfonamide group, butanesulfonamide group); an alkylamino group (e.g., amino group, N,N'-dimethylamino group, N,N'-diethylamino group); a sulfo group; a phosphono group; a sulfite group; a sulfino group; an alkylsulfonylaminocarbonyl group (e.g., methanesulfonylaminocarbonyl group, ethanesulfonylaminocarbonyl group); an alkylcarbonylaminosulfonyl group (e.g., acetamidosulfonyl group, methoxyacetamidosulfonyl group); an alkynylaminocarbonyl group (e.g., acetamidocarbonyl group, methoxyacetamidocarbonyl group); and an alkylsulfinylaminocarbonyl group (e.g., methanesulfinylaminocarbonyl group, ethanesulfinylaminocarbonyl group).

$(Q_0)$ are the same or different from each other, and are groups capable of being substituted for a benzene ring. Examples of the groups include a substituted or unsubstituted alkyl group having 1 to 20 carbon atoms, a substituted or unsubstituted aryl group having 6 to 26 carbon atoms, a halogen atom, a substituted or unsubstituted alkoxyl group having 1 to 20 carbon atoms, and a substituted or unsubstituted acylamino group having 6 to 26 carbon atoms. Further, $Q_0$ may combine with $R_1$ and $R_2$ to form a saturated ring. $Q_0$ is preferably a hydrogen atom, a halogen atom or an alkyl group, and is more preferably a hydrogen atom.

In this invention, a reducing agent represented by foregoing formula (A-2) is used together with a reducing agent represented by foregoing formula (A-1), and is more preferably a reducing agent represented by formula (A-3).

In formula (A-2), Z is an atom group to form a 3- to 10-membered non-aromatic ring together with carbon atom (s). Exemplary examples of the rings include a 3-membered ring (e.g., cyclopropyl, aziridil, oxiranyl; a 4-membered ring (e.g., cyclobutyl, cyclobutenyl, oxisetanyl, azetidinyl); a 5-membered ring (e.g., cyclopentyl, cyclopentenyl, cyclopentadienyl, tetrahydrofuranyl, pirosinyl, tetrahydrothienyl); a 6-membered ring (e.g., cyclohexyl, cyclohexenyl, cyclohexadienyl, tetrahydropyranyl, pyranyl, pyperidinyl, dioxanyl, tetrahydrothiopyranyl, norcaranyl, norpinanyl, norbornyl); a 7-membered ring (e.g., cycloheptyl, cycloheptynyl, cycloheptadienyl); an 8-membered ring (e.g., cyclooctanyl, cyclooctenyl, cyclooctadienyl, cyclooctatrienyl); a 9-membered ring (e.g., cyclononaniel, cyclononenyel, cyclononadienyl, cyclononatrienyl); and a 10-membered ring (e.g., cyclodecanyl, cyclodecenyel, cyclodecadienyl, cyclodecatrienyl).

The ring is preferably a 3- to 6-membered ring, and is more preferably a 5- to 6-membered ring, and still more preferably a 6-membered ring. Of these, a hydrocarbon ring containing no hetero atom is preferred. The ring may form a spiro-union with other ring via a spiro-atom, and may condense with other ring containing an aromatic ring in any form. There may be any substituent group on the ring. Exemplary examples of a substituent group include, for example, a halogen atom (e.g., fluorine atom, chlorine atom, bromine atom); an alkyl group (e.g., a methyl group, ethyl group, propyl group, butyl group, pentyl group, iso-pentyl group, 2-ethyl-hexyl group, octyl group, decyl group); a cycloalkyl group (e.g., cyclohexyl group, cycloheptyl group); an alkenyl group (e.g., ethenyl-2-propenyl group, 3-butenyl group, 1-methyl-3-propenyl group, 3-propenyl group, 3-pentenyl group, 1-methyl-3-butenyl group); a cycloalkenyl group (e.g., 1-cycloalkenyl group, 2-cycloalkenyl group); an alkynyl group (e.g., ethynyl group, 1-propynyl group); an alkoxyl group (e.g., methoxy group, ethoxy group, propoxy group); an alkylcarbonyloxy group (e.g., acetyloxy group); an alkylthio group (e.g., methylthio group, trifluoromethylthio group); a carbokyl group; an alkylcarbonylamino group (e.g., acetylamino group); a ureido group (e.g., methylaminocarbonylamino group); an alkylsulfonylamino group (e.g., methanesulfonylamino group); an alkylsulfonyl group (e.g., methanesulfonyl group, trifluoromethanesulfonyl); a carbamoyl group (e.g., carbamoyl group, N,N'-dimethylcarbamoyl group, N-morpholinocarbonyl group); a sulfamoyl group (e.g., sulfamoyl group, N,N'-dimethylsulfamoyl group, morpholinosulfamoyl group), a trifluoromethyl group; a hydroxyl group; a nitro group; a cyano group; an alkylsulfonamide group (e.g., methanesulfonamide group, butanesulfonamide group); an alkylamino group (e.g., amino group, N,N'-dimethylamino group, N,N'-diethylamino group); a sulfo group; a phosphono group; a sulfite group; a sulfino group; an alkylsulfonylaminocarbonyl group (e.g., methanesulfonylaminocarbonyl group, ethanesulfonylaminocarbonyl group); an alkylcarbonylaminosulfonyl group (e.g., acetamidosulfonyl group, methoxyacetamidosulfonyl group); an alkynylaminocarbonyl group (e.g., acetamidocarbonyl group, methoxyacetamidocarbonyl group); and an alkylsulfinylaminocarbonyl group (e.g., methanesulfinylaminocarbonyl group, ethanesulfinylaminocarbonyl group). The plural subsituent groups may be the same or different. The specifically preferable substituent group is an alkyl group.

$R_3$ and $R_4$ may be each a hydrogen atom, an alkyl group, an aryl group or a heterocyclic group, and specifically an alkyl group having 1 to 10 carbon atoms is preferred. Examples of the alkyl group include a methyl group, ethyl group, propyl group, isopropyl group, butyl group, t-butyl group, pentyl group, iso-pentyl group, 2-ethyl-hexyl group, octyl group, decyl group, cyclohexyl group, cycloheptyl group, 1-methylcyclohexyl group, ethenyl-2-propenyl group, 3-butenyl group, 1-methyl-3-propenyl group, 3-pentenyl group, 1-methyl-3-butenyl group, 1-cycloalkenyl group, 2-cycloalkenyl group, ethynyl group, and 1-propynyl group. Preferable are a metyl group, t-butyl group and 1-methylcyclohexyl group, and more preferable is a methyl group. Examples of the aryl group include a phenyl group, a naphthyl group and an anthranyl group. Examples of the heterocyclic group include an aromatic heterocyclic group (e.g., pyridine group, quinoline group, isoquinoline group, imidazole group, pyrazole group, triazole group, oxazole group, thiazole group, oxadiazole group, thiadiazole group, tetrazole group); and a non-aromatic heterocyclic group (e.g., piperidino group, morpholino group, tetrahydrofuryl group, tetrahydrothienyl group, tetrahydropyranyl group). The group may be substituted by a substituent group, and examples of the subsistent group include the foregoing ones on the ring. The plural $R_3$s or $R_4$s may be the same or different, and optimally preferable are all methyl groups.

$R_x$ is a hydrogen atom or an alkyl group, and the preferable example of an alkyl group is one having 1 to 10 carbon atoms. Exemplary examples of the alkyl group include a methyl group, ethyl group, propyl group, isopropyl group, butyl group, t-butyl group, pentyl group, iso-pentyl group, 2-ethyl-hexyl group, octyl group, decyl group, cyclohexyl group, cycloheptyl group, 1-methylcyclohexyl group, ethenyl-2-propenyl group, 3-butenyl group, 1-methyl-3-propenyl group, 3-pentenyl group, 1-methyl-3-butenyl group, 1-cycloalkenyl group, 2-cycloalkenyl group, ethynyl group, and 1-propynyl group. Preferably are a metyl group, an ethyl group and isopropyl group. $R_x$ is preferably a hydrogen atom.

$Q_0$ are groups capable to substitute for a benzene ring. Examples of the groups include an alkyl group having 1 to 25 carbon atoms such as a methyl group, ethyl group, propyl group, isopropyl group, tert-butyl group, pentyl group, hexyl group, cyclohexyl group; an alkyl halide group (e.g., trifluoromethyl group, perfluorooctyl group); a cycloalkyl group (e.g., cyclohexyl group, cyclopentyl group); an alkynyl group (e.g., propargyl group); a glycidyl group; an acrylate group; a methacrylate group; an aryl group (e.g., phenyl group); a heterocyclic group (pyridyl group, thiazolyl group, oxazolyl group, imidazolyl group, furyl group, pyrrolyl group, pyrazinyl group, pyrimidinyl group, pyridazinyl group, selenazolyl group, sulfolanyl group, pyperidinyl group, pyrazolyl group, tetrazolyl group); a halogen atom (e.g., chlorine atom, bromine atom, iodine atom, fluorine atom); an alkoxyl group (e.g., methoxy group, ethoxy group, propyloxy group, pentyloxy group, cyclopentyloxy group, hexyloxy group, cyclohexyloxy group); an arloxy group (e.g., phenoxy group); an alkoxycarbonyl group (e.g., methyloxycarbonyl group, ethyloxycarbonyl group, butyloxycarbonyl group); an arloxicarbonyl group (e.g., phenyloxycarbonyl group); a sulfonamide group (e.g., methanesulfonamide, ethanesulfonamide, butanesulfonamide, hexanesulfonamide, cyclohexanesulfonamide, benzenesulfonamide); a sulfamoil group (aminosulfonyl group, methylaminosulfonyl group, dimethylaminosufonyl group, butylaminosulfonyl group, hexylaminosulfonyl group, cyclohexylaminosulfonyl group, phenylaminosulfonyl group, 2-pyridylaminosulfonyl group); a urethane group (methylureido group, ethylureido group, pentylureido group, cyclohexylureido group, phenylureido group, 2-pyridylureido group); an acyl group (e.g., acetyl group, propionyl group, butanoyl group, hexanoyl group, cyclohevanoyl group, benzoyl group, pyridinoyl group); a carbamoyl group (e.g., aminocarbonyl group, methylaminocarbonyl group, dinethylaminocarbonyl group, propylaminocarbonyl group, pentylaminocarbonyl group, cyclohexylaminocarbonyl group, phenylaminocarbonyl group, 2-pyridylaminocarbonyl group); an amide group (e.g., acetamido group, propionamido group, butanamido group, hexanamido group, benzamido group); a sulfonyl group (e.g., methylsulfonyl group, ethylsulfonyl group, butylsulfonyl group, cyclohexylsulfonyl group, phenylsulfonyl group, 2-pyridylsulfonyl group); an amino group (e.g., amino group, ethylamino group, dimethylamino group, butylamino group, cyclopentylamino group, anylino group, 2-pyridylamino group); a cyano group; a nitro group; a sulfo group; a carboxyl group; a hydroxyl group; and an oxamoyl group. Some of previous groups may further be subtituted by orhers of the same groups. n and m are numbers 0, 1 or 2 and optimally preferably is that both n and m are 0.

In formula (A-3), $Q_1$ is a halogen atom, an alkyl group, an aryl group or a heterocyclic group, while $Q_2$ is a hydrogen atom, a halogen atom, an alkyl group, an aryl group or a heterocyclic group. Examples of the halogen atom include a chlorine atom, bromine atom, florine atom and iodine atom, and preferably are a fluorine atom, a chlorine atom or a bromine atom. An alkyl group having 1 to 10 carbon atoms is preferred. Examples of the alkyl group include a methyl group, ethyl group, propyl group, isopropyl group, butyl group, t-butyl group, pentyl group, iso-pentyl group, 2-ethyl-hexyl group, octyl group, decyl group, cyclohexyl group, cycloheptyl group, 1-methylcyclohexyl group, ethenyl-2-propenyl group, 3-butenyl group, 1-methyl-3-propenyl group, 3-pentenyl group, 1-methyl-3-butenyl group, 1-cycloalkenyl group, 2-cycloalkenyl group, ethinyl group, and a 1-propynyl group. Preferable examples include a methyl group and an ethyl group. Examples of the aryl group include concretely a phenol group and a naphthyl group. Preferable heterocyclic groups include 5- or 6-membered hetero aromatic groups such as a pyridyl group, a furyl group, a thienyl group and an oxazolyl group. G is a nitrogen atom or a carbon atom, and is preferably a carbon atom, and ng is 0 or 1 and is preferably 1.

$Q_1$ is most preferably a methyl group. $Q_2$ is preferably a hydrogen atom or a methyl group, and is most preferably a hydrogen atom.

$Z_2$ is an atom group to form a 3- to 10-membered non-aromatic ring together with carbon atom(s) and G, and the 3- to 10-membered non-aromatic ring is the same as defined in formula (A-2).

$R_3$, $R_4$, $R_x$, $Q_0$, n and m are same as defined in formula (A-2).

Exemplary examples of the compounds represented by Formulas (A-1), (A-2) and (A-3) will be listed below, however, the present invention is not limited to only these.

(1-1)

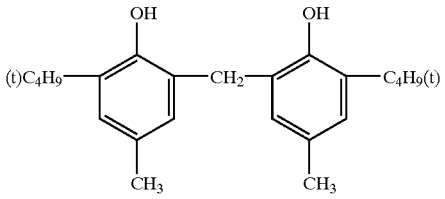

(1-2)

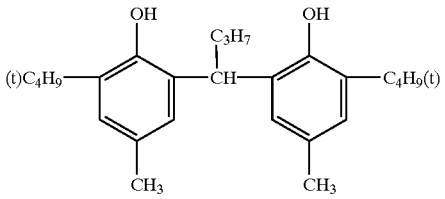

-continued (1-3)

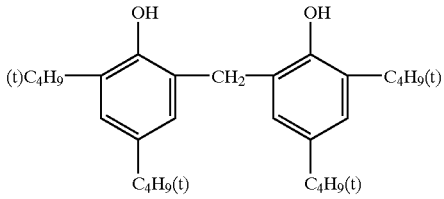

(1-4)

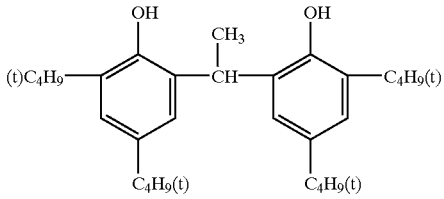

(1-5)

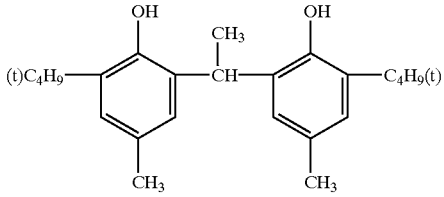

(1-6)

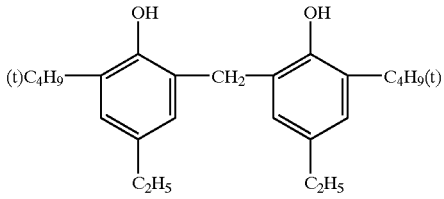

(1-7)

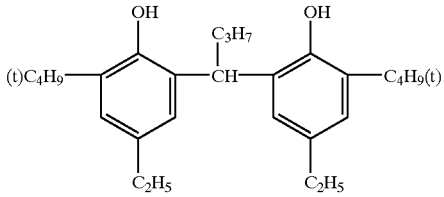

(1-8)

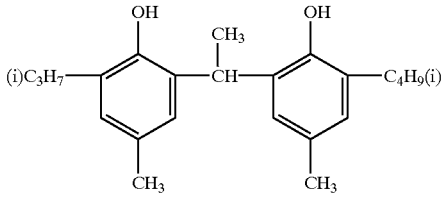

(1-9)

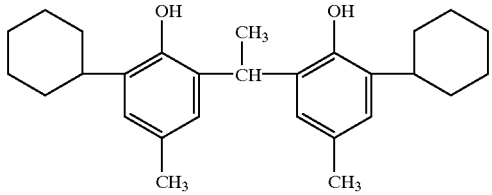

-continued
(1-10)
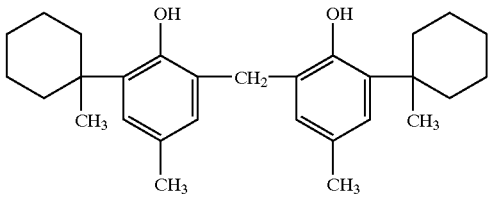
(1-11)
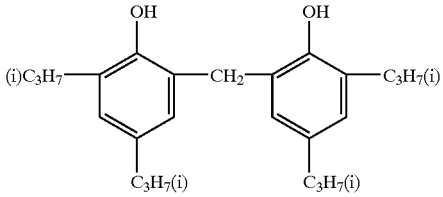
(1-12)
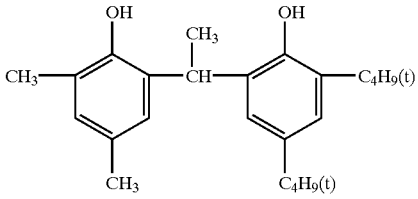
(1-13)
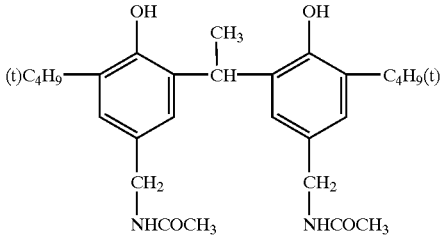
(1-14)
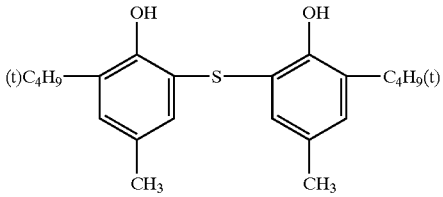
(1-15)
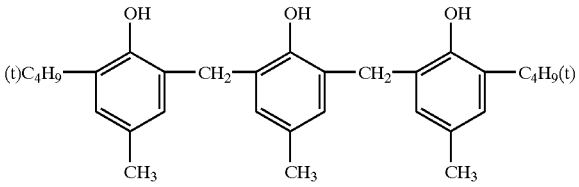
(1-16)
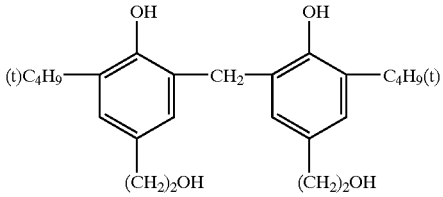
-continued
(1-17)
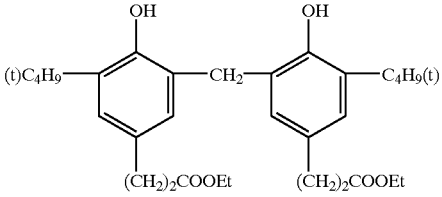
(1-18)
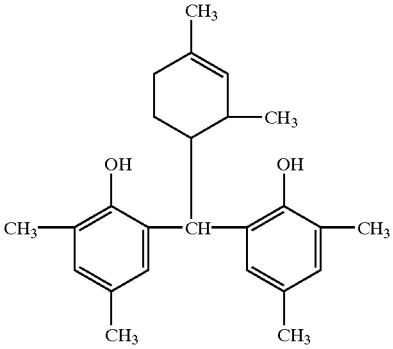
(1-19)
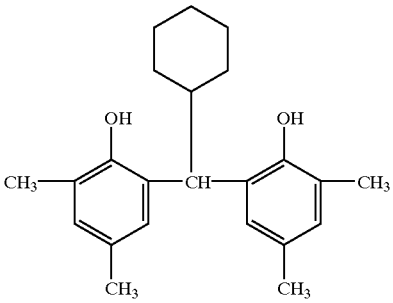
(1-20)
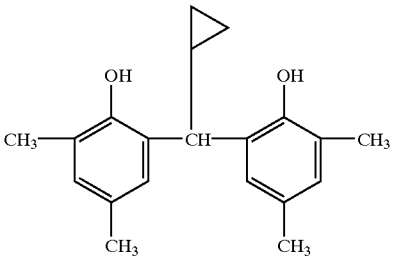
(1-21)
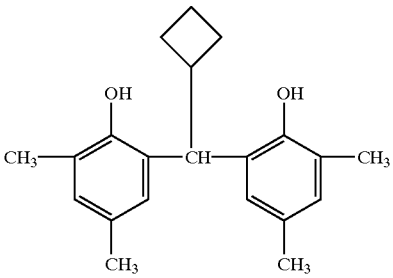

-continued
(1-22)
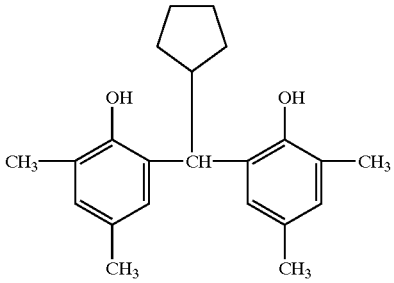
(1-23)
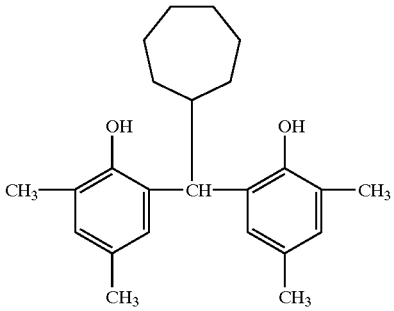
(1-24)
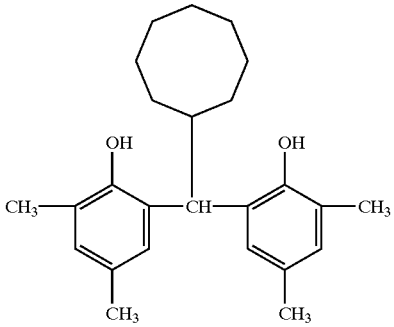
(1-25)
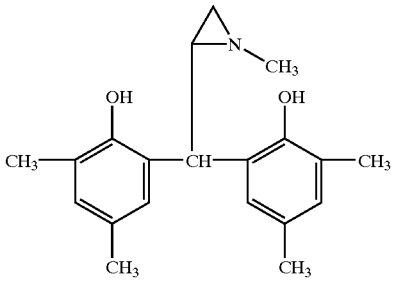
(1-26)
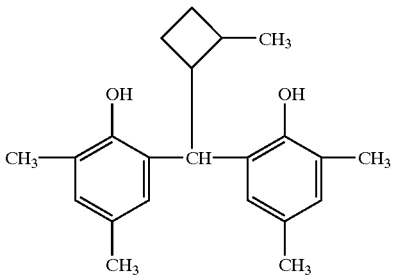
-continued
(1-27)
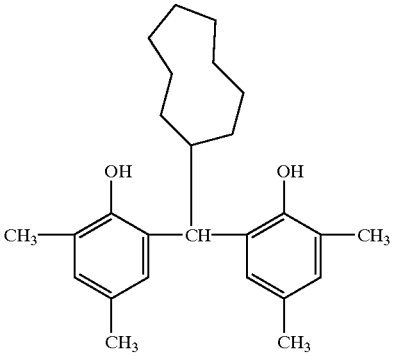
(1-28)
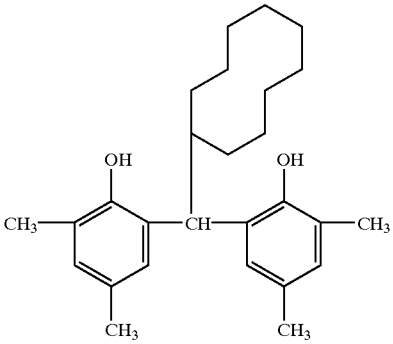
(1-29)
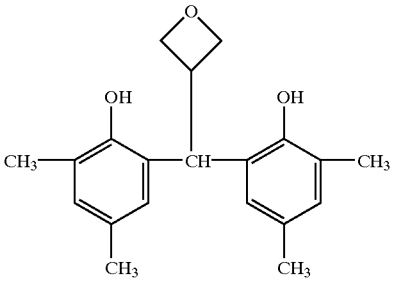
(1-30)
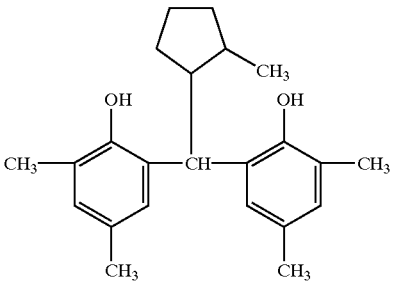
(1-31)
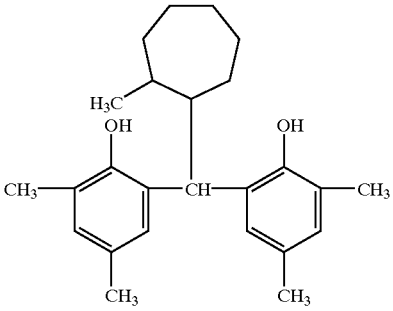

-continued
(1-32)
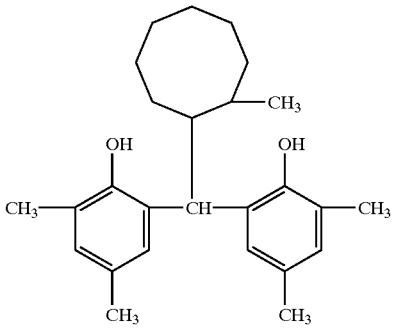
(1-33)
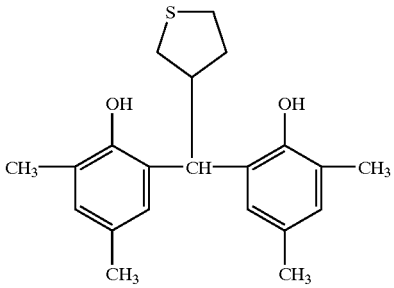
(1-34)
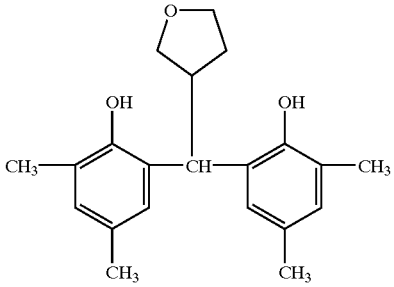
(1-35)
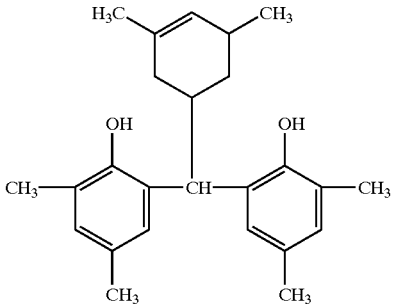
(1-36)
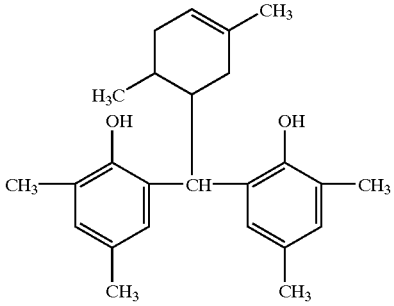
-continued
(1-37)
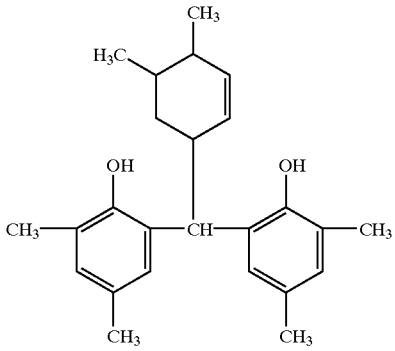
(1-38)
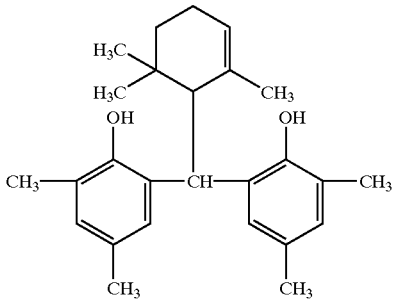
(1-39)
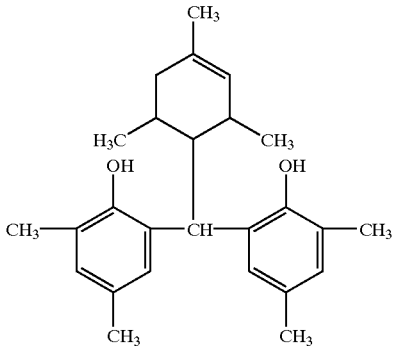
(1-40)
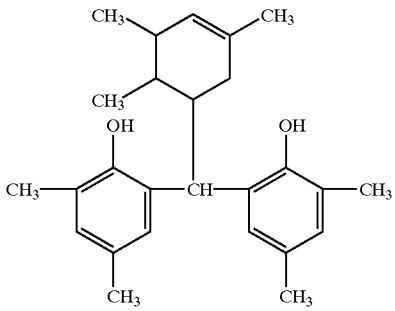

-continued
(1-41)
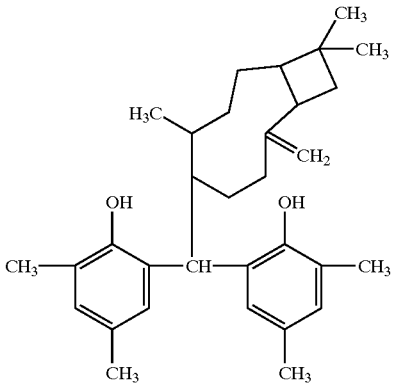
(1-42)
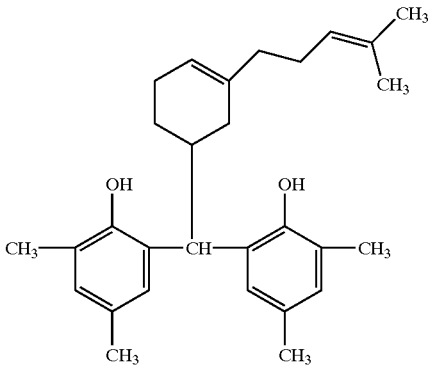
(1-43)
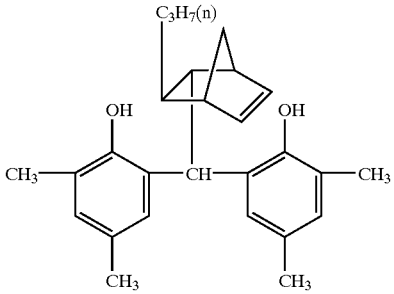
(1-44)
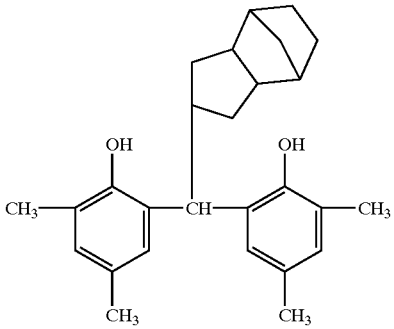
-continued
(1-45)
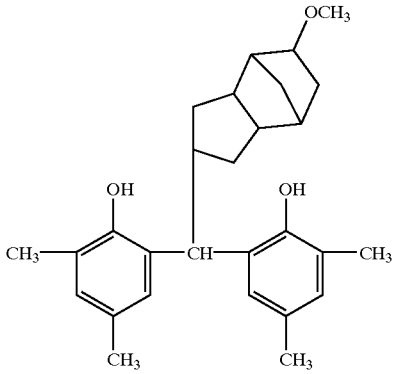
(1-46)
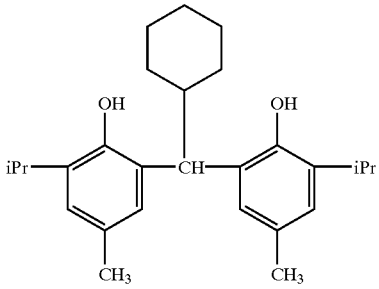
(1-47)
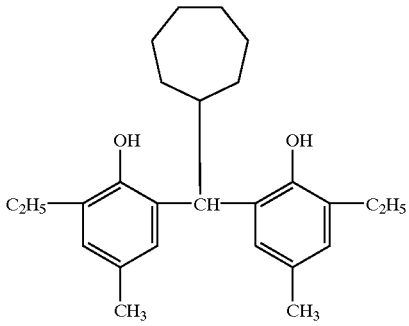
(1-48)
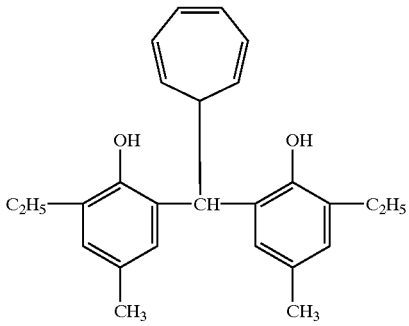
(1-49)
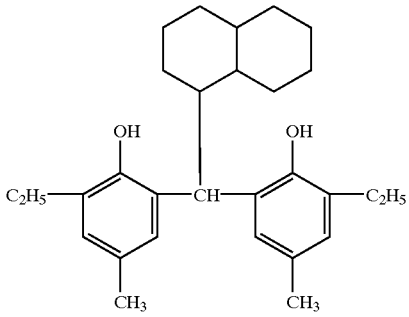

-continued
(1-50)
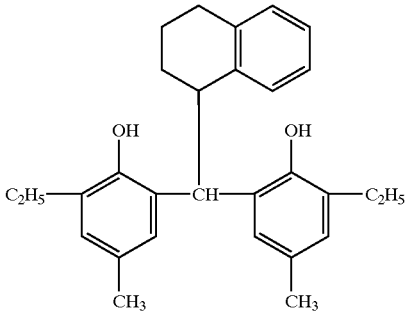
(1-51)
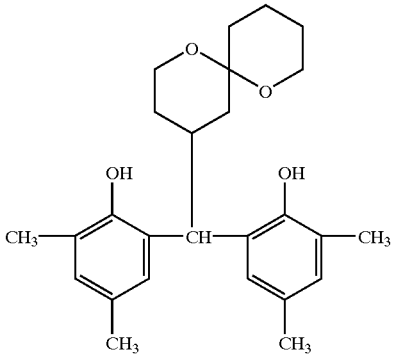
(1-52)
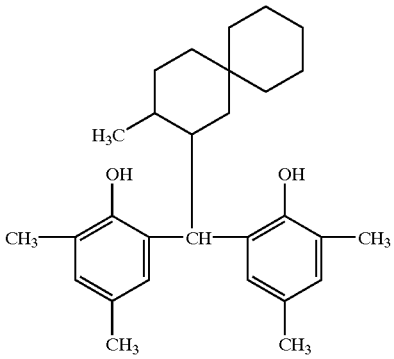
(1-53)
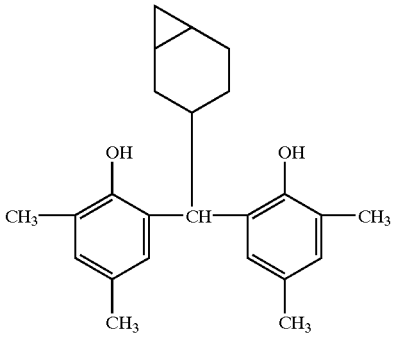
-continued
(1-54)
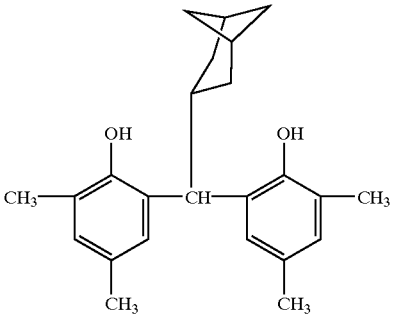
(1-55)
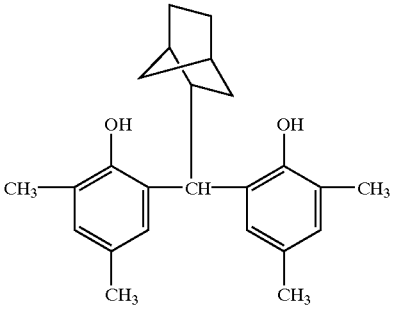
(1-56)
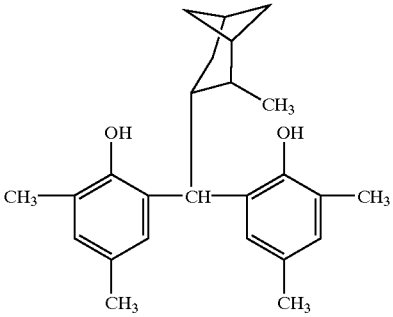
(1-57)
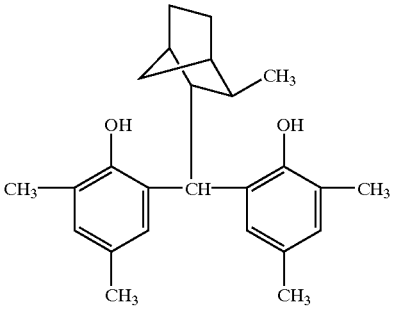
(1-58)
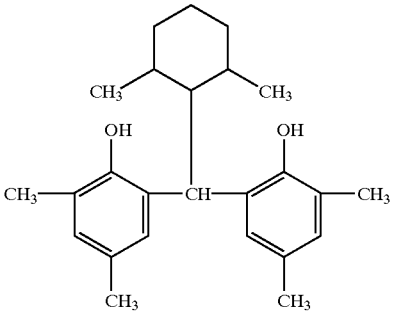

-continued
(1-59)
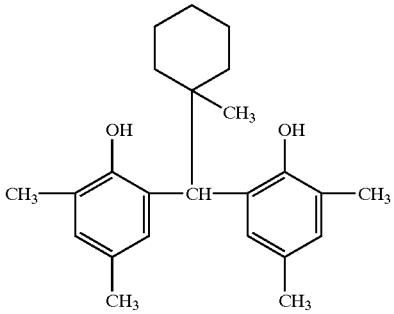
(1-60)
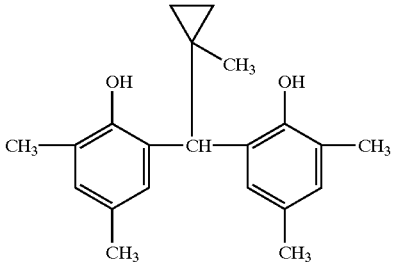
(1-61)
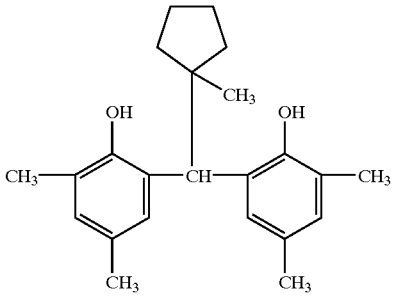
(1-62)
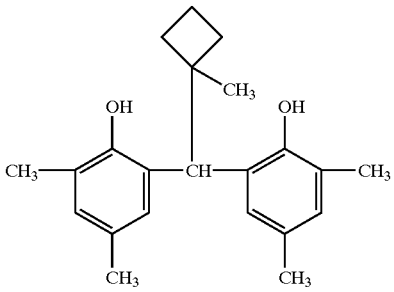
(1-63)
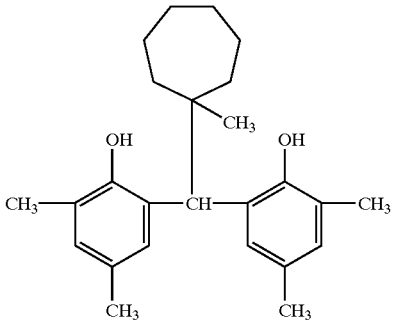
-continued
(1-64)
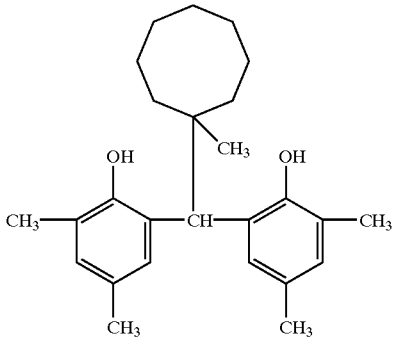
(1-65)
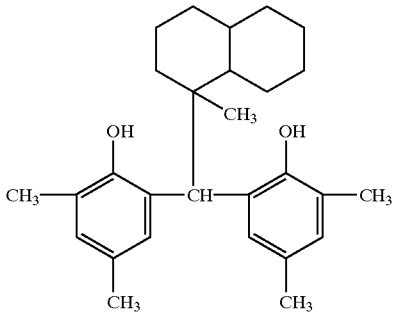
(1-66)
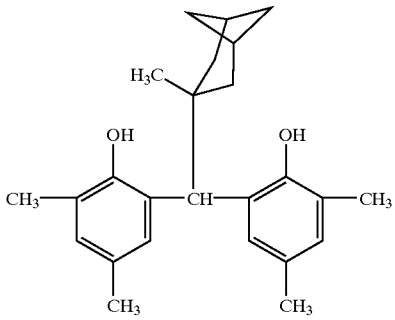
The compounds represented by formulas (A-1), (A-2) and (A-3) can be readily synthesized according to the methods commonly known in the art. The preferable synthesic scheme will be illustrated below taking compounds corresponding to formula (A-2) as an example.
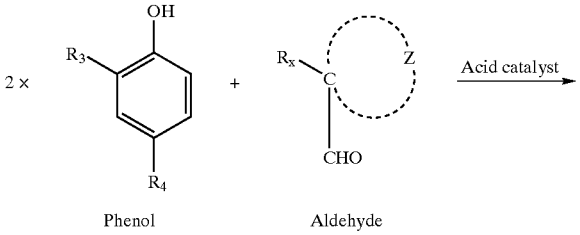

-continued

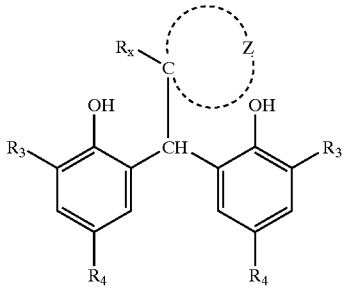

Preferably, 2-equivalent phenol and 1-equivalent aldehyde are dissolved or suspended without a solvent or into a suitable solvent, and then added are an acid of an optimal amount of catalyst, and preferably a reaction is performed at a temperature of −20° to 120° C. for 0.5 to 60 hrs. to obtain a high yield compound of formula (A-2). A compound represented by formula (A-1) or (A-3) is similarly synthesized.

As an organic solvent, a hydrocarbon organic solvent is preferable, and examples include benzene, toluene, xylene, dichloromethane and chloroform. The preferable solvent is toluene. Further, a reaction without a solvent is specifically preferable in view of yield. Any inorganic or organic acid can be used as an acid catalyst, and a concentrated hydrochloric acid p-toluenesulfonic acid and phosphoric acid are preferably used. It is preferable to use 0.001 to 1.500 equivalent to corresponding aldehyde as the amount of catalyst. The reaction temperature is preferably around room temperature (15 to 25° C.), and the reaction time is preferably 3 to 20 hrs.

In this invention, the following compounds can be used as a silver ion reducing agent such as: polyphenol compounds described in U.S. Pat. Nos. 3,589,903 and 4,021,249, British Patent No. 1,486,148, JP-A Nos. 51-51933, 50-36110, 50-116023 and 52-84727, JP-B 51-35727; bisnaphthols (e.g., 2,2'-dihydroxy-1,1'-binaphthyl, 6,6'-dibromo-2,2'-dihydroxy-1,1'-dinaphthyl) described in U. S. Pat. No. 3,672,904; and sulfonamide phenols and sulfonamide naphthols (e.g., 4-benzensulfonamide phenol, 2-benzensulfonamide phenol, 2,6-dichloro-4-benzensulfonamide phenol, and 4-benzenesulfonamide naphthol) described in U.S. Pat. No. 3,801,321.

The amount of a reducing agent to be used, such as the compounds represented by formula (A-1), (A-2) or (A-3) is preferably $1\times10^{-2}$ to 10 mol and more preferably $1\times10^{-2}$ to 1.5 mol per mol silver.

The amount of the reducing agent used in the photothermographic material of the invention is variable depending on the kind of an organic silver salt or reducing agent and is usually 0.05 to 10 mol, and preferably 0.1 to 3 mol per mol of organic silver salt. Two or more reducing agents may be used in combination, in an amount within the foregoing range. In the invention, addition of the reducing agent to a light-sensitive emulsion comprising a light-sensitive silver halide, organic silver salt grains and a solvent immediately before coating the emulsion is often preferred, thereby minimizing variation in photographic performance during standing.

Binders suitable for photothermographic materials are transparent or translucent and generally colorless, including natural polymers, synthetic polymers or copolymers and film forming mediums. Exemplary examples thereof include gelatin, gum Arabic, polyvinyl alcohol, hydroxyethyl cellulose, cellulose acetate, cellulose acetate butyrate, polyvinyl pyrrolidone, casein, starch, polyacrylic acid, poly (methyl methacrylate), poly(methylmethacrylic acid), polyvinyl chloride, polymethacrylic acid, copoly(styrene-anhydrous maleic acid), copoly(styrene-acrylonitrile), copoly(styrene-butadiene9, polyvinyl acetals (e.g., polyvinyl formal, polyvinyl butyral), polyesters, polyurethanes, phenoxy resin, polyvinylidene chloride, polyepoxides, polycarbonates, polyvinyl acetate, cellulose esters, and polyamides, these of which may be hydrophilic or hydrophobic.

Of these, polyvinyl acetals are preferred as a binder used for the light sensitive layer, and polyvinyl acetal is specifically preferred binder. Further, for a light insensitive layer such as an over-coating layer or a sublayer, specifically, a protective layer or a back coating layer are preferred cellulose esters exhibiting a relatively high softening temperature, such as triacetyl cellulose and cellulose acetate-butyrate. The foregoing binders may optionally be used in combination. In the binder, at least one polar group selected from —COOM, —$SO_3$M, —$OSO_3$M, —P═O$(OM)_2$, —O—P═O$(OM)_2$ (in which M is a hydrogen atom or an alkali metal salt), —$N(R)_2$, —$N^+(R)_3$ (in which $R_2$ is a hydrocarbon group), epoxy group, —SH, and —CN is preferably introduced in copolymerization or addition reaction. Such a polar group is preferably contained in an amount of $10^{-8}$ to $10^{-1}$ mol/g, and more preferably $10^{-6}$ to $10^{-2}$ mol/g.

The binder is used in an amount within the range effective to function as a binder. The effective range can be readily determined by one skilled in the art. As a measure to hold an organic silver salt in the light sensitive layer, the ratio by weight of a binder to an organic silver salt is preferably 15:1 to 1:2, and more preferably 8:1 to 1:1. Thus, the amount of a binder in the light sensitive layer is preferably 1.5 to 6 g/$m^2$, and more preferably 1.7 to 5 g/$m^2$. The amount of less than 1.5 g/$m^2$ results in an increase in unexposed areas, leading to levels unacceptable in practical use.

In one preferred embodiment of the invention, the binder contained in the light-sensitive layer exhibits a glass transition point Tg of 70 to 105° C. The glass transition point can be determined by the foregoing differential scanning calorimeter and the glass transition point is defined as the crossing-point of the base line and the slope of the endothermic peak.

Preferably, the photothermographic material which has been thermally developed at a temperature of 100° C. or higher exhibits a thermal transition point of 46 to 200° C. The thermal transition point is a value indicating an endothermic peak obtained when measuring the light-sensitive layer separated from the thermally developed photographic material, using a differential scanning calorimeter (or DSC, for example, EXSTAR 6000, available from SEIKO DENSHI KOGYO Co., Ltd.; DSC 220C, SEIKO DENSHI KOGYO. Co., Ltd; and DSC-7, available from Perkin Elmer Co.). In general, polymeric compounds have a glass transition point (Tg). It was found by the inventors of the present invention that a large endothermic peak emerged at a temperature lower than the Tg value of binder resin used in the light-sensitive layer. As a result of further study of this thermal transition point temperature, it was newly found that setting the thermal transition point to a temperature of 46 to 200° C. not only provided the increase of the formed film but also the improvement of the photographic characteristics such as sensitivity, maximum density and storage stability of image.

The glass transition point (Tg) can be determined in accordance with the method described in "Polymer Handbook" by Brandlap et al. at page III-139 to III-179 (1966, published by Wiley and Sons).

In cases where the binder is a copolymer resin, Tg is defined by the following equation:

$$Tg(\text{copolymer})(^\circ\ C.)=v_1Tg_1+v_2Tg_2+\ldots+v_nTg_n$$

where $v_1$, $v_2$, . . . $v_n$ each represent a weight fraction of respective monomers of the copolymer; $Tg_1$, $Tg_2$, . . . $Tg_n$ each represent a glass transition point, Tg (° C.) of a homopolymer obtained by each of monomers constituting the copolymer.

The precision of the Tg calculated by the foregoing equation is within ±5° C.

It is preferred to use the binder having Tg of 70 to 105° C., resulting in obtaining the sufficient maximum density at the image formation.

The binder used in the invention preferably exhibits Tg of 70 to 105° C. and the number average molecular weight of 1,000 to 1,000,000, more preferably 10,000 to 500,000 and degree of polimerization of ca. 50 to 1,000.

Examples of polymer containing an ethylenically unsaturated monomer as a constituting unit and its copolymer include acrylic acid alkyl esters, acrylic acid aryl esters, methacrylic acid alkyl esters, methacrylic acid aryl esters, cyanoacrylic acid alkyl esters, and cyanoacrylic acid aryl esters, in which the alkyl or aryl group may be substituted. Examples of substituent groups include methyl, ethyl, n-propyl, isopropyl, n-butyl, isobutyl, sec-butyl, tert-butyl, amyl, hexyl, cyclohexyl, benzyl, chlorobenzyl, octyl, stearyl, sulfopropyl, N-ethyl-phenylethyl,, 2-(3-phenylpropyloxy)ethyl, dimethylaminophenoxyethyl, furfuryl, tetrahydrofurfuryl, phenyl, cresyl, naphthyl, 2-hydroxyethyl, 4-hydroxybutyl, triethylene glycol, dipropylene glycol, 2-methoxyethyl, 3-methoxybutyl, 2-aetoxyethyl, 2-acetoxyacetoxyethyl, 2-ethoxyethyl, 2-isopropoxy, 2-butoxyethyl, 2-(2-methoxy)ethyl, 2-(2-ethoxyethoxy)ethyl, 2-(2-butoxyethoxy)ethyl, 2-diphenylphosphorylethyl, ω-methoxyethylene glycol (addition mole number n=6) allyl, and a dimethylaminoethyl chloride salt.

In addition, the following monomers are also usable, including vinyl esters such as vinyl acetate, vinyl propionate, vinyl butyrate, vinyl isobutyrate, vinyl caproate, vinyl chloroacetate, vinyl methoxyacetate, vinyl phenylacetate, vinyl benzoate, and vinyl salicylate; N-substituted acrylamides, N-substituted methacrylamides, acrylamides and methacrylamides, in which N-substituting groups include, for example, methyl, ethyl, propyl, butyl, tert-butyl, cyclohexyl, benzyl, hydroxymethyl, methoxyethyl, dimethylaminoethyl, phenyl, dimethyl, diethyl, β-cyanoethyl, N-(2-acetoacetoxyethyl) and diacetone; olefins such as dicyclopentadiene, ethylene, propylene, 1-butene, 1-pentene, vinyl chloride, vinylidene chloride, isoprene, chloprene, butadiene, and 2,3-dimethylbutadiene; styrenes such as methylstyrene, dimethylstyrene, trimethylstyrene, ethylstyrene, isopropylstyrene, tert-butylstyrene, chloromethylstyrene, methoxystyrene, acetoxystyrene, chlorostyrene, dichlorostyrene, bromostyrene, and methyl vinylbenzoate; vinyl ethers such as methyl vinyl ether, butyl vinyl ether, hexyl vinyl ether, methoxyethyl vinyl ether, and dimethylaminoethyl vinyl ether; N-substituted maleimides, in which N-substituting groups include, for example, methyl, ethyl, propyl, butyl, tert-butyl, cyclohexyl, benzyl, n-dodecyl, phenyl, 2-methylphenyl, 2,6-diethylphenyland 2-chlorophenyl; and others such as butyl crotonate, hexyl crotonate, dimethylitaconate, dibutyl itaconate, diethyl maleate, dimetyl maleate, dibutyl maleate, diethyl fumarate, dimethyl fumarate, dibutyl fumarate, methyl vinyl ketone, phenyl vinyl ketone, methoxy ethyl ketone, glycidyl acrylate, glycidyl methacrylate, N-vinyl oxazolidone, N-vinyl pyrrolidone, acrylonitrile, methacrylonitrile, methylene malonitrile, and vinylidene chloride.

Of these polymer compounds are preferred methacrylic acid alkyl esters, methacrylic acid aryl esters and styrenes. Specifically, polymer compounds containing an acetal group are preferred. Of these, polyvinyl acetal, which substantially has an acetoacetal structure is preferred, including, for example, polyvinyl acetal described in U.S. Pat. Nos. 2,358,836, 3,003,879 and 2,828,204; and British Patent No. 771,155.

The polymer compound containing an acetal group is preferably represented by the following formula (V):

Formula (V)

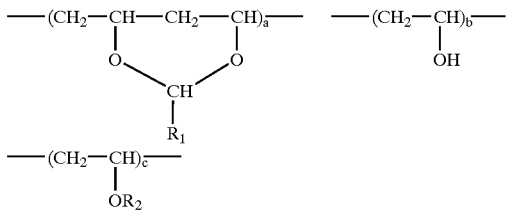

wherein $R_1$ is an unsubstituted alkyl group, a substituted alkyl group, an unsubstituted aryl group, or a substituted aryl group, preferably the groups other than the aryl group; $R_2$ is an unsubstituted alkyl group, a substituted alkyl group, an unsubstituted aryl group, a substituted aryl group, —$COR_3$ or —$COR_3$, in which $R_3$ is the same as defined in $R_1$.

The unsubstituted alkyl group represented by $R_1$, $R_2$ and $R_3$ is preferably one having 1 to 20 carbon atoms, and more preferably 1 to 6 carbon atoms, which may be straight chain or branched, and preferably straight chain. Examples of such an unsubstituted alkyl group include methyl, ethyl, n-propyl, isopropyl, n-butyl, isobutyl, t-butyl, n-amyl, t-amyl, n-hexyl, cyclohexyl, n-heptyl, n-octyl, t-octyl, 2-ethylhexyl, n-nonyl, n-decyl, n-dodecyl, and n-octadecyl. Specifically, methyl or propyl group is preferred.

The unsubstituted aryl group is preferably one having 6 to 20 carbon atoms, such as phenyl or naphthyl. Examples of a group capable of being substituted on the above alkyl or aryl group include an alkyl group (e.g., methyl, n-propyl, t-amyl, t-octyl, n-nonyl, dodecyl, etc.), aryl group (e.g., phenyl), nitro group, hydroxyl group, cyano group, sulfo group, alkoxy group (e.g., methoxy), aryloxy group (e.g., phenoxy), acyloxy group (e.g., acetoxy), acylamino group (e.g., acetylamino), sulfonamido group (e.g., methanesulfonamido), sulfamoyl group (e.g., methylsufamoyl), halogen atom (e.g., fluorine, chlorine, bromine atoms), carboxyl group, carbamoyl group (e.g., methylcarbamoyl), alkoxycarbonyl group (e.g., methoxycarbonyl), and sulfonyl group (e.g., methylsufonyl). In cases where two or more substituent groups are contained, the substituent groups may be the same or different. The total number of carbon atoms of the substituted alkyl group is preferably 1 to 20, and that of the substituted aryl group is preferably 6 to 20.

$R_2$ is preferably —$COR_3$ (in which $R_3$ is an alkyl or aryl group) or —$CONHR_3$ (in which $R_3$ is an aryl group); a, b and c each are the weight of respective repeating units, expressed in terms of mol %, and a is 40 to 86 mol %, b is 0 to 30 mol % and c is 0 to 60 mol %, provided that a+b+c=100 mol %, a is preferably 50 to 86 mol %, b is preferably 5 to 25 mol % and c is preferably 0 to 40 mol %. The respective repeating units having composition ratio, a, b and c may be the same or different.

Polymer compounds represented by the foregoing formula (V) can be synthesized in accordance with commonly known methods, as described, for example, in "Vinyl Acetate Resin" edited by Ichiro Sakurada (KOBUNSHIKAGAKU KANKOKAI, 1962).

Polyurethane resins having commonly known structures are usable in the invention, such as polyester-polyurethane, polyether-polyurethane, polyether-polyester-polyurethanepolycarbonate-polyurethane, polyester-polycarbonate-polyurethane, and polycaprolactone-polyurethane. It is preferred to contain at least one OH group on the end of a polyurethane molecule, i.e., at least two Oh groups in total. The OH group is capable of reacting with a polyisocyanate as a hardening agent to form a three-dimensional network structure so that the more is contained in the molecule, the more preferred. Specifically, the OH group on the molecular end, which exhibits relatively high reactivity is preferred. Polyurethane having at least three OH groups (and preferably at least four OH groups) on the molecular end is preferred. Specifically, polyurethane exhibiting a glass transition point of 70 to 105° C., a rupture elongation of 100 to 2000% and a rupture stress of 0.5 to 100 $N/mm^2$ is preferred.

These polymer compounds may be used singly or in a blended form of at least two thereof. The layer containing light-sensitive silver salt (preferably, light-sensitive layer) preferably contains the foregoing polymer compounds as a main binder. The main binder refers to the state in which at least 50% by weight of the total binder of the light-sensitive silver salt-containing layer is accounted for by the foregoing polymer. Accordingly, other polymer(s) may be blended within the range of less than 50% by weight of the total binder. Such polymer(s) are not specifically limited so long as a solvent capable of dissolving the foregoing polymer is used. Examples of such polymer(s) include polyvinyl acetate, polyacryl resin and polyurethane resin.

The light-sensitive layer preferably contains an organic gelling agent. The organic gelling agent refers to a compound having a function of providing a yield value to a system and removing or lowering fluidity of the system when added to organic liquid, which compounds are polyhydric alcohols.

In the invention, it is a preferable embodiment that a coating solution to form a light-sensitive layer contains aqueous-dispersed polymer latex. In this case, at least 50% by weight of a total binder content of the light sensitive layer-coating solution is preferably accounted for by the aqueous-dispersed polymer latex.

In cases where the light sensitive layer contains polymer latex, the polymer latex preferably accounts for at least 50% by weigh, and more preferably at least 70% by weight of a total binder content of the light sensitive layer.

Herein, the polymer latex is a water-insoluble, hydrophobic polymer which is dispersed in an aqueous dispersing medium in the form of fine particles. The dispersion form thereof may be any one of a form in which a polymer is emulsified in a dispersing medium, a form of being emulsion-polymerized, being dispersed in the form of a micell and a form in which a polymer has a hydrophilic partial structure and its molecular chain is in the form of a molecular dispersion.

The mean particle size of dispersing particles is 1 to 50,000 nm, and preferably 5 to 1,000 nm. The particle size distribution thereof is not specifically limited and may be of broad size distribution or monodisperse.

The polymeric latexes used in the invention may be those having a uniform structure as well as core/shell type latexes. In this case, it is sometimes preferred that the glass transition temperature is different between the core and shell. The minimum film-forming (or tarnishing) temperature (MFT) of the polymeric latexes is preferably −30 to 90° C., and more preferably 0 to 70° C. A tarnishing aid is also called a plasticizer, which is an organic compound (conventionally, an organic solvent) capable of lowering the MFT of a polymeric latex and described in "Chemistry of Synthetic Latex" (S. Muroi, published by KOBUNSHI-KANKOKAI, 1970).

Polymers used for polymeric latexes include acryl resin, vinyl acetate resin, polyester resin, polyurethane resin, rubber type resin, vinyl chloride resin, vinylidene chloride resin, polyolefin resin and their copolymers. Polymers may be a straight-chained polymer or branched polymer, or a cross-linked polymer, including homopolymers and copolymers. The copolymer may be a random copolymer or a block copolymer. The number-averaged molecular weight of the copolymer is preferably 5,000 to 1,000,000, and more preferably 10,000 to 100,000. In cases where the molecular weight is excessively small, mechanical strength of an light sensitive layer such as a light-sensitive layer is insufficient, excessively large molecular weight results in deterioration in film forming property.

The polymer latex used in the invention preferably exhibits an equlibrium moisture content at 25° C. and 60% RH (relative humidity) of 0.01 to 2%, and more preferably 0.01 to 1% by weight. The definition and measurement of the equlibrium moisture content are described, for example, in "KOBUNSHIKOGAKU-KOZA 14: KOBUNSHIZAIRYO SHIKENHO" (Polymer Engineering Series 14: Polymer Material Test Method), edited by Kobunshi Gakkai, published by Chijin Shoin.

Exemplary examples of polymer latexes used as binder include a latex of methylmethacrylate/ethylmethacrylate/methacrylic acid copolymer, a latex of methylmethacrylate/2-ethylhexylacrylate/styrene/acrylic acid copolymer, a latex of styrene/butadiene/acrylic acid copolymer, a latex of styrene/butadiene/divinylbenzene/methacrylic acid copolymer, a latex of methylmethacrylate/vinyl chloride/acrylic acid copolymer, and a latex of vinylidene chloride/ethylacrylate/acrylonitrile/methacrylic acid copolymer.

These polymers may be used alone or may be blended. The polymer latex preferably contains, as polymer species, 0.1 to 10% by weight of a carboxylic acid component, such as an acrylate or methacrylate component.

Further, a hydrophilic polymer such as gelatin, polyvinyl alcohol, methyl cellulose, hydroxypropyl cellulose, carboxymethyl cellulose and hydroxypropylmethyl cellulose may be added within the range of not more than 50% by weight of the total binder. The hydrophilic binder is added preferably in an amount of not more than 30% by weight, based on the total binder of the light sensitive layer.

In preparation of a coating solution to form the light-sensitive layer, an organic silver salt and an aqueous-dispersed polymer latex may be added in any order, i.e., either one may be added in advance or both ones may be simultaneously added, but the polymer latex is preferably added later.

It is further preferred that the organic silver salt is mixed with a reducing agent prior to addition of the polymer latex. After mixing the organic silver salt and polymer latex, the coating solution is preferably maintained at a temperature of 30 to 65° C., more preferably 35 to 60° C., and still more preferably 35 to 55° C. since there are problems such that an excessively low temperature often vitiates the coat surface and an excessively high temperature results in increased fogging. To maintain such a temperature, a vessel to prepare the coating solution may be maintained a prescribed temperature.

In coating a coating solution of the light sensitive layer, after mixing the organic silver salt and aqueous-dispersed polymer latex, a coating solution aged for 30 min to 24 hrs. is preferably used and a coating solution aged for 1 to 12 hrs. is more preferred, 2 to 10 hrs. is still more preferred.

Herein, the expression "after mixing" refers to after the organic silver salt and the aqueous-dispersed polymer latex are added and additives are homogeneously dispersed.

Although it is commonly known that the use of a cross-linking agent in such a binder as described above improves layer adhesion and lessens unevenness in development, the use of the crosslinking agent is also effective in fog inhibition during storage and prevention of print-out after development.

The composition of the foregoing polymers are shown in Table 1, in which Tg was determined using a differential scanning calorimeter (DSC, produced by SEIKO DENSHI KOGYO Co., Ltd.). Further, P-9 is polyvinyl butyral resin B-79 manufactured by SORCIA Co.

TABLE 1

Formula [V]

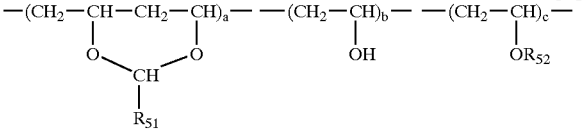

| Polymer | $R_{51}$ $CH_3$ mol % | $R_{51}$ $C_3H_7$ mol % | a Total Acetal (mol%) | c ($R_{52}$) $CH_3CO$ mol % | b Hydroxyl Group (mol %) | Tg (° C.) |
|---|---|---|---|---|---|---|
| P-1 | 60 | 40 | 73.7 | 1.7 | 24.6 | 83 |
| P-2 | 30 | 70 | 75.0 | 1.6 | 23.4 | 75 |
| P-3 | 100 | 0 | 73.6 | 1.9 | 24.5 | 104 |
| P-4 | 70 | 30 | 71.1 | 1.6 | 27.3 | 88 |
| P-5 | 90 | 10 | 71.8 | 1.5 | 26.7 | 99 |
| P-6 | 80 | 20 | 71.4 | 1.6 | 27.0 | 90 |
| P-7 | 30 | 70 | 70.4 | 1.6 | 28.0 | 76 |
| P-8 | 30 | 70 | 77.4 | 1.6 | 21.0 | 74 |
| P-9 | — | — | — | — | — | 60 |

It is commonly known that the use of a cross-linking agent in such a binder as described above improves layer adhesion and lessens unevenness in development.

Cross-linking agents usable in the invention include various commonly known cross-linking agents used for photographic materials, such as an aldehyde type, epoxy type, ethyleneimine type, isocyanate type, vinylsulfon type, sulfonester type, acryloyl type, carbodiimide type and silane compound type cross-linking agents, as described in JP-A 50-96216. In the present invention, at least one of the cross-linking agents is preferably to be a polyfunctional carbodiimide.

Said carbodiimide type crosslinking agent is a compound containing at least two carbodiimide groups and their adducts. Examples thereof include aliphatic dicarbodiimides, aliphatic dicarbodiimides having a cyclic group, benzenedicarbodiimides, naphthalenedicarbodiimides, biphenyldicarbodiimides, diphenylmethanediisocyanates, triphenylmethanedicarbodiimides, tricarbodiimides, tetracarbodiimides, their carbodiimides' adducts and adducts of these carbodiimides and bivalent or trivalent polyhydric alcohols. These carbodiimides are synthesized by reacting corresponding isocyanates with a primary amine under a presence of a phosphor catalyst such as a phospholene compound.

The polyfunctional carbodiimide compound is a compound containing more than 2 carbodiimide groups or carbodithioimide groups in the molecular structure. Preferably is a polyfunctional aromatic carbodiimide compound containing carbodiimide groups and an aromatic group in the molecule.

Generally, a carbodiimide compound is slower in reaction compared to an isocyanate compound, and higher temperature and longer time are needed to obtain sufficient hardness. However, applying high temperature for a long time to the photothermographic material causes performance problems such as increase of unacceptable fog density. A commonly known carbodiimide resin which is polymerized and contains many carbodiimide bonds in the main chain similarly needs high temperature to obtain sufficient hardness, and exhibits problems such as hardening itself resulting in poor performance due to poor compatibility with a binder. The inventors of the invention have found that no increase of fog density and restraint of minute density change in image storage results by use of the polyfunctional carbodiimide compound controlling thermo transition temperature, specifically by use of the polyfunctional carbodiimide compound represented by foregoing Formula (C-1).

Any of the polyfunctional carbodiimide compounds containing more than 2 carbodiimide groups may be used, and specifically preferable is a compound represented by foregoing Formula (CI).

In the formula, $R_1$ and $R_2$ are an alkyl group or an aryl group, and examples include an alkyl group (e.g., methyl, ethyl, propyl, butyl, pentyl), an aryl group (e.g., a residue of benzene, naphthalene, toluene, xylene), a heterocyclic group (e.g., a residue of furan, thiophene, dioxane, pyridine, piperazine, morpholine), and a group combining these groups by linking groups.

Examples of a linking group designated by $J_1$ or $J_4$ include simply a linking bond or a linking group formed by an oxygen atom, a nitrogen atom, a sulfur atom, and a phosphorus atom, which may contain a carbon atom, such as O, S, NH, CO, COO, SO, $SO_2$, NHCO, NHCONH, PO, and PS. Examples of an alkylene group or an arylene group designated by $J_2$ or $J_3$ include an alkylene group (e.g., methylene, ethylene, trimethylene, tetramethylene, and hexamethylene), and an arylene group (e.g., phenylene, tolylene, and naphthalene).

L is (v+1)-valent group, and examples include an alkyl group (e.g., methyl, ethyl, propyl, butyl, pentyl), an alkenyl group (e.g., ethenyl, propenyl, butadiene, pentadiene), an aryl group (e.g., a residue of benzene, naphthalene, toluene, xylene), and a heterocyclic group (e.g., a residue of furan, thiophene, dioxane, pyridine, piperazine, morpholine), and a group combined these groups by linking groups. Examples of a linking group include a simple linking bond or a linking group formed by an oxygen atom, a nitrogen atom, a sulfur atom, and a phosphorus atom, which may contain a carbon atom, such as O, S, NH, CO, SO, $SO_2$, NHCO, NHCONH, PO, and PS. v is an integer of more than 1, and is preferably 1 to 6, and more preferably 1, 2 or 3.

Examples of the cross-linking agents of the invention represented by Formula (CI) are listed below.

CI-1
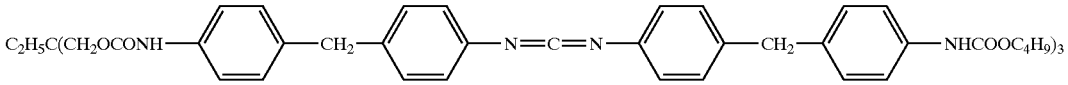
CI-2
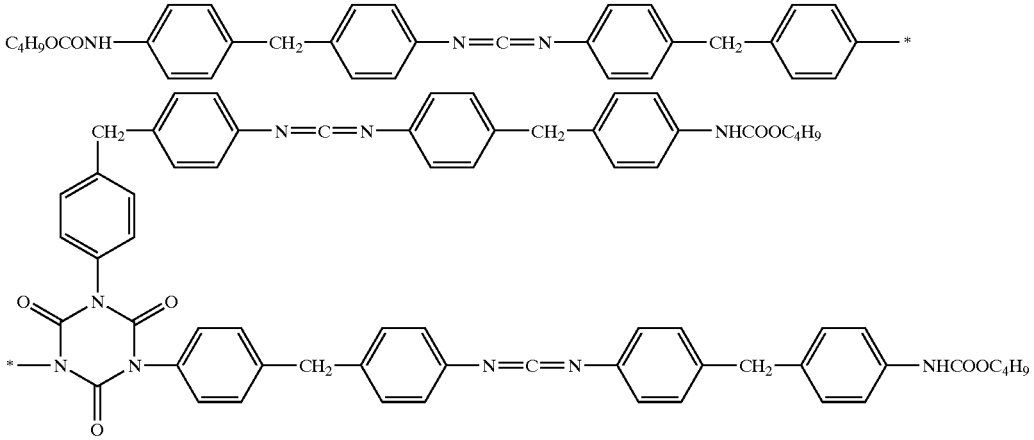
CI-3
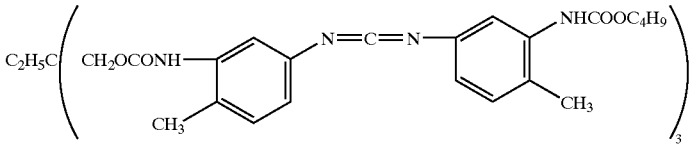
CI-4
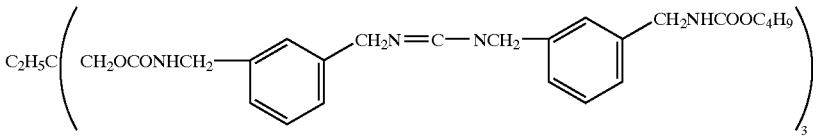
CI-5
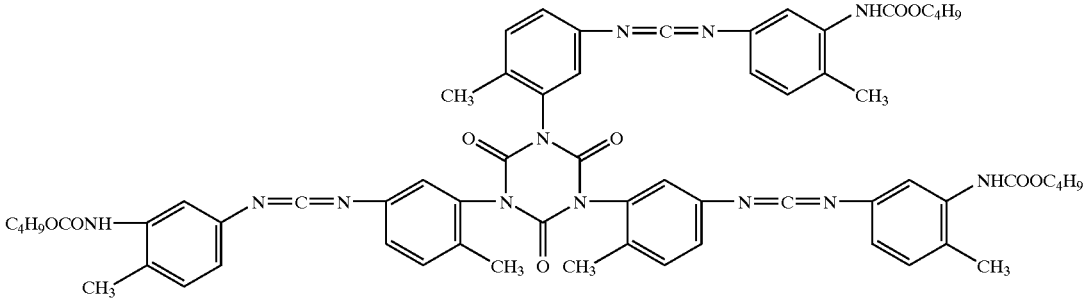
CI-6
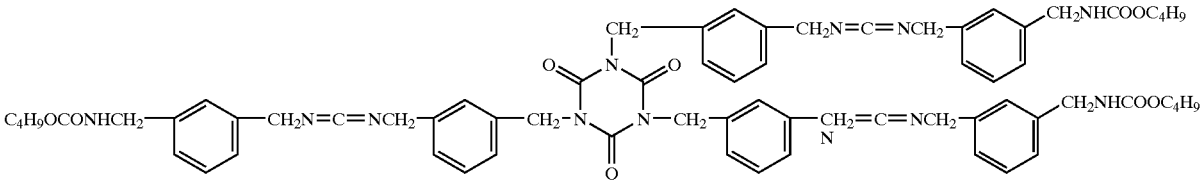
CI-7
$C_2H_5C[CH_2OCONH(CH_2)_6N{=}C{=}N(CH_2)_6NHCOOC_4H_9]_3$
CI-8
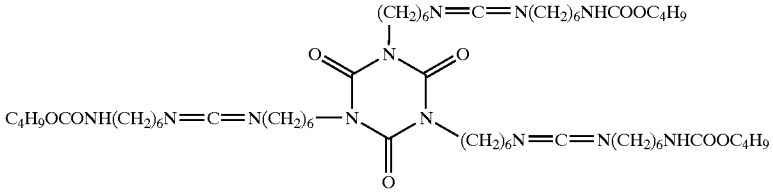

-continued
CI-9
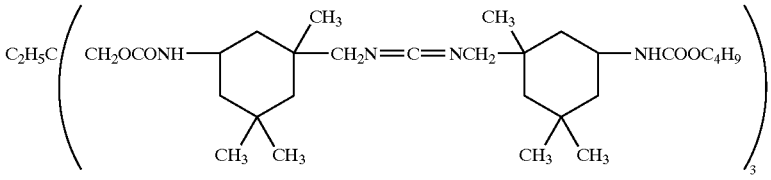
CI-10
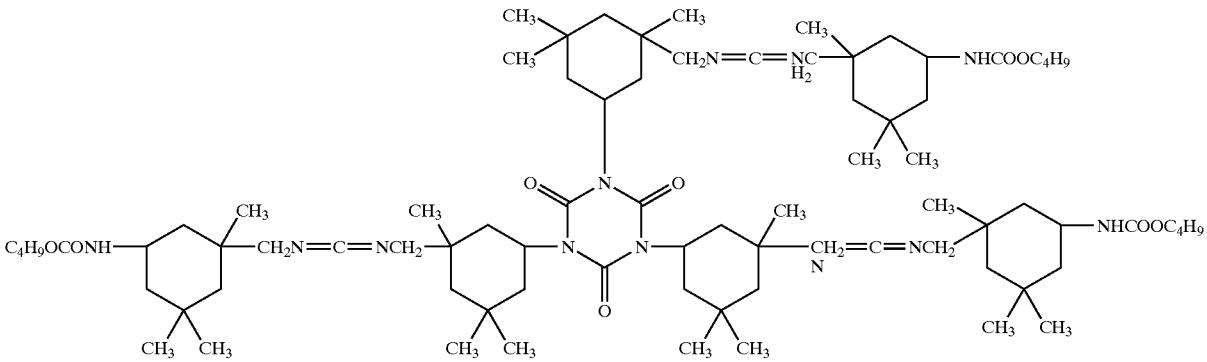
CI-11
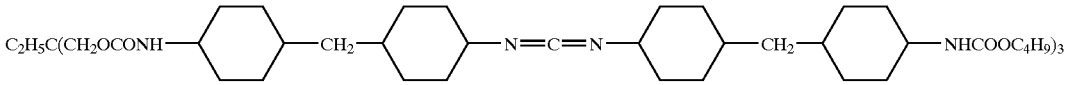
CI-12
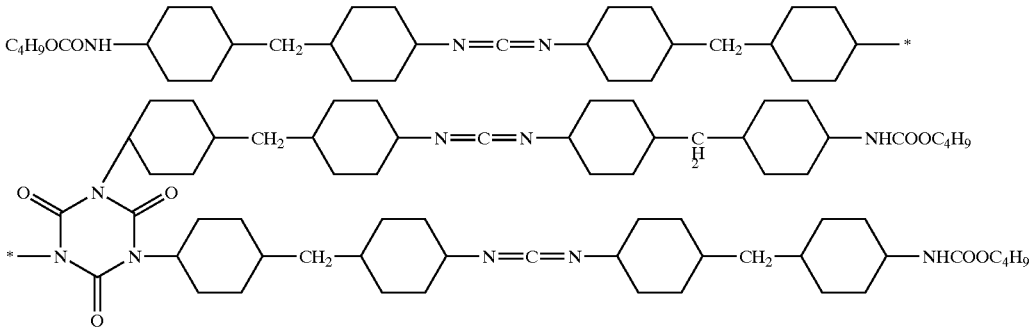
CI-13
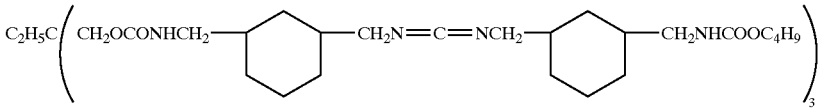
CI-14
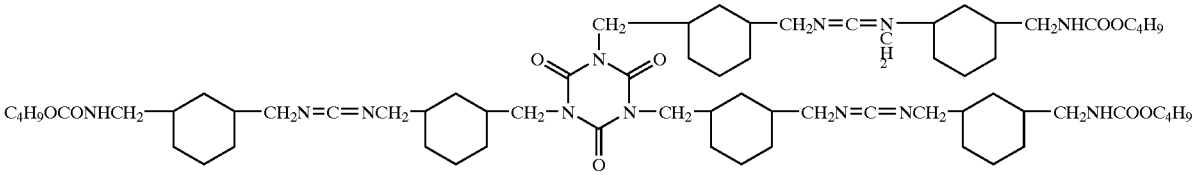
CI-15
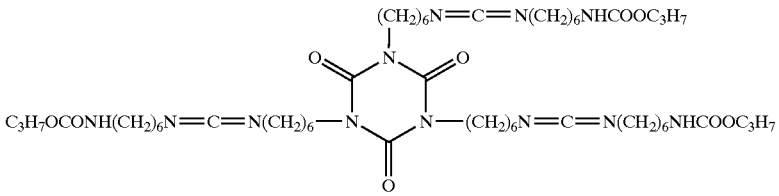

-continued

CI-16

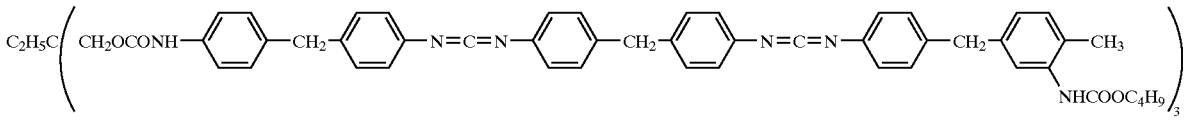

CI-17

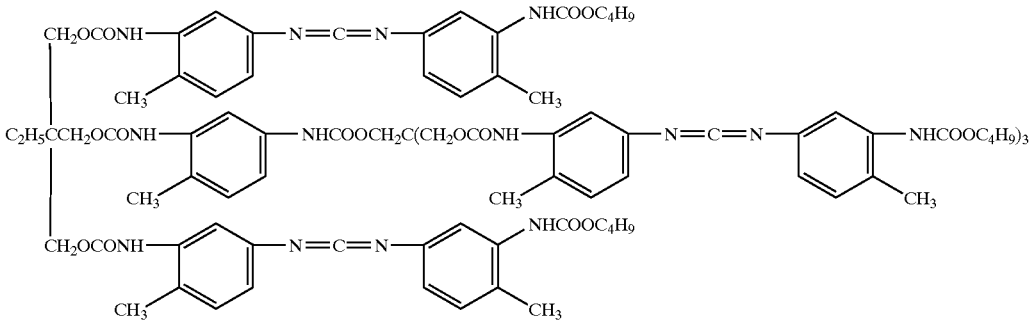

CI-18

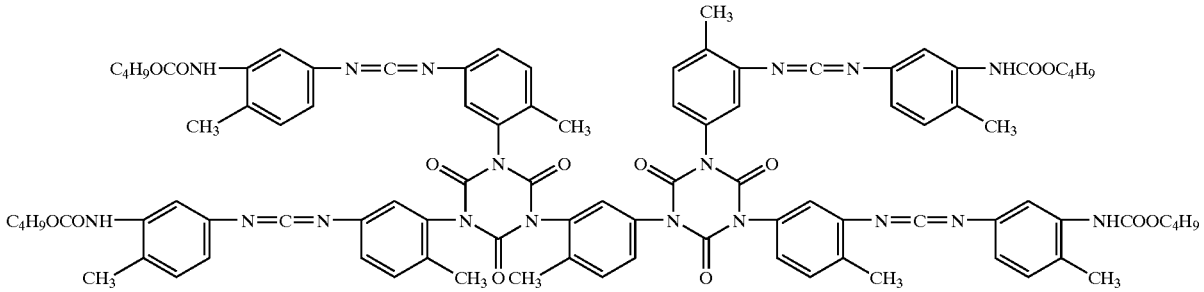

The polyfunctional carbodiimide cross-linking agents may be incorporated into any portion of the photothermographic material, for example, into the interior of a support (e.g., into the sizing of a paper support) or any layer on the photosensitive layer-side of the support, such as a light-sensitive layer, surface protective layer, interlayer, antihalation layer or a sublayer. Thus it may be incorporated into one or a plurality of these layers.

The cross-linking agents described above are used preferably in an amount of 0.001 to 2 mol, and more preferably 0.005 to 1 mol per mol of silver. The agents may be used alone or in combinations thereof, as long as they remain within the above range.

Crosslinking agents usable in the invention include various commonly known crosslinking agents used for photographic materials, such as aldehyde type, epoxy type, vinylsulfone type, sulfone ester type, acryloyl type, carbodiimide type crosslinking agents, as described in JP-A 50-96216. Of these, compounds capable of reacting with a hydroxy group, i.e., hydroxy group-reactive compounds are preferably employed.

One of the preferred cross-linking agents is an isocyanate or thioisocyanate compound represented by the following Formula (2):

$$X{=}C{=}N\text{-}L\text{-}(N{=}C{=}X)_v \qquad \text{Formula (2)}$$

wherein v is 1 or 2; L is a bivalent linkage group having an alkylene, alkenylene, arylene or alkylarylene group; and X is an oxygen atom or a sulfur atom. An arylene ring of the arylene group may be substituted.

Preferred substituents of the above compound represented by formula (2) include a halogen atom (e.g., bromine atom, chlorine atom), hydroxyl, amino, carboxyl, alkyl and alkoxy.

The isocyanate crosslinking agent is an isocyanate compound containing at least two isocyanate group and its adduct. Examples thereof include aliphatic isocyanates, alicyclic isocyanates, benzeneisocyanates, naphthalenediisocyanates, biphenyldiisocyanates, diphenylmethandiisocyanates, triphenylmethanediisocyanates, triisocyanates, tetraisocyanates, their adducts and adducts of these isocyanates and bivalent or trivalent polyhydric alcohols.

Exemplary examples are isocyanate compounds described in JP-A 56-5535 at pages 10–12.

Specifically, adduct of isocyanate and polyhydric alcohol improves adhesion between layers, exhibiting high capability of preventing layer peeling, image slippage or production of bubbles. These polyisocyanate compounds may be incorporated into any portion of the photothermographic material, for example, into the interior of a support (e.g., into size of a paper support) or any layer on the photosensitive layer-side of the support, such as a photosensitive layer, surface protective layer, interlayer, antihalation layer or sublayer. Thus, it may be incorporated into one or plurality of these layers.

The thioisocyanate type crosslinking agent usable in the invention is to be a compound having a thioisocyanate structure, corresponding to the isocyanates described above.

The isocyanate compounds and thioisocyanate compounds used in the invention are preferably those which are capable of functioning as the above cross-linking agent. Even when "v" of the above formula is zero (0), i.e., even a compound containing only one functional group provides favorable effects.

Examples of silane compounds used as a cross-linking agent in the invention include the compounds represented by the following formula (3) or (4):

$$(R^1O)_m—Si-(L_1-R^2)_n$$ Formula (3)

Formula (4)

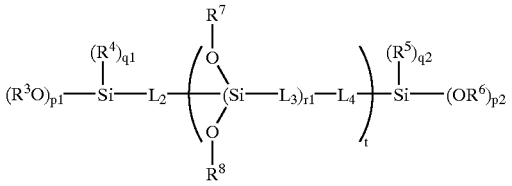

In the formulas, $R^1$, $R^2$, $R^3$, $R^4$, $R^5$, $R^6$, $R^7$ and $R^8$ are each a straight chain, branched or cyclic alkyl group having 1 to 30 carbon atoms (e.g., methyl, ethyl, butyl, octyl, dodecyl, cycloalkyl, alkenyl group (e.g., propenyl, butenyl, nonenyl), an alkynyl group (e.g., acetylene group, bisacetylene group, phenylacetylene group), an aryl group or a heterocyclic group (e.g., phenyl, naphthyl tetrahydropyran, pyridyl, furyl, thiophenyl, imidazol, thiazol, thiadiazol, oxadiazol). These groups may be substituted and substituent groups include any one of electron-withdrawing and electron-donating groups.

At least one substituent group selected from $R^1$, $R^2$, $R^3$, $R^4$, $R^5$, $R^6$, $R^7$ and $R^8$ preferably is a ballast group (or a diffusion-proof group) or an adsorption-promoting group, and more preferably, $R^2$ is a ballast group or an adsorption-promoting group.

The ballast group is preferably an aliphatic group having 6 or more carbon atoms or an aryl group substituted with an alkyl group having 3 or more carbon atoms. Introduction of the ballast group, depending on the amount of a binder or crosslinking agent, restrains diffusion at room temperature, preventing reaction during storage.

$L_1$, $L_2$, $L_3$ and $L_4$ are each a bivalent linkage group, including, for example, $—CH_2—$, $—CF_2—$, $=CF—$, —O—, —S—, —OCO—, —CONH—, $—SO_2NH—$, polyoxyalkylene, thiourea, polymethylene, and the combined groups thereof.

m and n are 1 to 3, and m+n is 4. p1 and p2 are 1 to 3, q1 and q2 is 0, 1 or 2. p1+q1 and p2+q2 are 3, and r1 and t are 0, 1 to 1,000.

The epoxy compound usable in the invention may be any one containing at least one epoxy group and is not limited with respect to the number of the epoxy group, molecular weight and other parameters. The epoxy group is preferably contained in the form of a glycidyl group through an ether bond or an imino bond in the molecule. The epoxy compound may be any one of a monomer, oligomer and polymer, in which the number of the epoxy group in the molecule is preferably 1 to 10 and more preferably 2 to 4. In cases where the epoxy compound is a polymer, it may be either one of a homopolymer and a copolymer. The number-averaged molecular weight (Mn) thereof is preferably 2,000 to 20,000.

The epoxy compound used in the invention is preferably a compound represented by the following Formula (5):

Formula (5)

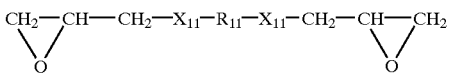

wherein an alkylene group represented by $R_{11}$ in formula (5) may be substituted by a substituent selected from a halogen atom, a hydroxyalkyl group and an amino group; $R_{11}$ in formula (5) preferably contains an amide linkage, ether linkage or thioether linkage; a bivalent linkage group represented by $X_{11}$ is preferably $—SO_2—$, $—SO_2NH—$, —S—, —O— or $—NR_{11}'—$, in which $R_{11}'$ is a univalent linkage group and preferably an electron-withdrawing group.

The epoxy compounds may be used alone or combination thereof. The amount to be added is not specifically limited, but preferably $1\times10^{-6}$ to $1\times10^{-2}$ mol/m$^2$, and more preferably $1\times10^{-5}$ to $1\times10^{-3}$ mol/m$^2$.

The epoxy compound may be added to any layer of a light-sensitive layer, surface protective layer, interlayer, antihalation layer and subbing layer provided on the light-sensitive layer-side of the support and may be added to one or plurality of these layers. Further, it may be added to a layer provided on the opposite side of the support, in combination with the light-sitive layer-side. In the case of a photothermographic material having light-sensitive layers on both sides of the support, it may be added to any one of the layers.

The acid anhydride used in the invention is preferably a compound containing at least an acid anhydride group represented as below:

—CO—O—CO—

The acid anhydride usable in the invention may be any compound containing one or more acid anhydride group, the number of the acid anhydride group, molecular weight or other parameters are not specifically limited, and a compound represented by the following Formula (B) is preferred:

Formula (B)

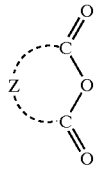

wherein Z is an atomic group necessary to form a monocyclic or polycyclic ring, which may be substituted. Examples of substituent include an alkyl group (e.g., methyl, ethyl, hexyl), an alkoxyl group (e.g., methoxy, ethoxy, octyloxy), an aryl group (e.g., phenyl, naphthyl, tolyl), hydroxy group, an aryloxy group (e.g., phenoxy), an alkylthio group (e.g., methylthio, butylthio), an arylthio group (e.g., phenylthio), an acyl group (e.g., acetyl, propionyl, butylyl), a sulfonyl group (e.g., methylsulfonyl, phenylsulfonyl), an acylamino group, a sulfonylamino group, an acyloxy group (e.g., acetoxy, benzoxy), carboxyl group, cyano group, sulfo group and an amino group. It is preferred not to contain a halogen atom as a substituent.

The acid anhydride compound may be used alone or combination thereof. The amount to be added is not specifically limited, but preferably $1\times10^{-6}$ to $1\times10^{-2}$ mol/m$^2$, and more preferably $1\times10^{-5}$ to $1\times10^{-3}$ mol/m$^2$.

The acid anhydride compound may be added to any layer of a light-sensitive layer, surface protective layer, interlayer, antihalation layer and subbing layer provided on the light-sensitive layer-side of the support and may be added to one or plurality of these layers. Further, it may be added to a layer containing the foregoing epoxy compound.

In the invention, the use of a silver-saving agent can enhance the effects of the invention.

The silver-saving agent used in the invention refers to a compound capable of reducing the silver amount necessary to obtain a prescribed silver density. The action mechanism for the reducing function has been variously supposed and compounds having a function of enhancing covering power of developed silver are preferred. Herein the covering power of developed silver refers to an optical density per unit amount of silver.

Examples of the preferred silver-saving agent include hydrazine derivative compounds represented by the following Formula (H), vinyl compounds represented by Formula (G) and quaternary onium compounds represented by Formula (P):

Formula (H)

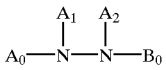

Formula (G)

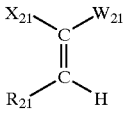

Formula (P)

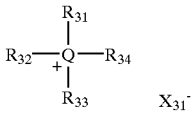

In Formula (H), $A_0$ is an aliphatic group, aromatic group, heterocyclic group, each of which may be substituted, or $-G_0-D_0$ group; $B_0$ is a blocking group; $A_1$ and $A_2$ are both hydrogen atoms, or one of them is a hydrogen atom and the other is an acyl group, a sulfonyl group or an oxalyl group, in which $G_0$ is a —CO—, —COCO—, —CS—, —C(=$NG_1D_1$)-, —SO—, —$SO_2$— or —P(O) ($G_1D_1$)-group, in which $G_1$ is a bond, or a —O—, —S— or —N($D_1$)-group, in which $D_1$ is an aliphatic group, an aromatic group or heterocyclic group or hydrogen atom, provided that when a plural number of $D_1$ are present, they may be the same with or different from each other and $D_0$ is a hydrogen atom, an aliphatic group, aromatic group, heterocyclic group, amino group, alkoxy group, aryloxy group, alkylthio group or arylthio group. $D_0$ is preferably a hydrogen atom, an alkyl group, an alkoxy group or an amino group.

In Formula (H), an aliphatic group represented by $A_0$ of formula (H) is preferably one having 1 to 30 carbon atoms, more preferably a straight-chained, branched or cyclic alkyl group having 1 to 20 carbon atoms. Examples thereof are methyl, ethyl, t-butyl, octyl, cyclohexyl and benzyl, each of which may be substituted by a substituent (such as an aryl, alkoxy, aryloxy, alkylthio, arylthio, sulfo-oxy, sulfonamido, sulfamoyl, acylamino or ureido group).

An aromatic group represented by $A_0$ of Formula (H) is preferably a monocyclic or condensed-polycyclic aryl group such as a benzene ring or naphthalene ring. A heterocyclic group represented by $A_0$ is preferably a monocyclic or condensed-polycyclic one containing at least one heteroatom selected from nitrogen, sulfur and oxygen such as a pyrrolidine-ring, imidazole-ring, tetrahydrofuran-ring, morpholine-ring, pyridine-ring, pyrimidine-ring, quinoline-ring, thiazole-ring, benzthiazole-ring, thiophene-ring or furan-ring. The aromatic group, heterocyclic group or $-G_0-D_0$ group represented by $A_0$ each may be substituted. Specifically preferred $A_0$ is an aryl group or $-G_0-D_0$ group.

In Formula (H), $A_0$ contains preferably a non-diffusible group or a group for promoting adsorption to silver halide. As the non-diffusible group is preferably a ballast group used in immobile photographic additives such as a coupler. The ballast group includes an alkyl group, alkenyl group, alkynyl group, alkoxy group, phenyl group, phenoxy group and alkylphenoxy group, each of which has 8 or more carbon atoms and is photographically inert.

In Formula (H), the group for promoting adsorption to silver halide includes a thioureido group, thiourethane, mercapto group, thioether group, thione group, heterocyclic group, thioamido-heterocyclic group, mercapto-heterocyclic group or an adsorption group as described in JP A 64-90439.

In Formula (H), $B_0$ is a blocking group, and preferably $-G_0-D_0$, wherein $G_0$ is a —CO—, —COCO—, —CS—, —C(=$NG_1D_1$)-, —SO—, —$SO_2$— or —P(O)($G_1D_1$)-group, and preferred $G_0$ is a —CO—, —COCO—, in which $G_1$ is a linkage, or a —O—, —S— or —N($D_1$)-group, in which $D_1$ represents an aliphatic group, aromatic group, heterocyclic group, or a hydrogen atom, provided that when a plural number of $D_1$ are present, they may be the same with or different from each other. $D_0$ is a hydrogen atom, an aliphatic group, aromatic group, heterocyclic group, amino group, alkoxy group, aryloxy group, alkylthio group or arylthio group, and preferably, a hydrogen atom, or an alkyl, alkoxy or amino group. $A_1$ and $A_2$ are both hydrogen atoms, or one of them is a hydrogen atom and the other is an acyl group, (acetyl, trifluoroacetyl or benzoyl), a sulfonyl group (methanesulfonyl or toluenesulfonyl) or an oxalyl group (ethoxaly).

The compounds of Formulas (H) can be readily synthesized in accordance with methods known in the art, as described in, for example, U.S. Pat. Nos. 5,464,738 and 5,496,695.

Furthermore, preferred hydrazine derivatives include compounds H-1 through H-29 described in U.S. Pat. No. 5,545,505, col. 11 to col. 20; and compounds 1 to 12 described in U.S. Pat. No. 5,464,738, col. 9 to col. 11. These hydrazine derivatives can be synthesized in accordance with commonly known methods.

In Formula (G), $X_{21}$ and $R_{21}$ may be either cis-form or trans-form. The structure of its exemplary compounds is also similarly included.

In Formula (G), $X_{21}$ is an electron-with drawing group; $W_{21}$ is a hydrogen atom, an alkyl group, alkenyl group, an alkynyl group, an aryl group, a heterocyclic group, a halogen atom, an acyl group, a thioacyl group, an oxalyl group, an oxyoxalyl group, a thiooxalyl group, an oxamoyl group, an oxycarbonyl group, a thiocarbonyl group, a carbamoyl group, a thiocarbmoyl group, a sulfonyl group, a sulfinyl group, an oxysulfinyl group, a thiosulfinyl group, a sulfamoyl group, an oxysulfinyl group, a thiosulfinyl group, a sulfinamoyl group, a phosphoryl group, a nitro group, an imino group, a N-carbonylimino group, a N-sulfonylimino group, a dicyanoethylene group, an ammonium group, a sulfonium group, a phosphonium group, pyrylium group, or an immonium group.

$R_{21}$ is a halogen atom, a hydroxyl group, an alkoxy group, an aryloxy group, a heterocyclic-oxy group, an alkenyloxy group, an acyloxy group, an alkoxycarbonyloxy group, an aminocarbonyloxy group, a mercapto group, an alkylthio group, an arylthio group, a heterocyclic-thio group, an alkenylthio group, an acylthio group, an alkoxycarbonylthio group, an aminocarbonylthio group, an organic or inorganic salt of hydroxyl or mercapto group (e.g., sodium salt, potassium salt, silver salt, etc.), an amino group, an alkylamino group, a cyclic amino group (e.g., pyrrolidino), an acylamino group, an oxycarbonylamino group, a heterocyclic group (5- or 6-membered nitrogen containing heterocyclic group such as benztriazolyl, imidazolyl, triazolyl, or tetrazolyl), a ureido group, or a sulfonamido group. $X_{21}$ and $W_{21}$, or $X_{21}$ and $R_{21}$ may combine together with each other to form a ring. Examples of the ring formed by $X_{21}$ and $W_{21}$ include pyrazolone, pyrazolidinone, cyclopentadione, β-ketolactone, and β-ketolactam.

Formula (G) will be further explained. The electron-withdrawing group represented by $X_{21}$ refers to a substituent group exhibiting a negative substituent constant σp. Examples thereof include a substituted alkyl group (e.g., halogen-substituted alkyl, etc.), a substituted alkenyl group (e.g., cyanovinyl, etc.), a substituted or unsubstituted alkynyl group (e.g., trifluoromethylacetylenyl, cyanoacetylenyl, etc.), a substituted aryl group (e.g., cyanophenyl, etc.), a substituted or unsubstituted heterocyclic group (e.g., pyridyl, triazinyl, benzoxazolyl, etc.), a halogen atom, a cyano group, an acyl group (e.g., acetyl, trifluoroacetyl, formyl, etc.), thioacetyl group (e.g., thioacetyl, thioformyl, etc.), an oxalyl group (e.g., methyloxalyl, etc.), an oxyoxalyl group (e.g., ethoxalyl, etc.), a thiooxalyl group (e.g., ethylthiooxalyl, etc.), an oxamoyl group (e.g., methyloxamoyl, etc.), an oxycarbonyl group (e.g., ethoxycarbonyl, etc.), a carboxyl group, a thiocarbonyl group (e.g., ethylthiocarbonyl, etc.), a carbamoyl group, a thiocarbamoyl group, a sulfonyl group, a sulfinyl group, an oxysulfonyl group (e.g., ethoxysulfonyl), a thiosulfonyl group (e.g., ethylthiosulfonyl, etc.), a sulfamoyl group, an oxysulfinyl group (e.g., methoxysulfinyl, etc.), a thiosulfinyl (e.g., methylthiosulfinyl, etc.), a sulfinamoyl group, phosphoryl group, a nitro group, an imino group, N-carbonylimino group (e.g., N-acetylimino, etc.), a N-sulfonylimino group (e.g., N-methanesufonylimono, etc.), a dicynoethylene group, an ammonium group, a sulfonium group, a phophonium group, pyrilium group and inmonium grou, and further including a group of a heterocyclic ring formed by an ammonium group, sulfonium group, phosphonium group or immonium group. Of these groups, groups exhibiting σp of 0.3 or more are specifically preferred.

Examples of the alkyl group represented by $W_{21}$ include methyl, ethyl and trifluoromethyl; examples of the alkenyl group include vinyl, halogen-substituted vinyl and cyanovinyl; examples of the alkynyl group include acetylenyl and cyanoacetylenyl; examples of the aryl group include nitrophenyl, cyanophenyl, and pentafluorophenyl; and examples of the heterocyclic group include pyridyl, pyrimidyl, triazinyl, succinimido, tetrazolyl, triazolyl, imidazolyl, and benzoxazolyl. $W_{21}$ is preferably an electron-withdrawing group exhibiting positive σp value and the group exhibiting σp of 0.3 or more is specifically preferred.

Of the groups represented by $R_{21}$, a hydroxyl group, a mercapto group, an alkoxy group, an alkylthio group, a halogen atom, an organic or inorganic salt of a hydroxyl or mercapto group and a heterocyclic group are preferred, and a hydroxyl group, an alkoxy group, an organic or inorganic salt of a hydroxyl or mercapto group and a heterocyclic group are more preferred, and an organic or inorganic salt of a hydroxyl or mercapto group is sill more preferred. Examples of preferably used in the invention are shown below.

A1

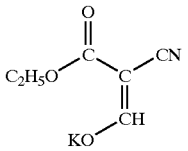

A2

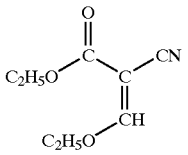

-continued

A3

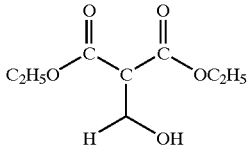

A4

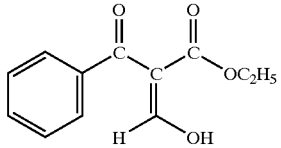

A5

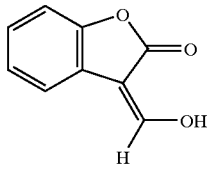

A6

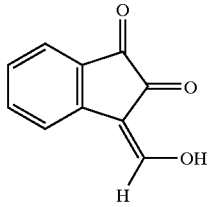

A7

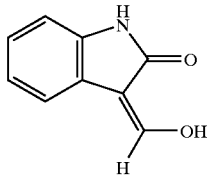

A8

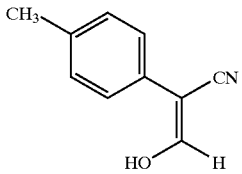

A9

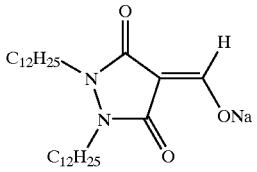

A10

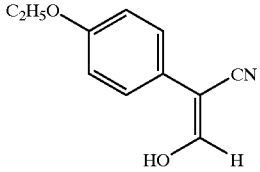

In Formula (P), Q is a nitrogen atom or a phosphorus atom; $R_{31}$, $R_{32}$, $R_{33}$ and $R_{34}$ each are a hydrogen atom or a substituent group, provided that $R_{31}$, $R_{32}$, $R_{33}$ and $R_{34}$ combine together with each other to form a ring; and $X^-$ is an anion.

Examples of the substituent represented by $R_{31}$, $R_{32}$, $R_{33}$ and $R_{34}$ include an alkyl group (e.g., methyl, ethyl, propyl, butyl, hexyl, cyclohexyl), alkenyl group (e.g., allyl, butenyl), alkynyl group (e.g., propargyl, butynyl), aryl group (e.g., phenyl, naphthyl), heterocyclic group (e.g., piperidinyl, piperazinyl, morpholinyl, pyridyl, furyl, thienyl, tetrahydrofuryl, tetrahydrothienyl, sulforanyl), and amino group.

Examples of the ring formed by $R_{31}$, $R_{32}$, $R_{33}$ and $R_{34}$ include a piperidine ring, morpholine ring, piperazine ring, quinuclidine ring, pyridine ring, pyrrole ring, imidazole ring, triazole ring and tetrazole ring.

The groups represented by $R_{31}$, $R_{32}$, $R_{33}$ and $R_{34}$ may be further substituted by a hydroxyl group, alkoxy group, aryloxy group, carboxyl group, sulfo group, alkyl group or aryl group. Of these, $R_{31}$, $R_{32}$, $R_{33}$ and $R_{34}$ are each preferably a hydrogen atom or an alkyl group.

Examples of the anion of $X^-$ include an inorganic or organic anion such as a halide ion, sulfate ion, nitrate ion, acetate ion and p-toluenesulfonic acid ion.

The quaternary onium salt compounds described above can be readily synthesized according to the methods commonly known in the art. For example, the tetrazolium compounds described above may be referred to Chemical Review 55, page 335–483. The silver-saving agents described above are used preferably in an amount of $10^{-5}$ to 1 mol, and more preferably $10^{-4}$ to $5\times10^{-1}$ mol per mol of organic silver salt.

With regard to the difference in constitution between a conventional silver salt photographic material and a photothermographic imaging material, the photothermographic imaging material contains relatively large amounts of light sensitive silver halide, a carboxylic acid silver salt and a reducing agent, which often cause fogging and silver printing-out (printed out silver). In the photothermographic imaging material, therefore, an enhanced technique for antifogging and image-lasting is needed to maintain storage stability not only before development but also after development. In addition to commonly known aromatic heterocyclic compounds to restrain growth of fogged specks and development thereof, usable are mercury compounds having a function of allowing the fog specks to oxidatively die away. However, such mercury compounds causes problems with respect to working safety and environmental protection.

Next, antifoggants and image stabilizers used in the photothermographic material relating to the invention will be described.

As a reducing agent used in photothermographic materials are employed reducing agents containing a proton, such as bisphenols and sulfonamidophenols. Accordingly, a compound generating a labile species which is capable of abstracting a proton to deactivate the reducing agent is preferred. More preferred is a compound as a non-colored photo-oxidizing substance, which is capable of generating a free radical as a labile species on exposure.

Any compound having such a function is applicable. An organic free radical composed of plural atoms is preferred. Any compound having such a function and exhibiting no adverse effect on the silver salt photothermographic material is usable irrespective of its structure.

Of such free radical generation compounds, a compound containing an aromatic, and carbocyclic or heterocyclic group is preferred, which provides stability to the generated free radical so as to be in contact with the reducing agent for a period sufficient to react with the reducing agent to deactivate it.

Representative examples of such compounds include biimidazolyl compounds and iodonium compounds shown below.

Of such biimidazolyl compounds, a compound represented by the following formula (6) is preferred:

Formula (6)

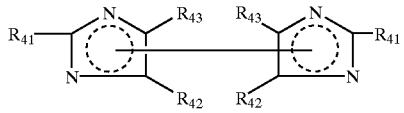

wherein $R_{41}$, $R_{42}$ and $R_{43}$ (which may be the same or different) each are an alkyl group (e.g., methyl, ethyl, hexyl), an alkenyl group (e.g., vinyl, allyl), an alkoxyl group (e.g., methoxy, ethoxy, octyloxy), an aryl group (e.g., phenyl, naphthyl, tolyl), a hydroxyl group, a halogen atom, an aryloxyl (e.g., phenoxy), an alkylthio group (e.g., methylthio, butylthio), an arylthio group (e.g., phenylthio), an acyl group (e.g., acetyl, propionyl, butylyl, valeryl), a sulfonyl group (e.g., methylsulfonyl, phenylsulfonyl), an acylamino group, a sulfonylamino group, an acyloxy group (e.g., acetoxy, benzoxy), a carboxyl group, a cyano group, a sulfo group, or an amino group. Of these groups are preferred an aryl group, a heterocyclic group, an alkenyl group and a cyano group.

The foregoing biimidazolyl compounds can be synthesized in accordance with the methods described in U.S. Pat. No. 3,734,733 and British Patent No. 1,271,177. Preferred examples thereof are shown below.

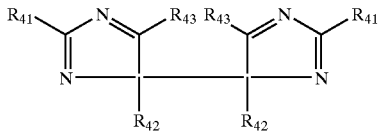

| | $R_{41}$ | $R_{42}$ | $R_{43}$ |
|---|---|---|---|
| BI-1 | H | CN | H |
| BI-2 | CN | H | CN |
| BI-3 | $CF_3$ | H | $CF_3$ |
| BI-4 | 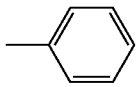 | 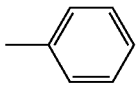 | 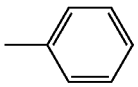 |

-continued

| | | | |
|---|---|---|---|
| BI-5 | 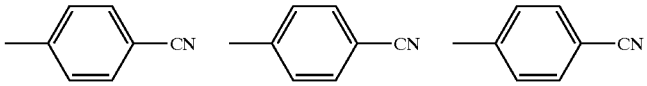 | | |
| BI-6 | 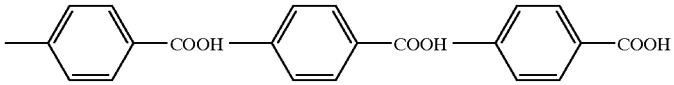 | | |
| BI-7 | H | —CH=CH$_2$ | H |
| BI-8 | 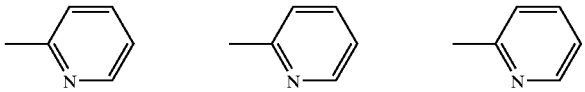 | | |
| BI-9 | 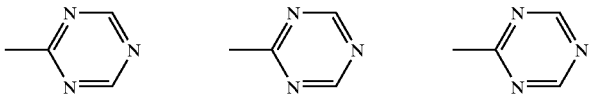 | | |

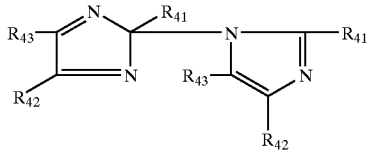

| | $R_{41}$ | $R_{42}$ | $R_{43}$ |
|---|---|---|---|
| BI-10 | H | 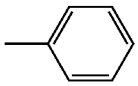 | 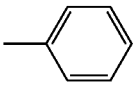 |
| BI-11 | CN | H | H |
| BI-12 | CN | 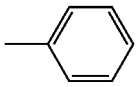 | 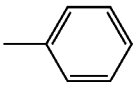 |
| BI-13 | H | 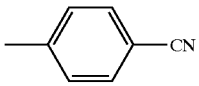 | 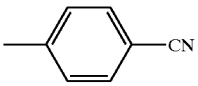 |
| BI-14 | H | $CF_3$ | H |
| BI-15 | H | 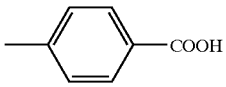 | 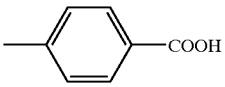 |
| BI-16 | H | 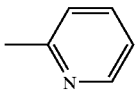 | 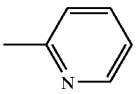 |

Similarly preferred compounds include an iodonium compound represented by the following formula (7):

Formula (7)

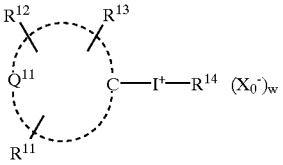

In the formula, $Q^{11}$ is a group of atoms necessary to complete a 5-, 6-, or 7-membered ring, and the atoms being selected from a carbon atom, nitrogen atom, oxygen atom and sulfur atom; and $R^{11}$, $R^{12}$ and $R^{13}$ (which may be the same or different) are each a hydrogen atom, an alkyl group (e.g., methyl, ethyl, hexyl), an alkenyl group (e.g., vinyl, allyl), an alkoxyl group (e.g., methoxy, ethoxy, octyloxy), an aryl group (e.g., phenyl, naphthyl, tolyl), a hydroxyl group, a halogen atom, an aryloxyl (e.g., phenoxy), an alkylthio group (e.g., methylthio, butylthio), an arylthio group (e.g., phenylthio), an acyl group (e.g., acetyl, propionyl, butylyl, valeryl), a sulfonyl group (e.g., methylsulfonyl, phenylsulfonyl), an acylamino group, sulfonylamino group, an acyloxy group (e.g., acetoxy, benzoxy), a carboxyl group, a cyano group, a sulfo group, or an amino group. Of these groups are preferred an aryl group, an alkenyl group and a cyano group.

$R^{14}$ is a carboxylate group such as acetate, benzoate or trifluoroacetate, or $O^-$, and w is 0 or 1.

$X^-$ is an anionic counter ion, and preferably $CH_3CO_2^-$, $CH_3SO_3^-$ and $PF_6^-$.

When $R^{13}$ is a sulfo group or a karboxyl group, w is 0 and $R^{14}$ is $O^-$.

$R^{11}$, $R^{12}$ and $R^{13}$ may be bonded with each other to form a ring. Of these is specifically preferred a compound represented by following formula (8):

Formula (8)

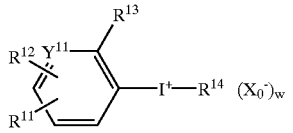

In the formula (8), $R^{11}$, $R^{12}$, $R^{13}$, $R^{14}$, $X_0$ and w are each the same as defined in foregoing formula (7); $Y^{11}$ is a carbon (i.e., —CH═) to form a benzene ring or a nitrogen atom (—N═) to form a pyridine ring.

The iodonium compounds described above can be synthesized in accordance with the methods described in Org. Syn., 1961 and Fieser, "Advanced Organic Chemistry" (Reinhold, N.Y., 1961). The details of the substituent groups and specifically preferable examples are described in JP-A 2000-321711 (before-mentioned), for example.

The compounds represented above formula (6) and (7) are used in an amount of 0.001 to 0.1 mol/m$^2$, and preferably 0.005 to 0.05 mol/m$^2$. The compound may be incorporated into any component layer of the photothermographic material relating to the invention and is preferably incorporated in the vicinity of a reducing agent.

As a compound capable of deactivating a reducing agent to inhibit reduction of an organic silver salt to silver by the reducing agent are preferred compounds releasing a labile species other than a halogen atom. However, these compounds may be used in combination with a compound capable of releasing a halogen atom as a labile species. The combination in use may result in a better effect.

Examples of the compound releasing an active halogen atom include a compound represented by following formula (9):

Formula (9)

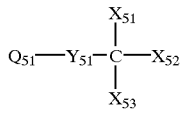

In formula (9), $Q_{51}$ is an aryl group or a heterocyclic group; $X_{51}$, $X_{52}$ and $X_{53}$ are each a hydrogen atom, a halogen atom, an acyl group, an alkoxycarbonyl group, an aryloxycarbonyl group, a sulfonyl group, or an aryl group, provided that at least of them a halogen atom; $Y_{51}$ is —C(═O)—, —SO— or —$SO_2$—.

The aryl group represented by $Q_{51}$ may be a monocyclic group or condensed ring group and is preferably a monocyclic or di-cyclic aryl group having 6 to 30 carbon atoms (e.g., phenyl, naphthyl), more preferably a phenyl or naphthyl group, and still more preferably a phenyl group.

The heterocyclic group represented by $Q_{51}$ is a 3- to 10-membered, saturated or unsaturated heterocyclic group containing at least one of N, O and S, which may be a monocyclic or condensed with another ring to form a condensed ring.

The heterocyclic group is preferably a 5- or 6-membered unsaturated heterocyclic group, which may be condensed, more preferably a 5- or 6-membered aromatic heterocyclic group, which may be condensed, still more preferably a N-containing 5- or 6-membered aromatic heterocyclic group, which may be condensed, and optimally a 5- or 6-membered aromatic heterocyclic group containing one to four N atoms, which may be condensed. Exemplary examples of heterocyclic rings included in the heterocyclic group include imidazole, pyrazole, pyridine, pyrimidine, pyrazine, pyridazine, triazole, triazine, indole, indazole, purine, thiadiazole, oxadiazole, quinoline, phthalazine, naphthyridine, quinoxaline, quinazoline, cinnoline, pteridine, acrydine, phenanthroline, phenazine, tetrazole, thiazole, oxazole, benzimidazole, benzoxazole, benzthiazole, indolenine and tetrazaindene. Of these, are preferred imidazole, pyridine, pyrimidine, pyrazine, pyridazine, triazole, triazine, thiadiazole, oxadiazole, quinoline, phthalazine, naphthylizine, quinoxaline, quinazoline, cinnoline, tetrazole, thiazole, oxazole, benzimidazole, and tetrazaindene; more preferably imidazole, piridine, pyrimidine, pyrazine, pyridazine, triazole, triazines, thiadiazole, quinoline, phthalazine, naphthyridine, quinoxaline, quinazoline, cinnoline, tetrazole, thiazole, benzimidazole, and benzthiazole; and still more preferably pyridine, thiadiazole, quinoline and benzthiazole.

The aryl group or heterocyclic group represented by $Q_{51}$ may be substituted by a substituent, in addition to —Y—C($X_{51}$)($X_{52}$)($X_{53}$). Preferred examples of the substituent include an alkyl group, an alkenyl group, an aryl group, an alkoxyl group, an aryloxyl group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, a ureido group, a phosphoramido group, a halogen atom, a cyano group, a sulfo group, a carboxyl group, a nitro group and a heterocyclic group. Of these are preferred an alkyl group, an aryl group, an alkoxyl group, an aryloxyl group, an acyl group, an acylamino group, an aryloxyl group, an acyl group, an acylamino group, an alkoxycarbonylamino group, an aryloxycarbonylamino group, a sulfonylamino group, a sulfamoyl group, a carbamoyl group, a ureido group, a phosphoramido group, a halogen atom, a cyano group, a nitro group, and a heterocyclic group; and more preferably an alkyl group, an aryl group, an alkoxyl group, an aryloxyl group, an acyl group, an acylamino group, a sulfonylamino group, a sulfamoyl group, a carbamoyl group, a halogen group, a cyano group, a nitro group and a heterocyclic group; and still more preferably an alkyl group, an aryl group and a halogen atom.

$X_{51}$, $X_{52}$ and $X_{53}$ are preferably a halogen atom, a haloalkyl group, an acyl group, an alkoxycarbonyl group, an aryloxycarbonyl group, a carbamoyl group, a sulfamoyl group, a sulfonyl group, and a heterocyclic group, more preferably a halogen atom, a haloalkyl group, an acyl group, an alkoxycarbonyl group, an aryloxycarbonyl group, and a sulfonyl group; and still more preferably a halogen atom and trihalomethyl group; and most preferably a halogen atom. Of halogen atoms are preferably chlorine atom, bromine and iodine atom, and more preferably chlorine atom and bromine atom, and still more preferably bromine atom.

$Y_{51}$ is —C(═O)—, —SO—, and —$SO_2$—, and preferably —$SO_2$—.

The amount of this compound to be incorporated is preferably within the range in which an increase of printed-out silver caused by formation of silver halide becomes substantially no problem, more preferably not more than 150% by weight and still more preferably not more than 100% by weight, based on the compound releasing no active halogen atom.

Further, in addition to the foregoing compounds, compounds commonly known as an antifoggant may be incorporated in the photothermographic material used in the invention. In such a case, the compounds may be those which form a labile species similarly to the foregoing compounds or those which are different in antifogging mechanism. Examples thereof include compounds described in U.S. Pat. Nos. 3,589,903, 4,546,075 and 4,452,885; JP-A No. 59-57234; U.S. Pat. Nos. 3,874,946 and 4,756,999; and JP-A Nos. 9-288328 and 9-90550. Further, other antifoggants include, for example, compounds described in U.S. Pat. No. 5,028,523 and European patent Nos. 600,587, 605,981 and 631,176.

Photothermographic materials of the invention, which form photographic images by thermal development, is preferably incorporated with optionally a color toning agent for adjusting silver image color tone, which are contained in the form of a dispersion in a binder matrix (usually organic).

Exemplary preferred toning agents used in the invention are described in RD17029, U.S. Pat. Nos. 4,123,282, 3,994,732, 3,846,136 and, 4,021,249.

Examples thereof include imides (succinimide, phthalimide, naphthalimide, N-hydroxy-1,8-naphthalimide, etc.); mercaptanes (e.g., 3-mercapto-1,2,4-triazole, etc.); phthalazinone derivatives and their metal salt [e.g., phthalazinone, 4-(1-naphthyl)phthalazinone, 6-chlorophthalazinone, 5,7-dimethyloxyphthalazinone, 2,3-dihydroxy-1,4-phthalzinedione, etc.]; combinations of phthalazine and phthalic acids (e.g., phthalic acid, 4-methylphthalic acid, 4-nitrophthalic acid, tetrachlorophthalic acid, etc.); and combinations of phthalazine and at least one selected from maleic acid anhydride, phthalic acid, 2,3-naphthalenedicarboxylic acid, and o-phenylenic acid derivatives and their anhydrides (e.g., phthalic acid, 4-methyphthalic acid, 4-nitrophthalic acid, tetrachlorophthalic acid, etc.). Specifically preferred toning agents include phthalazinone, a combination of phthalazine, and phthalic acids or phthalic acid anhydrides.

With regard to image tone of the outputted image used for medical diagnosis, it has been supposed that more exact diagnostic observation results can be easily achieved with cold image tone. The cold image tone refers to pure black tone or bluish black tone and the warm image tone refers to a brownish black image exhibiting a warm tone.

The expression regarding to the tone, i.e., "colder tone" or "warmer tone" can be determined based on a hue angle, $h_{ab}$ at a density of 1.0 and minimum density Dmin, as defined in JIS Z 8729. The hue angle, hab can be determined with the formula described below, using color coordinates a* and b* in L*a*b*color system which is recommended by Commission Internationale de I'Eclairage (CIE) in 1976, of which L*a*b*color system has color space nearly equable persep-tin.

$$h_{ab}=\tan^{-1}(b^*/a^*)$$

In the invention, when the photothermographic material is used for medical use, the range of the $h_{ab}$ is preferably $180°<h_{ab}<270°$, more preferably $200°<h_{ab}<270°$, and still more preferably $220°<h_{ab}<260°$.

In the present invention, a matting agent is preferably incorporated into the outermost layer of the image forming layer having an average grain size of Le (μm) and the outermost layer of the back coat layer having an average grain size of Lb (μm). The ratio of Lb/Le is preferably 1.5 to 10. Uneven density during heat-development can be reduced when Lb/Le is within this range.

In the present invention, organic or inorganic powder material which is preferably incorporated as a matting agent into the surface layer of the photothermographic material (on the image forming layer side or even in cases where a light-insensitive layer is provided on the opposite side of the support to the image forming layer), to achieve the purpose of the invention and to control the surface roughness. Powder material used in this invention may be the powder exhibiting preferably more than 5 on the Mohs' scale of hardness. Powder materials of the matting agent employed in this invention may be either commonly known organic substances or inorganic substances. Examples of the inorganic powder substances include titanium oxide, barium sulfate, boron nitrate, $SnO_2$, $Cr_2O_3$, $\alpha$-$Al_2O_3$, $\alpha$-$Fe_2O_3$, $\alpha$-FeOOH, SiC, cerium oxide, corundum, artificial diamond, garnet, mica, silica rock, silica nitride, and silica carboride. Examples of the organic powder substances include polymethyl methacrurate, polystyrene, and Teflon (R). Of these preferably used is inorganic powder such as $SiO_2$, titanium oxide, barium sulfate, $\alpha$-$Al_2O_3$, $\alpha$-$Fe_2O_3$, $\alpha$-FeOOH, $Cr_2O_3$, and mica, more preferably $SiO_2$ and $\alpha$-$Al_2O_3$, and still more preferably $SiO_2$.

In this invention, the foregoing powder is preferably surface-treated with Si compoud and/or Al compound. The use of the surface treated powder leads to better surface characteristics of the outermost layer. As the foregoing Si and/or Al compound on the foregoing powder, preferably the content of Si is also 0.1 to 10 wt %, that of Al is 0.1 to 10 wt %, more preferably Si and Al are both 0.1 to 5 wt %, still more preferably Si and Al are both 0.1 to 2 wt %. Further, the weight ratio of Si and Al is preferably Si<Al. A surface treatment is conducted by a method described in JP-A 2-83219. The average particle size refers to the average diameter of spherical powder grains, the average length of the major axis of needle powders and the average length of the diagonal axis of tabular powder. The average is easily determined using an electron microscope.

The matting agent used in this invention preferably has an average particle diameter of 0.5 to 10 μm, and more preferably 1.0 to 8.0 μm.

Furthermore, the average grain size of the inorganic or organic powder contained in the outermost layer of the light-sensitive layer side is 0.5 to 8.0 μm, preferably is 1.0 to 6.0 μm, and more preferably 2.0 to 5.0 μm. The added amount is usually 1.0 to 20 wt % to the amount of a binder used in the outermost layer (a hardening agent is included in this amount of a binder), and is preferably 2.0 to 15 wt %, more preferably 3.0 to 10 wt %. The average particle size of organic or inorganic powders contained in the outermost layer of the opposite side to a light-sensitive layer on a support is usually 2.0 to 15.0 μm, is preferably 3.0 to 12.0 μm, and more preferably is 4.0 to 10.0 μm. The added amount is usually 1.0 to 20 wt % of the amount of a binder used in the outermost layer (a hardening agent is included in this amount of a binder), preferably is 0.4 to 7.0 wt %, and more preferably is 0.6 to 5.0 wt %.

The variation coefficient of the size distribution of the powder is preferably not more than 50%, is more preferably not more than 40%, and is still more preferably not more than 30%.

Here, the variation coefficient of the grain size distribution as described herein is is a value represented by the following formula:

$$\{(\text{standard deviation of particle size/average particle size})\}\times 100.$$

Addition methods of the matting agent of the inorganic or organic powder include those in which a matting agent is previously dispersed into a coating composition and is then coated, and prior to the completion of drying, a matting agent is sprayed. When plural matting agents are added, both methods may be employed in combination.

Suitable supports used in the photothermographic materials of the invention include various polymeric materials, glass, wool cloth, cotton cloth, paper, and metals (such as aluminum). Flexible sheets or roll-convertible one are preferred from view of handling as an information recording material. Examples of preferred support used in the invention include plastic resin films such as cellulose acetate film, polyester film, polyethylene terephthalate film, polyethylene naphthalate film, polyamide film, polyimide film, cellulose triacetate film and polycarbonate film, and biaxially stretched polyethylene terephthalate (PET) film is specifically preferred. The support thickness is 50 to 300 $\mu$m, and preferably 70 to 180 $\mu$m.

To improve electrification properties of photothermographic materials, metal oxides and/or conductive compounds such as conductive polymers may be incorporated into the constituent layer. These compounds may be incorporated into any layer and preferably into a backing layer, a surface protective layer or a sublayer of alight-sensitive layer side. Conductive compounds described in U.S. Pat. No. 5,244,773, col. 14–20 are preferably used in the invention.

Specifically in this invention, it is preferred to contain a conductive metal oxide in a surface protective layer of a backing layer side. It was proved that the effects of the invention are more effectively enhanced by the above addition of the oxide, said effect is specifically enhanced transportability during the thermal developing process. Here, a conductive metal oxide is comprised of crystal metal oxide particles, and the oxide containing an oxygen deficiency and a small amount of different atoms forming donors on the used oxide, is specifically preferred due to the high conductivity. Especially, the latter is preferred because it does not cause fogging to silver halide emulsions. Preferable examples of metal oxide include Zno, $TiO_2$, $SnO_2$, $Al_2O_3$, $In_2O_3$, $SiO_2$, MgO, BaO, $MoO_3$, $V_2O_5$ or its composite oxide, but ZnO, $TiO_2$ and $SnO_2$ are specifically preferred. Examples containing a different atom include, for example, addition of Al or In to ZnO, addition of Sb, Nb, P or a halogen atom to $SnO_2$, Nb or Ta to $TiO_2$. The added amount of these different atoms is preferably in the range of 0.01 to 30 mol %, and more preferably is 0.1 to 10 mol %. Further, a silicon compound may preferably be added during preparation of fine particles to improve dispersibility and transparency of the fine particles. The metal oxide fine particles used in this invention exhibit conductivity and the volume resistivity is not more than $10^7$ Ωcm, and preferably not more than $10^5$ Ωcm. These oxides are described in JP-A Nos. 56-143431, 56-120519 and 58-62647. A conductive material which adheres to the above metal oxide on fine particles of other crystal metal oxides or fibrous metal oxides (e.g., titanium oxide) may be used as described in JP-B 59-6235.

The grain size used is preferably not more than 1 $\mu$m, and a size of not more than 0.5 $\mu$m is more preferable due to stability after dispersion. The use of a conductive particle of not more than 0.3 $\mu$m is specifically preferred when forming a transparent light-sensitive material. In cases where the conductive metal oxide is in a needle or fibrous form, the length is preferably not more than 30 $\mu$m at a diameter of 1 $\mu$m, and more preferably the length is not more than 10 $\mu$m and diameter is not more than 0.3 $\mu$m, which the ratio of length/diameter is not less than 3. Further, $SnO_2$ is available from Ishihara Sangyo Kaisha, Ltd. under the designation of SNS10M, SN-100P, SN-100D and FSS10M.

The photothermographic material of the invention comprises at least one light-sensitive layer on the support, and further thereon, preferably having a light-insensitive layer. For example, a protective layer is provided on the light-sensitive layer to protect the image forming layer. On the opposite side of the support to the light-sensitive layer, a back coating layer is preferably provided to prevent adhesion to the surfaces of the materials each other or to rolls of a thermal development device. Binders used in the protective layer or back coating layer are preferably selected from polymers which have a glass transition point higher than that of the image forming layer and are hard to cause abrasion or deformation, such as cellulose acetate and cellulose acetate-butylate.

To adjust contrast, two or more image forming layers may be provided on one side of the support, or one or more layers may be provided on both sides of the support.

It is preferred to form a filter layer on the same side as or on the opposite side to the image forming layer or to allow a dye or pigment to be contained in the image forming layer to control the amount of wavelength distribution of light transmitted through the image forming layer of photothermographic materials relating to the invention.

Commonly known compounds having absorptions in various wavelength regions can used as a dye, in response to spectral sensitivity of the photothermographic material.

In cases where the photothermographic material relating to the invention are applied as a image recording material using infrared light is preferred the use of squarilium dye containing a thiopyrylium nucleus (also called as thiopyrylium squarilium dye), squarilium dye containing a pyrylium nucleus (also called as pyrylium squarilium dye), thiopyrylium chroconium dye similar to squarilium dye or pyrylium chroconium.

The compound containing a squarilium nucleus is a compound having a 1-cyclobutene-2-hydroxy-4one in the molecular structure and the compound containing chroconium nucleus is a compound having a 1-cyclopentene-2-hydroxy,4,5-dione in the molecular structure, in which the hydroxy group may be dissociated. Hereinafter, these dyes are collectively called as squarilium dye. Further, the compounds described in JP-A 8-201959 are also preferably usable as dyes.

Materials used in respective constituent layers are dissolved or dispersed in solvents to prepare coating solutions, and the plural coating solutions are simultaneously coated on the support and further subjected to a heating treatment to form a photothermographic material. Thus, coating solutions for respective constituent layers (for example, light-sensitive layer, protective layer) and coating and drying are not repeated for respective layers but plural layers are simultaneously coated and dried to form respective constituent layers. The upper layer is provided before the remaining amount of total solvents in the lower layer reaches 70% or less.

Methods for simultaneously coating plural constituent layers are not specifically limited and commonly known methods, such as a bar coating method, curtain coating method, dip coating method, air-knife method, hopper coating method and extrusion coating method are applicable. Of these, extrusion coating, that is, a pre-measuring type coating is preferred. Said extrusion coating is suitable for accurate coating or organic solvent coating since no evaporation occur on the slide surface, as in a slide coating system. This coating method is applicable not only to the light-sensitive layer side but also to the case when simultaneously coating a backing layer with a sublayer. Regarding the methods for simultaneous multilayer coating of photothermographic materials, methodes are detailed in JP-A 2000-15173.

The optimal silver coverage amount in this invention is preferably determined in accordance with the intended use of the photothermographic material. In cases when it is intended to form a medical use image, silver coverage is preferably 0.3 to 1.5 g/m$^2$, and is more preferably 0.5 to 1.5 g/m$^2$. The silver coverage due to from silver halide is preferably 2 to 18% of the total silver coverage, and is more preferably 5 to 15%.

The coated density of silver halide grains of more than 0.01 $\mu$m (circular equivalent converted grain diameter) is preferably $1\times10^{14}$ to $1\times10^{18}$/m$^2$ by number, and is more preferably $1\times10^{15}$ to $1\times10^{17}$/m$^2$ by number.

Further, the coated density of the foregoing light-insensitive silver salt of a long chained aliphatic carboxylic acid is preferably $1\times10^{-17}$ to $1\times10^{-15}$ g per silver halide grain of more than 0.001 $\mu$m (circular equivalent converted grain diameter), and is more preferably $1\times10^{-16}$ to $1\times10^{-14}$ g.

In cases where the photothermographic material is coated within the above range of conditions, the preferable results are obtained in view of optical maximum density per a certain silver coverage i.e., covering power, and silver image color tone.

It is preferred that when subjected to thermal development, the photothermographic material contains an organic solvent of 5 to 1,000 mg/m$^2$. The organic solvent content is more preferably 100 to 500 mg/m$^2$. The solvent content within the range described above leads to a thermally developable photosensitive material with high sensitivity, low fog density as well as maximum density.

Examples of solvents include ketones such as acetone, methyl ethyl ketone, isophorone; alcohols such as methyl alcohol, ethyl alcohol, and i-propyl alcohol, cyclohexanol, and benzyl alcohol; glycols such as ethylene glycol, diethylene glycol, triethylene glycol, propylene glycol and hexylene glycol; ether alcohols such as ethylene glycol monomethyl ether, and diethylene glycol monoethyl ether; ethers such as and i-propyl ether; esters such as ethyl acetate, butyl acetate; chlorides such as methylene chloride and dichlorobenzene; and hydrocarbons. Other than those, water, formaldehyde, dimethylformaldehyde, nitromethane, pyridine, toluidine, tetrahydrofuran and acetic acid are included. The solvents are not to be construed as limiting these examples. These solvents may be used alone or in combination.

The solvent content in the photothermographic material can be adjusted by varying conditions such as temperature conditions at the drying stage, following the coating stage. The solvent content can be determined by means of gas chromatography under conditions suitable for detecting the solvent.

In cases when the photothermographic material of the invention is stored, the material is preferably housed in a container to prevent density changes and fogging during the storage period. The air space ratio in the container is preferably 0.01 to 10%, and more preferably 0.02 to 5%. Also, the container is preferably filled with a nitrogen gas to exhibit a charged gas pressure of not less than 80%, and more preferably is not less than 90%.

Photothermographic materials of this invention are usually employed using a laser to record images. Exposure of the photothermographic materials desirably uses a light source suitable for the spectral sensitivity of the specific photothermographic materials. An infrared-sensitive photothermographic material, for example, is applicable to any light source in the infrared light region but the use of an infrared semiconductor laser (780 nm, 820 nm) is preferred in terms of being relatively high power and making it possible to provide a transparent photothermographic material.

In the invention, exposure is preferably conducted by using laser scanning exposure and various methods are applicable to its exposure. One of the preferred embodiments is the use of a laser scanning exposure apparatus, in which scanning laser light is not exposed at an angle substantially vertical to the exposed surface of the photothermographic material.

The expression "laser light is not exposed at an angle substantially vertical to the exposed surface" means that laser light is exposed preferably at an angle of 55 to 88°, more preferably 60 to 86°, still more preferably 65 to 84°, and optimally 70 to 82°.

When the photothermographic material is scanned with laser light, the beam spot diameter on the surface of the photosensitive material is preferably not more than 200 $\mu$m, and more preferably not more than 100 $\mu$m. Thus, the smaller spot diameter preferably reduces the angle displaced from verticality of the laser incident angle. The lower limit of the beam spot diameter is 10 $\mu$m. The thus configured laser scanning exposure can reduce deterioration in image quality due to reflected light, such as occurrence of interference fringe-like unevenness.

In the second preferred embodiment of the invention, exposure applicable in the invention is conducted preferably using a laser scanning exposure apparatus producing longitudinally multiple scanning laser light, whereby deterioration in image quality such as occurrence of interference fringe-like unevenness is reduced, as compared to scanning laser light with longitudinally single mode.

Longitudinal multiplication can be achieved by a technique of employing backing light with composing waves or a technique of high frequency overlapping. The expression "longitudinally multiple" means that the exposure wavelength is not a single wavelength. The exposure wavelength distribution is usually not less than 5 nm and preferably not less than 10 nm. The upper limit of the exposure wavelength distribution is not specifically limited but is usually about 60 nm.

In the third preferred embodiment of the invention, it is preferred to form images by scanning exposure using at least two laser beams.

The image recording method using such plural laser beams is a technique used in image-writing means of a laser printer or a digital copying machine for writing images with plural lines in a single scanning to meet requirements for higher definition and higher speed, as described in JP-A 60-166916. This is a method in which laser light emitted from a light source unit is deflection-scanned with a polygon mirror and an image is formed on the photoreceptor through an f$\theta$ lens, and a laser scanning optical apparatus similar in principle to an laser imager.

In the image-writing means of laser printers and digital copying machines, image formation with laser light on the photoreceptor is conducted in such a manner that displacing one line from the image forming position of the first laser light, the second laser light forms an image from the desire of writing images with plural lines in a single scanning. Concretely, two laser light beams are close to each other at a spacing of an order of some ten $\mu$m in the sub-scanning direction on the image surface; and the pitch of the two beams in the sub-scanning direction is 63.5 μm at a printing density of 400 dpi and 42.3 μm at 600 dpi (in which the printing density is represented by "dpi", i.e., the number of dots per inch i.e. 2,54 cm). As is distinct from such a method of displacing one resolution in the sub-scanning direction, one feature of the invention is that at least two laser beams are converged on the exposed surface at different incident angles to form images. In this case, when exposed with N laser beams, the following requirement is preferably met: when the exposure energy of a single laser beam (of a wavelength of λ nm) is represented by E, writing with N laser beam preferably meets the following requirement:

$$0.9\times E \leqq En\times N \leqq 1.1\times E$$

in which E is the exposure energy of a laser beam of a wavelength of λ nm on the exposed surface when the laser beam is singly exposed, and N laser beams each are assumed to have an identical wavelength and an identical exposure energy (En). Thereby, the exposure energy on the exposed surface can be obtained and reflection of each laser light onto the image forming layer is reduced, minimizing occurrence of an interference fringe.

In the foregoing, plural laser beams having a single wavelength are employed but lasers having different wavelengths may also be employed. In such a case, the wavelengths preferably fall within the following range:

$$(\lambda-30)<\lambda_1, \lambda_2, \ldots \lambda_n<(\lambda+30)$$

In the first, second and third preferred embodiments of the image recording method of the invention, lasers for scanning exposure used in the invention include, for example, solid-state lasers such as ruby laser, YAG laser, and glass laser; gas lasers such as He—Ne laser, Ar laser, Kr ion laser, $CO_2$ laser, Co laser, He—Cd laser, $N_2$ laser and eximer laser; semiconductor lasers such as InGaP laser, AlGaAs laser, GaAsP laser, InGaAs laser, InAsP laser, $CdSnP_2$ laser, and GaSb laser; chemical lasers; and dye lasers. Of these, semiconductor lasers of wavelengths of 600 to 1200 nm are preferred in terms of maintenance and the size of the light source. When exposed onto the photothermographic material in the laser imager or laser image-setter, the beam spot diameter on the exposed surface is 5 to 75 μm as a minor axis diameter and 5 to 100 μm as a major axis diameter. The laser scanning speed is set optimally for each photothermographic material, according to its sensitivity at the laser oscillation wavelength and the laser power.

The thermal development aparatus of this invention is comprised of components of a film supplying section such as a film tray, a laser image recording section, a thermo-development section supplying uniform and stable heat to the whole surface area of the material, and a conveying section from the film supplying section to the film ejecting section for the thermo-developed material, via the laser recording section. An example of an embodiment of a thermal development apparatus is illustrated in FIG. 1.

Thermal development apparatus 100 is provided with feeding section 110, which feeds photothermographic material (hereinafter referred to also as a photothermographic element or simply film) sheet by sheet, exposure section 120 exposing fed film F, developing section 130 developing the exposed film, cooling section 150 to stop development, and a stacking section, and further, paired feeding rollers 140 to supply film F from the feeding section, paired conveyance rollers 144 to transport the film to a developing section, and multiple paired conveyance rollers 141, 142, 143 and 145 to transport film F smoothly between said sections. A thermo-development section consists of heated drum 1 providing multiple opposed rollers 2 which keep film F in contact with the drum's outer surface as a means of thermo-development and separator claw 6 to separate film F from the drum and feed it to the cooling section.

The transfer speed of the photothermographic material is preferably within the range of 20 to 200 mm/sec.

The developing conditions for photographic materials are variable, depending on the instruments or apparatuses used, or the applied means and typically accompany heating the imagewise exposed photothermographic material at an optimal high temperature. Latent images formed upon exposure are developed by heating the photothermographic material at an intermediate high temperature (ca. 80 to 200° C., and preferably 100 to 200° C.) over a period of ample time (generally, ca. 1 sec. to ca. 2 min.).

Sufficiently high image densities cannot be obtained at a temperature lower than 80° C. in a short period and at a temperature higher than 200° C., the binder melts and is transferred onto the rollers, adversely affecting not only images but also transportability or the thermal processor caused upon heating to form silver images. The reaction process proceeds without supplying any processing solution such as water from the exterior.

Heating instruments, apparatuses and means include typical heating means such as a hot plate, hot iron, hot roller or a heat generator employing carbon or white titanium. In the case of a photothermographic material provided with a protective layer, it is preferred to thermally process while bringing the protective layer side into contact with a heating means, in terms of homogeneous-heating, heat efficiency and working property. It is also preferred to conduct thermal processing while transporting, while bringing the protective layer side into contact with a heated roller.

EXAMPLES

The present invention will be further described based on examples but embodiments of the invention are by no means limited to these examples. Incidentally, "%" in the examples is weght %, unless otherwise noted.

Example 1

Preparation of Sublayered Photographic Support

On one side of blue-tinted polyethylene terephthalate film having a thickness of 175 μm and exhibiting a density of 0.170 (measured with densitometer PDA-65, manufactured by Konica Corp.) which was previously subjected to a corona discharge treatment at 8 $W/m^2$·min. sublayer A-1 was coated using following sublayer coating solution a-1 so as to have a dry layer thickness of 0.8 μm. To the other side of the film, sublayer B-1 was coated using sublayer coating solutions b-1 described below so as to have dry layer thickness of 0.8 μm. Thereafter, a heating treatment was conducted at 130° C.

Blue dye

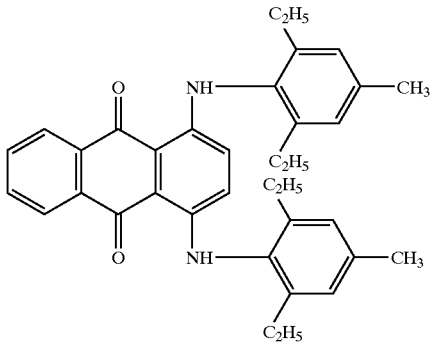

| Sublayer Coating Solution a-1 | |
|---|---|
| Copolymer latex solution (30% solid) of the followings | 270 g |
| Butyl acrylate (30 wt %) | |
| t-Butyl acrylate (20 wt %) | |
| Styrene (25 wt %) | |
| 2-Hydroxyethyl acrylate (25 wt %) | |
| (C-1) | 0.6 g |
| Hexamethylene-1,6-bis (thiourea) | 0.8 g |
| Water to make | 1 liter |

| Sublayer Coating Solution b-1 | |
|---|---|
| Copolymer latex solution (30% solid) of the followings | 270 g |
| Butyl acrylate (40 wt %) | |
| Stylene (20 wt %) | |
| Glycidyl acrylate 40 wt %) | |
| (C-1) | 0.6 g |
| Hexamethylene-1,6-bis (thiourea) | 0.8 g |
| Water to make | 1 liter |

Thereafter, the outer surfaces of sublayer A-1 and sublayer B-1 were subjected to a corona discharge treatment at 8 W/m2·min., and then, sublayer upperlayer coating solution a-2 was coated onto sublayer A-1 so as to have dry layer thickness of 0.1 μm and the layer was designated subbing upperlayer A-2. Sublayer upperlayer coating solution b-2 was coated onto sublayer upperlayer B-1 so as to have dry layer thickness of 0.4 μm as sublayer upperlayer B-2, having an antistatic function.

| Preparation of Sublayer Upperlayer Coating Solution a-2 | |
|---|---|
| Gelatin | weight of 0.4 g/m$^2$ |
| (C-1) | 0.2 g |
| (C-2) | 0.2 g |
| (C-3) | 0.1 g |
| Silica particle (average particle diameter 3 μm) | 0.1 g |
| Water to make | 1 liter |

| Preparation of Sublayer Upperlayer Coating Solution b-2 | |
|---|---|
| $SnO_2$ doped by Sb (SNS10M, available from Ishihara Sangyo Kaisha, Ltd.) | 60 g |
| Latex solution (20% Solid) comprised (C-4)) | 80 g |
| Ammonium sulfate | 0.5 g |
| (C-5) | 12 g |
| Polyethylene glycol (weight average molecular weight 600) | 6 g |
| Water to make | 1 liter |

-continued (C-1)

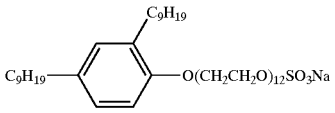

(C-2)

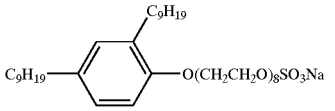

(C-3)

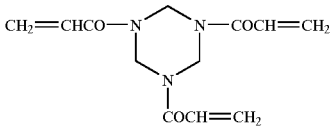

(C-4)

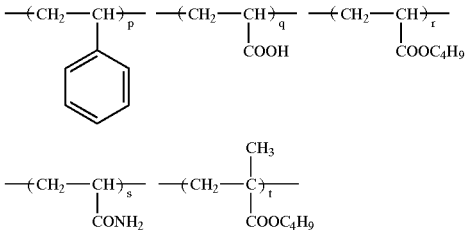

p:q:r:s:t = 40:5:10:5:40 (weught ratio)

(C-5)

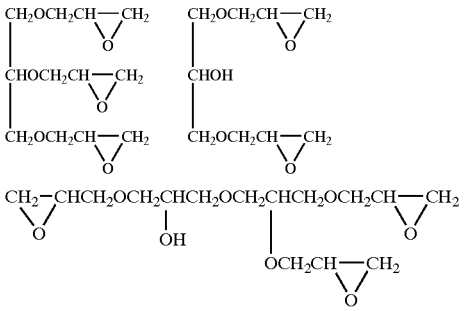

Mixture of the above 3 compounds

Preparation of Backcoat Layer Coating Solution 84.2 g of cellulose acetate butyrate (CAB381-20, available from Eastman Chemical Co.) and 4.5 g of polyester resin (Vitel PE2200B, available from Bostic Corp.) were dissolved in 830 g of methyl ethyl ketone (MEK) while stirring. Then, 0.30 g of infrared dye 1 was added to the resulting solution, and further, 4.5 g of fluorinated surfactant (Surfron KH40, available from Asahi Glass Co., Ltd.) and 2.3 g of fluorinated surfactant (Megafag F120K, available from Dainippon Ink Co., Ltd.) dissolved in 43.2 g of methanol were added with sufficient stirring until dissolved. To the resulting solution, 75 g of silica particles (SILOID 64×6000, available from W. R. Grace Corp.), which were previously dispersed using a dizolva type homogenizer in 1 wt % of methyl ethyl ketone were added and stirred to prepare a backcoat layer coating solution.

Infrared Dye 1

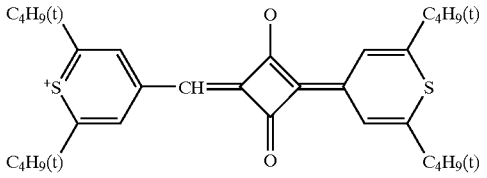

| Preparation of Backcoat Layer Protective Layer (Surface Protective Layer) Coating Solution | |
|---|---|
| Cellulose acetate butyrate (10% MEK solution) | 15 g |
| Monodispersed silica, 15% of degree of monodispersion (average particle diameter: 8 μm) (surface-treated with aluninum of 1 wt% based on the total silica weight) | 0.03 g |
| $C_8F_{17}(CH_2CH_2O)_{12}C_8F_{17}$ | 0.05 g |
| $C_9F_{17}$—$C_6H_4$—$SO_3Na$ | 0.01 g |
| Stearic acid | 0.1 g |
| Oleyl olate | 0.1 g |
| α-Alumina (Mors' scale hardness of 9) | 0.1 g |
| Preparation of Light-sensitive Silver Halide Emulsion A | |
| (A1) | |
| Phenylcarbamoyl gelatin | 88.3 g |
| Compound (A) (10% methanol aqueous solution) | 10 ml |
| Potassium bromide | 0.32 g |
| Water to make | 5429 ml |
| (B1) | |
| 0.67 mol/l Silver nitrate solution | 2635 ml |
| (C1) | |
| Potassium bromide | 51.55 g |
| Potassium iodide | 1.47 g |
| Water to make | 660 ml |
| (D1) | |
| Potassium bromide | 154.9 g |
| Potassium iodide | 4.41 g |
| Iridium chloride (1% solution) | 0.93 ml |
| Water to make | 1982 ml |
| (E1) | |
| 0.4 mol/l Potassium bromide aqueous solution | Amount necessary to adjust silver potential |
| (F1) | |
| Potassium hydroxide | 0.71 g |
| Water to make | 20 ml |
| (G1) | |
| Aqueous 56% acetic acid solution | 18.0 ml |
| (H1) | |
| Anhydrous sodium carbonate | 1.72 g |
| Water to make | 151 ml |

Compound (A): $HO(CH_2CH_2O)_n(CH(CH_3)CH_2O)_{17}$—$CH_2CH_2O)_mH$ (m + n = 5 to 7)

Using a stirring mixer described in JP-B Nos. 58-58288 and 58-58289, ¼ of solution B1, and the total amount of solution C1 were added to solution A1 by double jet addition for 4 min 45 sec. to form nucleus grains, while maintaining a temperature of 30° C. and a pAg of 8.09. After 1 min., the total amount of solution F1 was added thereto, while the pAg was properly adjusted using solution E1. After 6 min, ¾ of solution B1 and the total amount of solution D1 were further added by double jet addition for 14 min 15 sec., while maintaining a temperature of 30° C. and a pAg of 8.09. After stirring for 5 min., the reaction mixture was raised to 40° C. and solution G1 was added thereto to coagulate the resulting silver halide emulsion. Of the remaining 2,000 ml of precipitates, the supernatant was removed and after adding 10 lit. of water while stirring, the silver halide emulsion was again coagulated. Of the remaining 1,500 ml of precipitates, the supernatant was removed and after adding 10 lit. of water while stirring, the silver halide emulsion was again coagulated. Of the remaining 1,500 ml of precipitates, the supernatant was removed and solution H1 was added. The temperature was raised to 60° C. and stirring continued for 120 min. Finally, the pH was adjusted to 5.8 and water was added thereto so that the weight per mol of silver was 1161 g, and light-sensitive silver halide emulsion A was thus produced.

It was proved that the resulting emulsion was comprised of monodispersed silver iodobromide cubic grains having an average grain size of 25 nm, a coefficient of variation of grain size of 12% and a [100] face ratio of 92%.

Preparation of Light-sensitive Silver Halide Emulsion B

Light-sensitive silver halide emulsion B was prepared in the same manner as preparing light-sensitive silver halide emulsion A except for changing the additing temperature of the double jet addition from 20° C. to 40° C. It was proved that the resulting emulsion was comprised of monodispersed silver iodobromide cubic grains having an average grain size of 50 nm, a coefficient of variation of grain size of 12% and a [100] face ratio of 92%.

Preparation of Powdery Organic Silver Salt A 130.8 g of behenic acid, 67.7 g of arachidic acid, 43.6 g of stearic acid and 2.3 g of palmitic acid were dissolved in 4720 ml of 80° C. water. Then, 540.2 ml of aqueous 1.5 mol/l sodium hydroxide was added, and after further adding 6.9 ml of concentrated nitric acid, the mixture was cooled to 55° C. to obtain a fatty acid sodium salt solution. To the thus obtained fatty acid sodium salt solution, 36.2 g of light-sensitive silver halide emulsion A and 9.1 g of light-sensitive silver halide emulsion B, obtained above, and 450 ml of water were added and stirred for 5 min., while maintained at 55° C.

Subsequently, 702.6 ml of 1 mol/l aqueous silver nitrate solution was added over 2 min. and stirring continued for a further 10 min. to a obtain powdery organic silver salt dispersion, and removing aqueous soluble salts. Thereafter, obtained aliphatic carboxylic acid silver salt dispersion was transferred to a washing vessel, and then, washing with deionized water and filtration were repeated until the filtrate reached a conductivity of 2 μS/cm. After being subjected to centrifugal dehydration, using a flush jet dryer (produced by Seishin Kigyo Co., Ltd.), the thus obtained cake-like organic silver salt was dried under an atmosphere of nitrogen gas, according to the operation condition of a hot air temperature at the inlet of the dryer until reaching a moisture content of 0.1% to obtain dried powdery organic acid silver salt A at an average grain size (circular equivalent grain size) of 0.08 μm, an aspect ratio of 5, a degree of monodispersion of 10%.

The moisture content was measured by an infrared ray aquameter.

Preparation of Pre-dispersion A

As a binder of an image forming layer, 14.57 g of polyvinyl butyral containing —$SO_3K$ groups (Tg 75° C., containing —$SO_3K$ 0.2 m mil. mol/g) was dissolved in 1457 g methyl ethyl ketone and further thereto gradually added were 500 g of powdery organic silver salt A to obtain pre-dispersion A, while stirring by a dissolver type homogenizer (DISPERMAT Type CA-40M, available from VMA-GETZMANN).

Preparation of Light-sensitive Emulsion Dispersion 1

Thereafter, using a pump, pre-dispersion A was transferred to a media type dispersion machine (DISPERMAT Type SL-C12 EX, available from VMA-GETZMANN), which was packed to 80% capacity with 0.5 mm Zirconia beads (TORAY-SELAM, available from Toray Co. Ltd.), and dispersed at a circumferential speed of 8 m/s, for 1.5 min. with a mill to obtain light-sensitive emulsion 1.

Preparation of Stabilizer Solution

In 4.97 g methanol were dissolved 1.0 g of Stabilizer 1 and 0.31 g of potassium acetate to obtain a stabilizer solution.

Preparation of Infrared Sensitizing Dye Solution A

In 31.3 ml MEK were dissolved 19.2 mg of infrared sensitizing dye, 1.488 g of 2-chlorobenzoic acid, 2.779 g of Stabilizer 2 and 365 mg of 5-methyl-2-mercaptobenzimidazole in a darkroom to obtain an infrared sensitizing dye solution A.

Preparation of Additive Solution a

In 110 g MEK were dissolved the reducing agent (the compound and the amount were described in Table 1), 1.54 g of 4-methylphthalic acid and 0.48 g of the infrared dye-1 to obtain additive solution a.

Preparation of Additive Solution b

In 40.9 g MEK were dissolved 1.56 g of Antifoggant-2 and 3.43 g of phthalazine to obtain additive solution b.

Preparation of Additive Solution c 0.5 g of vinyl compound of silver-saving agent, represented by formula [G], was dissolved in 39.5 g MEK to obtain additive solution c.

Stabilizer-1

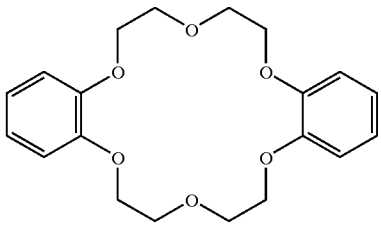

Stabilizer-2

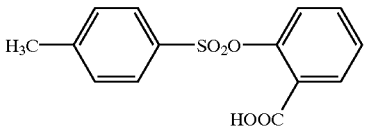

Antifoggant-2

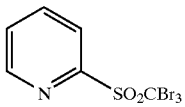

Infrared Sensitizing Dye

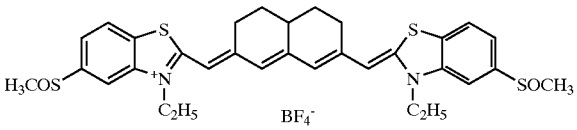

Preparation of Image Forming Layer Coating Solution

Under an inert gas atmosphere (97% nitrogen), 50 g of the light-sensitive emulsion dispersion 1 and 15.11 g MEK were maintained at 21° C. while stirring, 1000 μl of chemical sensitizer S-5 (0.5% methanol solution) was added thereto and after 2 min., 390 μl of antifoggant-1 (10% methanol solution) was added and stirred for 1 hr. Further thereto, 494 μl of calcium bromide (10% methanol solution) was added and after stirring for 10 min., gold sensitizer Au-5 of 1/20 equimolar amount of the chemical sensitizer was added and stirred for another 20 min. Subsequently, 167 ml of the stabilizer solution was added and after stirring for 10 min., 1.32 g of infrared sensitizing dye solution A was added and stirred for an additional hour. Then, the mixture was cooled to 13° C. and stirred for yet another 30 min. Further thereto, 13.31 g of the binder used in pre-dispersion A was added and stirred for 30 min, while maintaining 13° C., and 1.084 g of tetrachlorophthalic acid (9.4 wt % MEK solution) and stirred for 15 min. Then, 12.43 g of additive solution a, 1.6 ml of 10% MEK solution of Desmodur N3300 (aliphatic isocyanate, product by Movey Co.) and 4.27 g of additive solution b and 4.0 g of additive solution c were successively added with stirring to obtain the image forming layer coating solution.

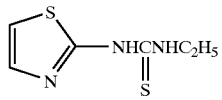

Chemical sensitizer S-5

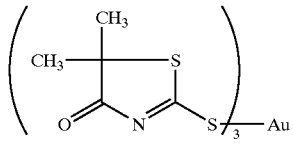

Au-5

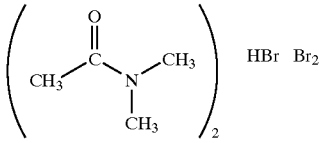

Antifoggant-1

| Preparation of Image Forming Layer Protective Layer Lower Layer (Surface Protective Layer Lower Layer) | |
|---|---|
| Acetone | 5 g |
| Methyl ethyl ketone | 21 g |
| Cellulose acetate butyrate | 2.3 g |
| Methanol | 7 g |
| Phthalazine | 0.25 g |
| Monodispersed silica (degree of monodispersion 15%) (average grain size: 3 μm) (surface treated by aluminum of 1 wt % of the total silica) | 0.140 g |
| $CH_2{=}CHSO_2CH_2CH_2OCH_2CH_2SO_2CH{=}CH_2$ | 0.035 g |
| $C_{12}F_{25}(CH_2CH_2O)_{10}C_{12}F_{25}$ | 0.01 g |
| $C_8F_{17}{-}C_6H_4{-}SO_3Na$ | 0.01 g |
| Stearic acid | 0.1 g |
| Butyl stearate | 0.1 g |
| α-alumina (Mohs' hardness 9) | 0.1 g |
| **Preparation of Image Forming Layer Protective Layer Upper Layer (Surface Protective Layer Upper Layer)** | |
| Acetone | 5 g |
| Methyl ethyl ketone | 21 g |
| Cellulose acetate butyrate | 2.3 g |
| Methanol | 7 g |
| Phthalazine | 0.25 g |
| Monodispersed silica (degree of monodispersion 15%) (average grain size: 3 μm) (surface-treated with aluminum of 1 wt % of the total silica) | 0.140 g |
| $CH_2{=}CHSO_2CH_2CH_2OCH_2CH_2SO_2CH{=}CH_2$ | 0.035 g |
| $C_{12}F_{25}(CH_2CH_2O)_{10}C_{12}F_{25}$ | 0.01 g |
| $C8F_{17}{-}C_6H_4{-}SO_3Na$ | 0.01 g |
| Stearic acid | 0.1 g |
| Butyl stearate | 0.1 g |
| α-alumina (Mohs' hardness 9) | 0.1 g |

Preparation of Thermo Developable Light-sensitive Material

The thus prepared back-coat layer coating solution and back-coat layer protective layer coating solution were simultaneously applied onto sublayer upperlayer B-2, using an extrusion type coater at a coating speed of 50 m/min. to form each dry layer at a thickness of 3.5 μm. Further, drying was conducted at a dry bulb temperature of 100° C. and a dew point of 10° C. for a period of 5 min.

The foregoing image forming layer coating solution and the image forming layer surface protective layer (surface protective layer) coating solution were simultaneously applied onto subbing upper layer A-2, using an extrusion type coater at a coating speed of 50 m/min. to obtain light-sensitive sample Nos. 1 through 6 and 10 through 15 (here, light-sensitive sample No. 15 was the same as No. 1) as shown in Table 1. Coating was conducted so that the silver coverage of the image forming layer was 1.2 g/m$^2$ and the dry layer thickness of the image forming layer protective layer (surface protective layer) was 2.5 μm (surface protective layer upper layer 1.3 μm, surface protective layer lower layer 1.2 μm). Drying of those layers was conducted at a dry bulb temperature of 75° C. and a dew point of 10° C. for a period of 10 min.

Example 2

Preparation of Organic Silver Salt Dispersion

In 850 ml of water were dissolved 7 g of stearic acid, 4 g of arachidic acid and 36 g of behenic acid at 90° C. with vigorous stirring. Then, after adding 187 ml of 1 mol/l aqueous NaOH solution while stirring for 120 min. and further adding 71 ml of 1 mol/l nitric acid, the solution was cooled to a temperature of 50° C. Subsequently, with additional vigorous stirring, 125 ml of the solution of 21 g silver nitrate was added over 100 sec., and the solution was set aside for 20 min. Thereafter, the reaction mixture was filtered by suction filtration. The filtrated solid content was washed until the filtrate reached a conductivity of 30 μS/cm. Added was 100 g of 10 wt % aqueous solution of PVA205 (polyvinyl alcohol, available from Kuraray Co., Ltd.), and water was added for a total weight of 270 g, and then, coarsely dispersed by using an automated mortar to obtain an organic silver salt coarse dispersion.

The obtained organic silver salt coarse dispersion was dispersed using Nanomizer (manufactured by Nanomizer Corp.) with a collision pressure of 98.07 MPa to obtain an organic silver salt dispersion. It was proved that the organic silver salt grains contained in said obtained organic silver salt dispersion were comprised of needle grains having an average minor axis of 0.04 μm, an average major axis of 0.8 μm, and a coefficient of variation of grain size of 30%.

Preparation of Reducing Agent Dispersion

The reducing agent (compounds and the amounts as described in Table 1) and 50 g of hydroxypropyl cellulose were added to 850 g of water and mixed well to obtain a slurry. The slurry was transfered to a vessel with 840 g of zirconia beads having an average diameter of 0.5 mm, and dispersed with a homogenizer (¼G Sandgrinder Mill, manufactured by Aimex Co., Ltd.) over 5 hrs. to obtain a reducing agent dispersion.

Preparation of Silver-saving Agent Dispersion 940 g of water was added to 50 g of vinyl compound A1 represented by formula (G) and 10 g of hydroxypropyl cellulose and mixed well to result in a slurry. The slurry was transferred to a vessel with 840 g of zirconia beads having an average diameter of 0.5 mm, and dispersed with a homogenizer (¼G Sandgrinder Mill, manufactured by Aimex Co., Ltd.) over 5 hrs. to obtain a reducing agent dispersion.

Preparation of Organic Polyhalide Dispersion 940 g of water was added to 50 g of tribromomethylphenylsulfone and 10 g of hydroxypropyl cellurose and mixed well to result in a slurry. The slurry was transferred to a vessel with 840 g of zirconia beads having an average diameter of 0.5 mm, and dispersed with a homogenizer (¼G Sandgrinder Mill, manufactured by Aimex Co., Ltd.) over 5 hrs. to obtain an organic polyhalide dispersion.

Preparation of Light-sensitive Silver Halide Emulsion 1

22 g of phthalated gelatin and 30 mg of potassium bromide were dissolved in 1,000 ml of water at 35° C., and after pH was adjusted to 5.0, mixed together were 159 ml of aqueous solution containing 18.6 g of silver nitrate and 0.9 g of ammonium nitrate, and 159 ml of aqueous solution containing potassium bromide and potassium iodide in a mol ratio of 98:2 under controlled addition over 10 min. maintaining pAg 7.7. Then, added were 476 ml of aqueous solution containing 55.4 g of silver nitrate and 2 g of ammonium nitrate and aqueous solution containing dipotassium iridium hexachloride 10 μmol/l and potassium bromide 1 mol/l with a controlled double jet addition over 10 min. maintaining pAg 7.7. Thereafter, 1 g of 4-hydroxy-6-methyl-1,3,3a,7-tetrazainden was added thereto, and further, pH was lowered and the mixture was coagulated, precipitated, and desalted. Then, 0.1 g of phenoxyethanol was added, and the pH and pAg were adjusted to 5.9 and 8.2, respectively, to complete the preparation of silver iodobromide grains (cubic grains with an iodine core content of 8 mol %, at an average of 2%, an average diameter of 25 nm, a coefficient of variation of projected area of 8%, and a (100) face ratio of 85%).

After the temperature of the obtained silver halide grains was raised to 60° C., 85 μmol of sodium thiosulfate, 11 μmol of 2,3,4,5,6-pentafluorophenyldiphenylphosphinselenide, 15 μmol of telluric compound, 3 μmol of chloroaurate acid, and 270 μmol of thiocyanic acid per mol of silver were added over 120 min., and then, cooled quickly to 40° C. 100 μmol of the sensitizing dye was added while stirring for 30 min., and cooled quickly to 30° C. to obtain light-sensitive silver halide emulsion 1. The above 30° C. was regarded as the preparation temperature of light-sensitive silver halide emulsion 1.

Sensitizing dye

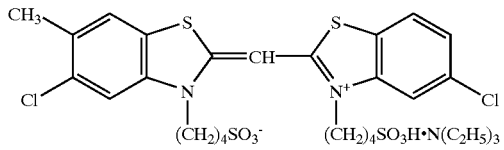

Telluric compound

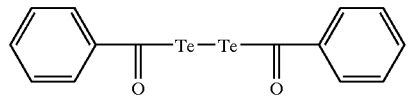

Preparation of Light-sensitive Silver Halide Emulsion 2

Light-sensitive silver halide emulsion 2 was prepared in the same manner as light-sensitive silver halide emulsion 1 except that each additing time of the controlled double jet addition was changed to 25 min. from 10 min. The obtained silver iodobromide grains were cubic grains with an iodine core content of 8 mol %, at an average of 2 mol %, an average grain diameter of 50 nm, a coefficient of variation of projected area of 8%, and a (100) face ratio of 85%.

Preparation of Light-sensitive Silver Halide Emulsion 3

Light-sensitive silver halide emulsion 3 was prepared by mixing of light-sensitive silver halide emulsions 1 and 2 at a ratio of 3:1 by weight.

Preparation of Image Forming Layer Coating Solution 350 g of organic silver salt dispersion 1, 140 ml of 20 wt % aqueous solution of PVA205, 37 ml of 10 wt % aqueous solution of phthalazine, 220 g of the reducing agent dispersion, 50 g of the silver-saving dispersion, and 61 g of the above organic polyhalide dispersion were mixed, and then, 275 g of solid of LACSTAR3307B (SBR latex containing a main copolymerization content of styrene and butadiene, 0.1 to 0.15 μm of the average particle diameter of dispersed particles, 0.6 wt % of equilibrium moisture content under the condition of 25° C. and 60% RH) was added, and thereafter, 120 g of the above light-sensitive silver halide emulsion 3 was mixed to prepare the image forming layer coating solution, while the solution was adjusted to pH 5.0 by using 11 mol/l sulfuric acid.

| Preparation of Image Forming Layer Protective Layer Lower Layer (Surface Protective Layer Lower Layer) Coating Solution | | |
|---|---|---|
| Water | | 26 g |
| Acrylic resin containing —$SO_3Na$ (acrylic resin of benzyl methacrylate/4-hydroxyphenyl methacrylamide/3-cyanophenyl methacrylamide = 3/4/3 (weight ratio): Tg = 90° C.) | as a solid | 2.3 g |
| Phthalazine | | 0.25 g |
| Monodispersed silica (degree of monodispersion 15%) (average particle diameter: 3 μm) (surface treated with aluminum of 1 wt % of the total silica) | | 0.140 g |
| $C_8F_{17}$—$C_6H_4$—$SO_3Na$ | | 0.02 g |
| Stearic acid | | 0.1 g |
| Butyl stearate | | 0.1 g |
| α-alumina (Mohs' hardness 9) | | 0.1 g |
| **Preparation of Image Forming Layer Protective Layer Upper Layer (Surface Protective Layer Upper Layer) Coating Solution** | | |
| Water | | 26 g |
| Acrylic resin containing —$SO_3Na$ (acrylic resin of benzyl methacrylate/4-hydroxyphenyl methacrylamide/3-cyanophenyl methacrylamide = 3/4/3 (weight ratio): Tg = 110° C.) | as a solid | 2.3 g |
| Phthalazine | | 0.25 g |
| Monodispersed silica (degree of monodispersion 15%) (average particle diameter: 3 μm) (surface treated with aluminum of 1 wt % of the total silica) | | 0.140 g |
| $C_8F_{17}$—$C_6H_4$—$SO_3Na$ | | 0.02 g |
| Stearic acid | | 0.1 g |
| Butyl stearate | | 0.1 g |
| α-alumina (Mohs' hardness 9) | | 0.1 g |

Preparation of Backcoat Layer Coating Solution 10 g of salt with a solid base of N,N',N",N'"-tetraethyl guanidine and 4-carboxymethylsulfonyl-phenylsulfon in a mol ratio of 1:2, was dispersed in 10 g of polyvinyl alcohol and 88 g of water with 1/16G Sand Grinder Mill (manufactured by Aimex Co., Ltd.) to obtain a base solution.

2.1 g of a basic dye precursor, 7.9 g of an acidic material, 0.1 g of antihalation dye-1 ($1.990\times10^{-4}$ mol), and 10 g of ethyl acetate were mixed and dissolved to make an organic solution, and further mixed with an aqueous solution of 10 g of polyvinyl alcohol and 80 g of water, and dispersed to an emulsion under room temperature to obtain a dye solution (average particle diameter 2.5 μm).

The obtained solutions of 39 g of the base solution, 26 g of the dye solution, and 36 g of polyvinyl alcohol aqueous solution of 10 wt %, were mixed to obtain a backcoat layer coating solution.

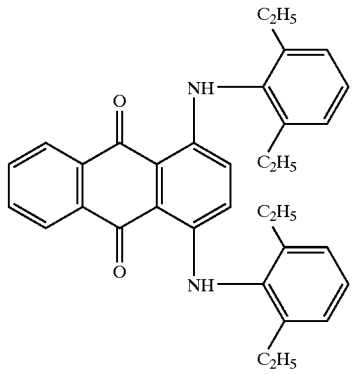

Antihalation dye-1

-continued

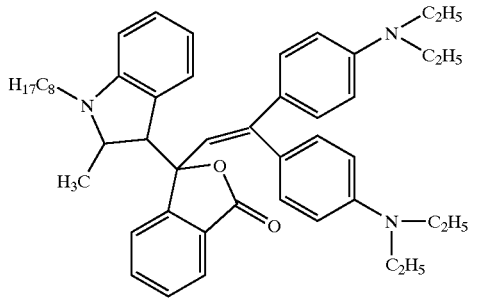

Basic dye precursor

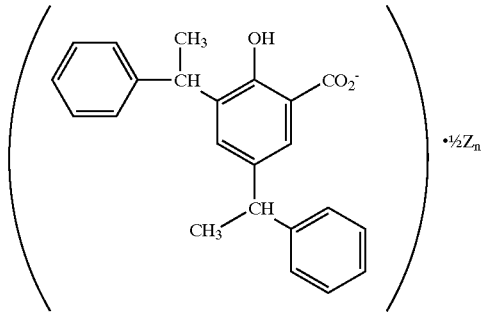

Acidic material

Preparation of Backcoat Layer Protective Layer (Surface Protective Layer) Coating Solution

| | |
|---|---|
| Cellulose acetate butyrate (10% methyl ethyl ketone solution) | 15 g |
| Monodispersed silica (degree of monodispersion 15%) (average particle diameter: 8 μm) (surface-treated with aluminum of 1 wt % of the total silica) | 0.030 g |
| $C_8F_{17}$ $(CH_2CH_2O)_{12}C_8F_{17}$ | 0.05 g |
| $C_9F_{17}$—$C_6H_4$—$SO_3Na$ | 0.01 g |
| Stearic acid | 0.1 g |
| Oleyl olate | 0.1 g |
| α-alumina (Mohs' hardness 9) | 0.1 g |

Preparation of Sub-coating Solution A 50 g of polystyrene fine particles (average particle diameter 0.2 μm) and 20 ml of surfactant A (1 wt %) were added to 200 ml of polyester copolymer dispersion Pesresin A-515GB (30%, available from TAKAMATSU OIL & FAT CO., LTD.), and water was added for 1,000 ml of obtain sub-coating solution A.

Surfactant A

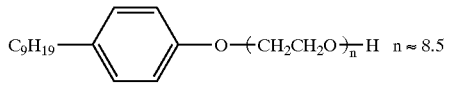

Preparation of Sub-coating Solution B

To 680 g of water, added were 200 ml of styrene-buthadiene copolymer aqueous dispersion (styrene/buthadiene/itaconic acid=47/50/3 (weight ratio), concentration 30 wt %) and 0.1 g of fine polystyrene particles (average particle diameter 2.5 μm), and water was further added to make 1,000 ml to obtain sub-coating solution B.

Preparation of Sub-coating Solution C 10 g of inert gelatin was dissolved in 500 ml of water, and 40 g of an aqueous dispersion (40 wt %) of tin oxide-antimony oxide complex as described in JP-A 61-20033 was added thereto, and further added was water to make 1,000 ml to obtain sub-coating solution C.

Preparation of Sub-coated Support

After a corona discharge treatment was applied onto one side (light-sensitive side) of the blue-tinted with a blue dye and biaxial oriented polyethylene terephthalate support having a thickness of 175 μm, which was used in Example 1, the above sub-coating solution A was coated using a bar coater so as to have a wet laydown of 5 ml/m$^2$, and drying was conducted at 180° C. over 5 min., for a dry thickness of ca. 0.3 μm. Thereafter, the opposite side (back side) was subjected to a corona discharge treatment, and the above sub-coating solution was coated thereon using a bar coater for a wet laydown of 5 ml/m$^2$, and a dry thickness of ca. 0.3 μm, and then, dried at 180° C. over 5 min. Further, the above sub-coating solution C was coated onto said opposite side using a bar coater for a wet laydown of 3 ml/m$^2$, and a dry thickness of ca. 0.03 μm, and then, dried at 180° C. over 5 min. to obtain a sub-coated support.

Preparation of Photothermographic Material

The backcoat layer coating solution was coated at a flow rate for an optical density of 0.8 at 810 nm, together with the coating of the backcoat layer protective layer coating solution for a wet laydown of 50 g/m2, onto the back side opposed to the image forming layer side (light-sensitive side) of the above sub-coated support, as a simultaneous multilayer coating using a coater similar to one as described in "LIQUID FILM COATING" page 427, FIG. 11*b*. 1, by Stephen F. Kistler and Peter M. Schweizer, published by CHAPMAN & amp; HALL Corp., 1997. Then, the image forming layer coating solution at a rate of 82 ml/m$^2$, and the image forming layer surface protective layer (surface protective layer upper layer atba rate of 20 ml/m$^2$, and surface protective layer lower layer at a rate of 20 ml/m$^2$) were coated simultaneously as a multilayer coating in said order from the support onto the opposite side to the back-side, at a coating speed of 160 m/min. After passing through a chilling zone of 10° C. (dew point below 0° C.), the coated material was forced air dried at 30° C., 40% RH and 20 m/sec., and further treated with heat at 60° C. for 1 min. to obtain light-sensitive material Nos. 7 through 9 as described in Table 1. Smoothness (Bekk smoothness measured by using an Ohken-type smoothness tester, described in Paper and Pulp Test Method No. 5 by J. TAPPI) of the thus obtained light-sensitive materials was 590 sec. on the image forming layer side and 80 sec. on the backcoat layer side.

Exposure and Developing Process

After the obtained photothermographic material Sample Nos. 1 through 15 were cut to strops of (14×2.54 cm)×(17×2.54 cm), the samples were processed using the following procedure.

The photothermographic material was pulled out from a film tray and transferred to a laser exposure section. All samples were subjected to laser scanning exposure from the emulsion side using an exposure apparatus having a light source of 810 nm semiconductor laser (maximum output was 70 mW with two composing waves, each with a maximum output of 35 mW) in a longitudinal multi-mode, which was made by means of high frequency overlapping. In this case, exposure was conducted at an angle of 75°, between the exposed surface and the exposing laser light. Subsequently, using an automatic processor provided with a heated drum, exposed samples were subjected to thermal development at 125° C. for 15 sec., while bringing the protective layer surface of the photothermographic material into contact with the drum surface. The transfer speed from the light-sensitive material feeding section to the image exposure section, and the transfer speed in the image exposure section, and transfer speed in the thermo-development section are shown in Table 1. Exposure and the thermal development were conducted in an atmosphere of 23° C. and 50% RH.

Image Density

The maximum density of the obtained image under the above condition was measured by a densitometer and designated as image density 1.

Silver Image Tone

Silver image tone was evaluated by visual checking of a processed chest X-ray image on a standard viewing box. Using Konica wet process type film for a laser imager as a standard sample, the relative color tone was evaluated by comparing it to the standard sample based on the following criteria in whole and half steps.

5: the same color tone as the standard sample

4: nearly equal and preferable color tone as the standard sample

3: slightly different color tone from the standard but no problem for practical use 2: apparently different color tone from the standard 1: distinctly different from the standard and unpleasant color tone Image Storage Stability Under Light Irradiation After the exposure and development of the obtained light-sensitive materials in the same manner as in the above process, the samples were pasted onto a viewing box of 1,000 lux and allowed to stand for 10 days. Variations of the samples were evaluated visually based on the following criteria in whole and half steps.

5: almost no changes

4: slight change in color tone was observed

3: partial changed color tone and increased fogging were observed

2: definite change in color tone and increased fogging were observed over wide areas 1: marked color tone change and increased fogging, and severe unevenness were observed over yhe whole area of the sample The results are shown in Table 1 and Table 2.

TABLE 2

| Sample No. | Image density | Silver color tone | Image storage stability under light irradiation | Remarks | |
|---|---|---|---|---|---|
| 1 | 4.1 | 4.0 | 4.0 | Example 1 | Inv. |
| 2 | 4.1 | 4.0 | 4.0 | Example 1 | Inv. |
| 3 | 4.2 | 5.0 | 5.0 | Example 1 | Inv. |
| 4 | 4.2 | 5.0 | 5.0 | Example 1 | Inv. |
| 5 | 4.2 | 5.0 | 5.0 | Example 1 | Inv. |
| 6 | 4.2 | 5.0 | 5.0 | Example 1 | Inv. |
| 7 | 4.1 | 4.0 | 4.0 | Example 2 | Inv. |
| 8 | 4.2 | 5.0 | 5.0 | Example 2 | Inv. |
| 9 | 4.2 | 5.0 | 5.0 | Example 2 | Inv. |
| 10 | 4.0 | 3.5 | 3.5 | Example 1 | Inv. |
| 11 | 4.1 | 3.5 | 3.5 | Example 1 | Inv. |
| 12 | 3.8 | 2.0 | 5.0 | Example 1 | Comp. |
| 13 | 4.1 | 1.0 | 5.0 | Example 1 | Comp. |
| 14 | 3.8 | 2.0 | 2.0 | Example 1 | Comp. |
| 15 | 3.7 | 4.0 | 4.0 | Example 1 | Comp. |

Inv.: Inventional sample
Comp.: Comparative sample

As is apparent from Table 1 and Table 2, it was proved that the photothermographic material of the present invention ia superior in high density, silver color tone and image storage stability under light irradiation compared well to comparative samples of the photothermographic material.

Example 3

Preparation of Photographic Support

On one side of blue-tinted polyethylene terephthalate film (having a thickness of 175 $\mu$m) exhibiting a density of 0.170 which was previously subjected to a corona discharge treatment at 0.5 kV·A·min/m$^2$, sublayer a was coated using the following sublayer coating solution A so as to have a dry layer thickness of 0.2 $\mu$m. After the other side of the film was also subjected to a corona discharge treatment at 0.5-

TABLE 1

| Sample No. | Reducing agent 1 (Compound) | Reducing agent 2 (Compound) | Reducing agent 1 (Weight) (g) | Reducing agent (Weight) (g) | *1 | *2 | *3 | Transfer speed (mm/sec) Image exposure section | Transfer speed (mm/sec) Thermo-development section | Remarks | |
|---|---|---|---|---|---|---|---|---|---|---|---|
| 1 | (1-6) | (1-18) | 4.20 | 23.78 | 15.0 | 15.0 | 40 | 40 | 40 | Example 1 | Inv. |
| 2 | (1-6) | (1-18) | 7.00 | 20.98 | 25.0 | 25.0 | 40 | 40 | 40 | Example 1 | Inv. |
| 3 | (1-10) | (1-18) | 4.20 | 23.78 | 15.0 | 15.0 | 40 | 40 | 40 | Example 1 | Inv. |
| 4 | (1-10) | (1-18) | 7.00 | 20.98 | 25.0 | 25.0 | 40 | 40 | 40 | Example 1 | Inv. |
| 5 | (1-10) | (1-35) | 4.20 | 23.78 | 15.0 | 15.0 | 40 | 40 | 40 | Example 1 | Inv. |
| 6 | (1-10) | (1-35) | 7.00 | 20.98 | 25.0 | 25.0 | 40 | 40 | 40 | Example 1 | Inv. |
| 7 | (1-6) | (1-18) | 15.00 | 85.00 | 15.0 | 15.0 | 40 | 40 | 40 | Example 2 | Inv. |
| 8 | (1-10) | (1-18) | 15.00 | 85.00 | 15.0 | 15.0 | 40 | 40 | 40 | Example 2 | Inv. |
| 9 | (1-10) | (1-35) | 15.00 | 85.00 | 15.0 | 15.0 | 40 | 40 | 40 | Example 2 | Inv. |
| 10 | (1-6) | (2*) | 4.20 | 23.78 | 15.0 | — | 40 | 40 | 40 | Example 1 | Inv. |
| 11 | (1-10) | (2*) | 4.20 | 23.78 | 15.0 | — | 40 | 40 | 40 | Example 1 | Inv. |
| 12 | (1-6) | (1-18) | 0.70 | 27.28 | 2.5 | 2.5 | 40 | 40 | 40 | Example 1 | Comp. |
| 13 | (1-6) | (1-18) | 13.99 | 13.99 | 50.0 | 50.0 | 40 | 40 | 40 | Example 1 | Comp. |
| 14 | (2*) | — | 27.98 | — | 0.0 | 0.0 | 40 | 40 | 40 | Example 1 | Comp. |
| 15 | (1-6) | (1-18) | 4.20 | 23.78 | 15.0 | 15.0 | 220 | 220 | 220 | Example 1 | Comp. |

Inv.: Inventional sample
Comp.: Comparative sample
2*: 1,1-bis(2-hydroxy-3,5-dimethylphenyl)-3,5,5- trimethylhexane
*1: Ratio (%) of the weight of reducing agent represented by Formula (A-1) based on the total weight of reducing agents comprised of bisphenol derivatives.
*2: Ratio (%) of the weight of reducing agent represented by Formula (A-1) based on the total weight of reducing agents represented by Formulas (A-1) and (A-2).
*3: From the light-sensitive material feeding section to the image exposure section.

kV·A·min/m$^2$, sublayers b was coated thereon using sub-layer coating solutions B described below so as to have dry layer thickness of 0.1 μm. Thereafter, a heating treatment was conducted at 130° C. for 15 min in a heating treatment type oven having a film transport apparatus provided with plural rolls.

Sub-coating Solution A

Copolymer latex solution (30% solids) of 270 g, comprised of butyl acrylate/t-butyl acrylate/styrene and 2-hydroxyethyl acrylate (30/20/25/25%) was mixed with 0.6 g of surfactant (UL-1) and 0.5 g of methyl cellulose. Further thereto a dispersion in which 1.3 g of silica particles (SILOID 350, available from FUJI SYLYSIA Co.) was previously dispersed in 100 g of water by a ultrasonic dispersing machine, Ultrasonic Generator (available from ALEX Corp.) at a frequency of 25 kHz and 600 W for 30 min., was added and finally water was added to make 1,000 ml to form sub-coating solution A.

Synthesis of Colloidal Tin Oxide Dispersion

Stannic chloride hydrate of 65 g was dissolved in 2,000 ml of water/ethanol solution. The prepared solution was boiled to obtain co-precipitates. The purified precipitate was taken out by decantation and washed a few times with distilled water. To the water used for washing, aqueous silver nitrate was added to confirm the presence of chloride ions. After confirming no chloride ion, distilled water was further added to the washed precipitate to make the total amount of 2,000 ml. After adding 40 ml of 30% ammonia water was added and heated, heating was further continued and concentrated to 470 ml to obtain colloidal tin oxide dispersion.

Sub-coating Solution B

The foregoing colloidal tin oxide dispersion of 37.5 g was mixed with 3.7 g of copolymer latex solution (30% solids) comprised of butyl acrylate/t-butyl acrylate/styrene and 2-hydroxyethyl acrylate (20/30/25/25%), 14.8 g of copolymer latex solution (30% solids) comprised of butyl acrylate/styrene and glycidyl methacrylate (40/20/40%), and 0.1 g of surfactant (UL-1) and water was further added to make 1,000 ml to obtain sub-coating solution B.

UL-1

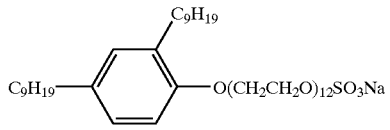

Back Layer-side Coating

To 830 g of methyl ethyl ketone (MEK), 84.2 g of cellulose acetate-butyrate (CAB381-20, available from Eastman Chemical Co.) and 4.5 g of polyester resin (Vitel PE2200B, available from Bostic Corp.) were added and dissolved, while stirring. To the resulting solution were added 0.30 g of infrared dye-1, 4.5 g of fluorinated surfactant-1 and 1.5 g of fluorinated surfactant (EFTOP EF-105, available from JEMCO Inc.) were added and further, 43.2 g of Methanol was added with sufficiently stirring until being dissolved. To the resulting solution was added 75 g of silica particles (SYLOID, available from FUJI SYLYSIA Co.), which were previously added to MEK in a concentration of 1% and dispersed in a dissolver homogenizer and then, stirred to obtain a back layer coating solution.

Infrared Dye-1

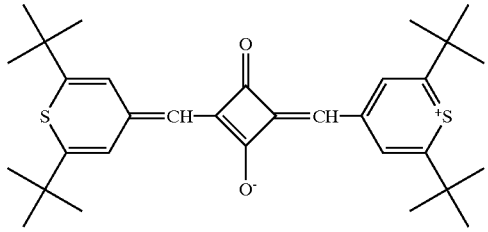

$C_9F_{17}O(CH_2CH_2O)_{22}C_9F_{17}$ Fluorinated Surfactant-1

The thus prepared back layer coating solution was coated on the support using an extrusion coater and dried so as to form a dry layer of 3.5 μm. Drying was conducted at a dry bulb temperature of 100° C. and a dew point of 10° C. over a period of 5 min.

| Preparation of Light-sensitive Silver Halide Emulsion A | |
|---|---|
| Solution A1 | |
| Phenylcarbamoyl gelatin | 88.3 g |
| Compound (A) (10% methanol solution) | 10 ml |
| Potassium bromide | 0.32 g |
| Water to make | 5429 ml |
| Solution B1 | |
| 0.67 mol/l aqueous silver nitrate solution | 2635 ml |
| Solution C1 | |
| Potassium bromide | 51.55 g |
| Potassium iodide | 1.47 g |
| Water to make | 660 ml |
| Solution D1 | |
| Potassium bromide | 154.9 g |
| Potassium iodide | 4.41 g |
| Water to make | 1982 ml |
| Solution E1 | |
| 0.4 mol/l aqueous potassium bromide solution | |
| Amount necessary to adjust silver potential | |
| Solution F1 | |
| Potassium hydroxide | 0.71 g |
| Water to make | 20 ml |
| Solution g1 | |
| Aqueous 56% acetic acid solution | 18.0 ml |
| Solution H1 | |
| Anhydrous sodium carbonate | 1.72 g |
| Water to make | 151 ml |

Compound (A):
$HO(CH_2CH_2O)_n—(CH(CH_3)CH_2O)_{17}CH_2CHO)_mH$
(m + n = 5 to 7

Using a stirring mixer described in JP-B Nos. 58-58288 and 58-58289, ¼ of solution B1, and the total amount of solution C1 were added to solution A1 by double jet addition for 4 min 45 sec. to form nucleus grains, while maintaining a temperature of 30° C. and a pAg of 8.09. After 1 min., the total amount of solution F1 was added thereto, while the pAg was properly adjusted using solution E1. After 6 min, ¾ of solution B1 and the total amount of solution D1 were further added by double jet addition for 14 min 15 sec., while maintaining a temperature of 30° C. and a pAg of 8.09. After stirring for 5 min., the reaction mixture was cooled to 40° C. and solution G1 was added thereto to coagulate the resulting silver halide emulsion. Of the remaining 2,000 ml of precipitates, the supernatant was removed and after adding 10 lit. of water while stirring, the silver halide emulsion was again coagulated. Of the remaining 1,500 ml of precipitates, the supernatant was removed and after adding 10 lit. of water while stirring, the silver halide emulsion was again coagulated. Of the remaining 1,500 ml of precipitates, the supernatant was removed and solution H1 was added. The temperature was raised to 60° C. and stirring continued for 120 min. Finally, the pH was adjusted to 5.8 and water was added thereto so that the weight per mol of silver was 1161 g, and light-sensitive silver halide emulsion was thus produced.

It was proved that the resulting emulsion was comprised of monodispersed silver iodobromide cubic grains having an average grain size of 0.040 μm, a coefficient of variation of grain size of 12% and a (100) face ratio of 92%.

Further, chemical sensitization was accomplished as follows. 240 ml of sulfuric sensitizer S-5 (0.5% methanol solution) was added to the above emulsion and then gold sensitizer Au-5 at 1/20 equimolar amount of the chemical sensitizer was added and stirred for 120 min., maintained at a temperature of 55° C. This was designated as light-sensitive silver halide emulsion A.

S-5

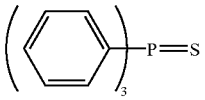

Au-5

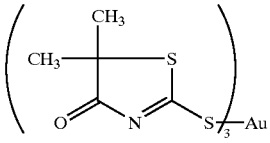

Preparation of Powdery Aliphatic Carboxylic Acid Silver Salt A

Behenic acid of 130.8 g, arachidic acid of 67.7 g, stearic acid of 43.6 g and palmitic acid of 2.3 g were dissolved in 4720 ml of water at 80° C. Then, 540.2 ml of aqueous 1.5 mol/l NaOH was added, and after further adding 6.9 ml of concentrated nitric acid, the mixture was cooled to 55° C. to obtain a aliphatic acid sodium solution. To the thus obtained aliphatic acid sodium solution, 45.3 g of light-sensitive silver halide emulsion A obtained above and 450 ml of water were added and stirred for 5 min., while being maintained at 55° C.

Subsequently, 702.6 ml of 1 mol/l aqueous silver nitrate solution was added in 2 min. and stirring continued further for 10 min. to obtain powdery aliphatic carboxylic acid silver salt dispersion, removing aqueous soluble salts. Thereafter, obtained aliphatic carboxylic acid silver salt dispersion was moved to a washing vessel, and then, washing with deionized water and filtration were repeated until the filtrate reached a conductivity of 50 μS/cm. Using a flush jet dryer (produced by Seishin Kigyo Co., Ltd.), the thus obtained cake-like aliphatic carboxylic acid silver salt was dried under an atmosphere of nitrogen gas, according to the operation condition of a hot air temperature at the inlet of the dryer until reached a moisture content of 0.1% to obtain dried powdery aliphatic carboxylic acid silver salt A. The moisture content was measured by an infrared ray aquameter.

Preparation of Pre-dispersion A

To 1457 g MEK was dissolved 14.57 g of polymer P-9, and further thereto was gradually added 500 g of powdery aliphatic carboxylic acid silver salt A to obtain pre-dispersion A, while stirring sufficiently by a dissolver type homogenizer (DISPERMAT Type CA-40, available from VMA-GETZMANN).

Preparation of Light-sensitive Emulsion Dispersion A

Thereafter, using a pump, pre-dispersion A was transferred to a media type dispersion machine (DISPERMAT Type SL-C12 EX, available from VMA-GETZMANN), which was packed 0.5 mm Zirconia beads (TORAY-SELAM, available from Toray Co. Ltd.) by 80%, and dispersed at a circumferential speed of 8 m/s and for 1.5 min. of a retention time with a mill to obtain light-sensitive emulsion dispersion A.

Preparation of Stabilizer Solution

In 4.97 g methanol were dissolved 1.0 g of Stabilizer-1 and 0.31 g of potassium acetate to obtain a stabilizer solution.

Preparation of Infrared Sensitizing Dye Solution A

In 31.3 ml MEK were dissolved 19.2 mg of infrared sensitizing dye-1, 1.488 g of 2-chlorobenzoic acid, 2.779 g of Stabilizer-2 and 365 mg of 5-methyl-2-mercaptobenzimidazole in a dark room to obtain infrared sensitizing dye solution A.

Preparation of Additive Solution a

In 110 g MEK were dissolved 27.98 g of developer 1,1-bis(2-hydroxy-3,5-dimethylphenyl)-3,5,5-trimethylhexane (comparative), 1.54 g of 4-methylphthalic acid and 0.48 g of the infrared dye-1 to obtain additive solution a.

Preparation of Additive Solution b 3.56 g of antifoggants-2 and 3.43 g of phthalazine were dissolved in 40.9 g of MEK to obtain additive solution b.

Preparation of Light-sensitive Layer Coating Solution A

Under inert gas atmosphere (97% nitrogen), 50 g of the light-sensitive emulsion A and 15.11 g MEK were maintained at 21° C. with stirring, 390 μl of antifoggant-1 (10% methanol solution) was added thereto and stirred for 1 hr. Further thereto, 494 μl of calcium bromide (10% methanol solution) was added and stirring for 20 min. Subsequently, 167 ml of the stabilizer solution was added and after stirring for 10 min., 1.32 g of infrared sensitizing dye solution A was added and stirred for 1 hr. Then, the mixture was cooled to 13° C. and stirred for 30 min. Further thereto, 13.31 g of polymer (P-9) was added and stirred for 30 min, while maintaining the temperature at 13° C., and 1.084 g of tetrachlorophthalic acid (9.4 wt % MEK solution) and stirred for 15 min. Then, 12.43 g of additive solution a, 1.6 ml of 10% MEK solution of Desmodur N3300 (aliphatic isocyanate, product by Movey Co.) (comparative cross-linking agent) and 4.27 g of additive solution b were successively added with stirring to obtain coating solution A of the light-sensitive layer.

Preparation of Matting Agent Dispersion

In 42.5 g of MEK, 7.5 g of cellulose acetate-butyrate (CAB171-15, available from Eastman Chemical Co.) was dissolved with stirring and further thereto, 5 g of Silica particles (SYLYSIA 320, available from FUJI SYLYSIA Co.) was added and stirred at 8,000 rpm for 45 min., using DISPERMAT Type CA-40M (dissolver mill, available from VMA-GETZMANN) to obtain a matting agent dispersion.

The structures of raw materials used for preparation of additive solutions are shown below.

Stabilizer-1

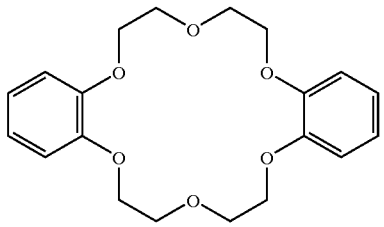

-continued

Stabilizer-2

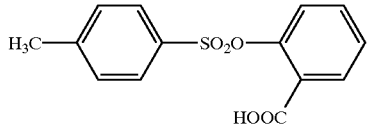

Infrared Sensitizing Dye-1

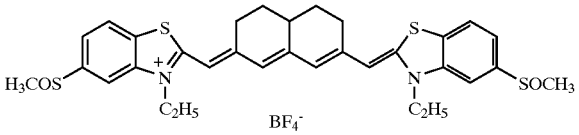

Antifoggant-2

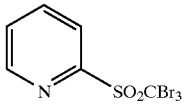

Antifoggant-1

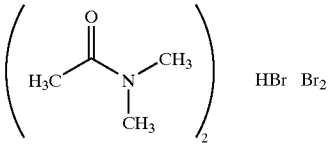

Surface Protective Layer Coating Solution

To 865 g of MEK, 96 g of cellulose acetate-butyrate (CAB171-15, mentioned before), 4.5 g of polymethyl methacrylate (Paraloid A-21, available from Rohm & Haas Corp), 1.0 g of benztriazole, 1.0 g of fluorinated surfactant-1 and fluorinated surfactant (EFTOP EF-105, available from JEMCO Inc.) were added and dissolved. Further thereto, 30 g of the foregoing matting agent dispersing solution was added while stirring to obtain a surface protective layer coating solution.

Preparation of Photothermographic Material Sample 101

Using a commonly known extrusion type coater, the thus prepared light-sensitive layer coating solution A and said protective layer coating solution were simultaneously applied to obtain Sample 101. The silver coating amount of the light-sensitive layer was 1.7 g/m$^2$ and the dry layer thickness of the protective layer was 2.5 $\mu$m. Drying was achieved using hot air at a dry bulb temperature of 75° C. and a dew point of 10° C. for 10 min., and thus, Sample 101 was prepared.

Samples 102 through 115 were prepared similarly to Sample 101, except that the comparative linking agent and binder resin P-9 in light-sensitive layer coating solution A and in the silver coverage were changed as described in Table 2.

Exposure and Thermal Processing

Samples were each subjected to laser scanning exposure from the emulsion side using an exposure apparatus using a 800 to 820 nm semiconductor laser light source of a longitudinal multi-mode, employing high frequency overlapping. In this case, exposure was conducted at an angle of 75°, between the exposed surface and exposing laser light. (As a result, images with superior sharpness were unexpectedly obtained, as compared to exposure at an angle of 90°).

Subsequently, using an automatic processor provided with a heated drum, exposed samples were subjected to thermal development at 115° C. for 15.0 sec., while bringing the protective layer surface of the photothermographic material into contact with the drum surface. Exposure and thermal development were conducted in an atmosphere at 23° C. and 50% RH. The evaluation of the obtained images was conducted by using a densitometer. The results of these measurements were determined by sensitivity [represented by a relative value of the reciprocal of exposure giving a density of 1.0 plus the minimum density (Dmin)], fogging and maximum density, based on the speed and maximum density of Sample No. 101 being 100.

Measurement of Thermal Transition Point

Each of the foregoing light-sensitive layer coating solution and protective layer coating solution were respectively coated on a Teflon (R) plate using a wire-bar and dried under the same condition as above. The thus coated samples were exposed under conditions giving the maximum density and were then thermally developed. Thereafter, the constitution layer coated onto the Teflon (R) plate was peeled from the plate. 10 mg of the thus peeled sample was charged into an aluminum pan and the thermal transition point for each sample was determined using a differential scanning calorimeter (EXSTAR 6000, available from SEIKO DENSHIKOGYO Co., Ltd.), in accordance with JIS K7121. In the measurement determination, the temperature was raised at a rate of 10° C./min. within the range of 0 to 200° C. and then the temperature was lowered to 0° C. at a rate of 20° C./min. This procedure was repeated twice to ascertain the thermal transition point.

Evaluation of Image Lasting Quality After Development

Evaluation of image lasting quality was conducted by measurment of variation of minimum density, maximum density and the hue angle under uniform conditions detailed below.

(1) Determination of Variation in Minimum Density (Dmin)

Samples which were thermally processed similarly to the determination of sensitivity were continuously exposed to light in an atmosphere at 45° C. and 55% RH for 3 days, in which commercially available white fluorescent lamps were arranged so as to exhibit an illumination intensity of 500 lux on the surface of each sample. Thereafter, exposed samples were measured for the minimum density (D2) and unexposed samples were measured for the minimum density (D1), after which variation in minimum density (%) was determined in accordance with the following equation.

$$\text{Variation in minimum density}=(D_2/D_1)\times 100(\%).$$

(2) Determination of Variation in Maximum Density (Dmax)

Thermally developed samples were prepared similarly to the determination of variation in minimum density. After being placed in environments of 25° C. or 45° C. for 3 days, variation in maximum density was measured and variation in image density was determined as a measure of image lasting quality, in accordance with the following equation.

$$\text{Variation in image density}=(\text{maximum density of sample aged at } 45^\circ\text{ C.})/(\text{maximum density of sample aged at } 25^\circ\text{ C.})\times 100(\%)$$

(3) Determination of Hue Angle

Thermally developed samples were prepared similarly to the determination of variation in maximum density. After being placed in environment of 25° C. or 45° C. for 3 days, the hue angle $h_{ab}$ was determined in such a manner that processed samples were measured with respect to areas corresponding to the minimum density, using an ordinary light source, D65 defined by CIE and a spectral colormeter CM-508d (available from Minolta Co., Ltd.) at a visual field of 2°.

The thus obtained results are shown in Table 3.

TABLE 3

| Sample No. | Poly-functional Carbodiimide | Light-sensitive Layer: Binder | Light-sensitive Layer: Thermal Transition Point (° C.) | Light-sensitive Layer: Silver Coverage (g/m²) | Photographic Performance: Fogging | Photographic Performance: Relative Sensitivity | Photographic Performance: Maximum Density (Relative Value) | Storage Stability after Development: Dmin Variation (%) | Storage Stability after Development: Dmax Variation (%) | Hue Angle |
|---|---|---|---|---|---|---|---|---|---|---|
| 101 (Comp. Example) | — | P-9 | 39 | 1.5 | 0.225 | 100 | 100 | 149 | 83 | 178 |
| 102 (Comp. Example) | — | P-1 | 52 | 1.5 | 0.231 | 101 | 101 | 158 | 84 | 178 |
| 103 (Comp. Example) | — | P-2 | 47 | 1.5 | 0.229 | 99 | 100 | 157 | 85 | 179 |
| 104 (Comp. Example) | — | P-4 | 56 | 1.5 | 0.232 | 96 | 101 | 167 | 87 | 179 |
| 105 (Comp. Example) | — | P-9 | 41 | 1.7 | 0.243 | 91 | 110 | 159 | 82 | 171 |
| 106 (Invt. Example) | CI-1 | P-9 | 42 | 1.5 | 0.210 | 109 | 105 | 123 | 94 | 182 |
| 107 (Invt. Example) | CI-2 | P-9 | 41 | 1.5 | 0.211 | 106 | 107 | 123 | 95 | 180 |
| 108 (Invt. Example) | CI-3 | P-9 | 43 | 1.5 | 0.208 | 107 | 106 | 127 | 94 | 182 |
| 109 (Invt. Example) | CI-1 | P-9 | 44 | 1.5 | 0.206 | 103 | 105 | 119 | 94 | 185 |
| 110 (Invt. Example) | CI-1 | P-1 | 57 | 1.5 | 0.195 | 108 | 109 | 121 | 97 | 192 |
| 111 (Invt. Example) | CI-1 | P-1 | 56 | 1.5 | 0.194 | 111 | 113 | 115 | 95 | 193 |
| 112 (Invt. Example) | CI-1 | P-2 | 49 | 1.5 | 0.201 | 111 | 112 | 125 | 93 | 189 |
| 113 (Invt. Example) | CI-1 | P-4 | 55 | 1.5 | 0.200 | 112 | 113 | 118 | 95 | 193 |
| 114 (Invt. Example) | CI-2 | P-1 | 51 | 1.5 | 0.203 | 107 | 115 | 110 | 98 | 189 |
| 115 (Invt. Example) | CI-3 | P-1 | 53 | 1.5 | 0.183 | 110 | 110 | 107 | 96 | 191 |

Comp.: Comparative
Invt.: Inventive

As is apparent from Table 3, it was proved that the photothermographic materials of the present invention exhibited superiority of lower fogging density in spite of almost the same sensitivity, pre-exposure storage stability and image lasting quality compared to the comparative examples. Further, it was also proved that hue angle values defined by CIE of the samples of the present invention exceeded 180°, but less than 270°, and exhibited a cold image tone, thus the appropriate outputted images were obtained for medical diagnosis.

Example 4

The photothermographic materials were prepared in the same manner as Example 3 except for changes described below.

Preparation of Powdery Aliphatic Carboxylic Acid Silver Salt B 104.6 g of behenic acid, 54.2 g of arachidic acid, 34.9 g of stearic acid and 1.8 g of palmitic acid were dissolved in 4720 ml of 80° C. water. Then, 432.2 ml of aqueous 1.5 mol/l NaOH was added, and after further addition of 5.5 ml of concentrated nitric acid, the mixture was cooled to 55° C. to obtain an aliphatic acid sodium solution.

To the thus obtained aliphatic acid sodium solution, 36.2 g of light-sensitive silver halide emulsion A, the same as in Example 3 and 450 ml of water were added and stirred for 5 min., while maintained at 55° C. Subsequently, 562.1 ml of 1 mol/l aqueous silver nitrate solution was added over 2 min. and stirring continued for a further 10 min. to obtain a powdery aliphatic carboxylic acid silver salt dispersion. Hereafter, powdery aliphatic carboxylic acid silver salt B was obtained in the same manner as preparation of powdery aliphatic carboxylic acid silver salt A of Example 3.

Preparation of Powdery Aliphatic Carboxylic Acid Silver Salt C 130.8 g of behenic acid, 67.7 g of arachidic acid, 43.6 g of stearic acid and 2.3 g of palmitic acid were dissolved in 4720 ml of 80° C. water. Then, 540.2 ml of aqueous 1.5 mol/l NaOH was added, and after further addition of 6.9 ml of concentrated nitric acid, the mixture was cooled to 55° C. to obtain an aliphatic acid sodium solution.

To the thus obtained aliphatic acid sodium solution, maintained at 55° C., after 347 ml of t-butyl alcohol was added and stirred for 20 min., 45.3 g of aforesaid light-sensitive silver halide emulsion A and 450 ml of water were added and stirred for 5 min. Hereafter, powdery aliphatic carboxylic acid silver salt C was obtained in the same manner as preparation of powdery aliphatic carboxylic acid silver salt A of Example 3.

Preparation of Powdery Aliphatic Carboxylic Acid Silver Salt D 130.8 g of behenic acid, 67.7 g of arachidic acid, 32.2 g of stearic acid, 2.3 g of palmitic acid and 17.0 g of iso-arachidic acid dissolved in 4720 ml of 80° C. water. Then, 540.2 ml of aqueous 1.5 mol/l NaOH was added, and after further addition of 6.9 ml of concentrated nitric acid, the mixture was cooled to 55° C. to obtain an aliphatic acid sodium solution.

To the thus obtained aliphatic acid sodium solution, 45.3 g of aforesaid light-sensitive silver halide emulsion A and 450 ml of water were added and stirred for 5 min., while maintained at 55° C. Hereafter, powdery aliphatic carboxylic acid silver salt D was obtained in the same manner as preparation of powdery aliphatic carboxylic acid silver salt A of Example 3.

Preparation of Powdery Aliphatic Carboxylic Acid Silver Salt E 130.8 8 g of behenic acid, 67.7 g of arachidic acid, 37.6 g of stearic acid, 2.3 g of palmitic acid and 6.0 g of oleic acid were dissolved in 4720 ml of 80° C. water. Then, 540.2 ml of aqueous 1.5 mol/l NaOH was added, and after further addition of 6.9 ml of concentrated nitric acid, the mixture was cooled to 55° C. to obtain an aliphatic acid sodium solution.

To the thus obtained aliphatic acid sodium solution, 45.3 g of aforesaid light-sensitive silver halide emulsion A and 450 ml of water were added and stirred for 5 min., while maintained at 55° C. Hereafter, powdery aliphatic carboxylic acid silver salt E was obtained in the same manner as preparation of powdery aliphatic carboxylic acid silver salt A of Example 3.

Preparation of Powdery Aliphatic Carboxylic Acid Silver Salt F 130.8 g of behenic acid, 67.7 g of arachidic acid, 43.6 g of stearic acid, 2.3 g of palmitic acid and 1.5 g of polyvinyl alcohol (available from KURARAY Co., Ltd.) were dissolved in 4720 ml of 80° C. water. Then, 540.2 ml of aqueous 1.5 mol/l NaOH was added, and after further addition of 6.9 ml of concentrated nitric acid, the mixture was cooled to 55° C. to obtain an aliphatic acid sodium solution.

To the thus obtained aliphatic acid sodium solution, 45.3 g of aforesaid light-sensitive silver halide emulsion A and 450 ml of water were added and stirred for 5 min. Powdery aliphatic carboxylic acid silver salt F was obtained in the same manner as preparation of powdery aliphatic carboxylic acid silver salt A of Example 3.

Preparation of Pre-dispersions B through F

The preparation of these samples was conducted in the same manner as Example 3 except for changing to powdery aliphatic carboxylic silver salts B through F.

Preparation of Light-sensitive Emulsion Dispersions B through F

The preparation was conducted in the same manner as Example 3 except for changing to pre-dispersions B through F.

Preparation of Light-sensitive Layer Coating Solution B

Light-sensitive layer coating solution B was prepared in the same manner as light-sensitive layer coating solution A, except for using light-sensitive emulsion dispersion B.

Preparation of Photothermographic Material of Sample 201

Using light-sensitive emulsion dispersion B and the surface protective layer coating solution, Sample 201 was prepared in the same manner as in Example 3.

Samples 202 through 210 were prepared in the same manner as Example 3 except that the light-sensitive emulsion dispersion in the light-sensitive layer coating solution and polyfunctional carbodiimide compound were replaced as described in Table 4.

In all samples, P-1 was used as a binder resin in the light-sensitive layer coating solution, and the temperature of the thermal transition point of the light-sensitive layer was adjusted to about 55° C.

Measurement of Grain Diameter and Grain Thickness of Aliphatic Carboxylic Acid Silver Salt For the determination of the grain diameter, an organic silver salt dispersion was diluted, dispersed on a grid provided with a carbon support membrane, and then photographed at a direct magnification of 5,000 times using a transmission type electron microscope (TEM, 2000 FX type, available from Nihon Denshi Co., Ltd.). The thus obtained negative electron micrographic images were read as a digital image by a scanner to determine the diameter (circular equivalent diameter) using image processing apparatus LUZEX-III (manufactured by Nireko Co.). At least 300 grains were so measured to determine an average diameter.

Further, to determine the grain thickness, a light-sensitive layer, coated onto a support, was pasted onto a suitable holder employing an adhesive and cut perpendicular to the support surface employing a diamond knife to prepare an ultra-thin 0.1 to 0.2 $\mu$m slice. The thus prepared ultra-thin slice was supported on a copper mesh, and placed onto a carbon membrane, which had been made hydrophilic by means of glow discharge. Then, while cooling the resulting slice to no more than −130° C. using liquid nitrogen, the image in a bright visual field was observed at a magnification of 5,000 to 40,000 times employing a transmission electron microscope, after which the images were recorded on film. The thus obtained images were read by image processing apparatus LUZEX-III (mentioned before). At least 300 grains were so measured to determine an average thickness.

Exposure, development and various evaluations were conducted in the same manner as in Example 3. The results are shown in Table 4.

TABLE 4

| Sample No. | Polyfunctional Carbodiimide | Light-sensitive Emulsion Dispersion | Carboxylic Acid Silver Salt Grain Diameter/Grain Thickness (μm) | Photographic Performance: Fogging | Relative Sensitivity | Maximum Density (Relative Value) | Storage Stability after Development: Dmin Variation (%) | Dmax Variation (%) |
|---|---|---|---|---|---|---|---|---|
| 201 (Comp. Example) | — | A | 0.82/0.08 | 0.238 | 100 | 100 | 164 | 84 |
| 202 (Invt. Example) | CI-1 | A | 0.82/0.08 | 0.197 | 107 | 108 | 121 | 97 |
| 203 (Comp. Example) | — | B | 0.77/0.06 | 0.240 | 114 | 106 | 163 | 84 |
| 204 (Invt. Example) | CI-1 | B | 0.77/0.06 | 0.202 | 112 | 114 | 123 | 96 |
| 205 (Comp. Example) | — | C | 0.34/0.03 | 0.237 | 110 | 108 | 157 | 80 |
| 206 (Invt. Example) | CI-1 | C | 0.34/0.03 | 0.198 | 122 | 124 | 121 | 95 |
| 207 (Invt. Example) | CI-2 | C | 0.34/0.03 | 0.210 | 117 | 115 | 118 | 94 |
| 208 (Invt. Example) | CI-3 | D | 0.42/0.03 | 0.201 | 119 | 118 | 121 | 95 |
| 209 (Invt. Example) | CI-1 | E | 0.46/0.04 | 0.199 | 118 | 110 | 118 | 95 |
| 210 (Invt. Example) | CI-1 | F | 0.48/0.04 | 0.192 | 117 | 112 | 122 | 95 |

Comp.: Comparative
Invt.: Inventive

As is apparent from Table 4, it was proved that the photothermographic materials of the present invention exhibited superiority of lower fogging density in spite of high sensitivity, pre-exposure storage stability and image lasting quality after development compared to the comparative examples. Further, it was also proved that hue angle values defined by CIE of the samples of the present invention were between 180 to 270°, and exhibited a cold image tone, and thus appropriately outputted images were obtained for medical diagnosis.

Example 5

Preparation of Photothermographic Material of Sample 301

Using light-sensitive layer coating solution A and surface protective layer coating solution of Example 3, Sample 301 was prepared in the same manner as Sample 101 of Example 3.

Samples 302 through 310 were prepared in the same manner as Sample 301 except that the developer in the additive solution and polyfunctional carbodiimide compound were replaced as described in Table 5.

In all samples, P-1 was used as a binder resin in the light-sensitive layer coating solution, and the temperature of the thermal transition point of the light-sensitive layer was adjusted to about 55° C.

Exposure, development and various evaluations were conducted in the same manner as in Example 3. The results are shown in Table 5.

TABLE 5

| Sample No. | Polyfunctional Carbodiimide | Developer: Compound | Developer: Relative mol ratio* | Photographic Performance: Fogging | Relative Sensitivity | Maximum Density (Relative Value) | Storage Stability after Development: Dmin Variation (%) | Dmax Variation (%) |
|---|---|---|---|---|---|---|---|---|
| 301 (Comp. Example) | — | Comp. Example | 100 | 0.237 | 100 | 100 | 164 | 84 |
| 302 (Invt. Example) | CI-1 | Comp. Example | 100 | 0.197 | 107 | 108 | 121 | 97 |
| 303 (Comp. Example) | — | A-3 | 60 | 0.247 | 114 | 110 | 163 | 84 |
| 304 (Invt. | CI-1 | A-3 | 60 | 0.201 | 119 | 117 | 123 | 96 |

TABLE 5-continued

| Sample No. | Polyfunctional Carbodiimide | Developer Compound | Developer Relative mol ratio* | Photographic Performance Fogging | Photographic Performance Relative Sensitivity | Photographic Performance Maximum Density (Relative Value) | Storage Stability after Development Dmin | Storage Stability after Development Dmax Variation (%) |
|---|---|---|---|---|---|---|---|---|
| Example) | | | | | | | | |
| 305 (Comp. Example) | — | A-14 | 60 | 0.247 | 113 | 114 | 152 | 83 |
| 306 (Invt. Example) | CI-1 | A-14 | 60 | 0.195 | 122 | 121 | 122 | 95 |
| 307 (Invt. Example) | CI-2 | A-24 | 60 | 0.203 | 119 | 119 | 118 | 94 |
| 308 (Invt. Example) | CI-3 | A-14 | 60 | 0.202 | 118 | 118 | 121 | 95 |
| 309 (Invt. Example) | CI-1 | A-24 | 100 | 0.200 | 119 | 119 | 118 | 95 |
| 310 (Invt. Example) | CI-1 | A-31 | 100 | 0.197 | 117 | 116 | 122 | 95 |

Comp.: Comparative
Invt.: Inventive
*Relative mol ratio based on the added amount of Sample 301 being 100

As is apparent from Table 5, it was proved that the photothermographic materials of the present invention exhibited superiority of lower fogging density in spite of high sensitivity, pre-exposure storage stability and image lasting quality after development compared to the comparative examples.

Example 6

The support was prepared in the same manner as Example 1 except that 1 g of the following silver-saving agent was added to subbing coating solution B of Example 3, in order to confirm the effect of the silver-saving agent.

Silver-saving Agent-1

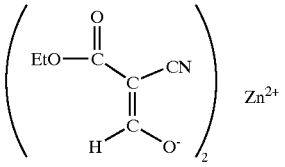

The following silver halide emulsion was prepared as detailed below.

Preparation of Light-sensitive Silver Halide Emulsion a

Light-sensitive silver halide emulsion a was prepared in the same manner as Example 3 except that the process of "240 ml of sulfuric sensitizer (0.5% methanol solution) was added to the above emulsion and then gold sensitizer Au-5 at 1/20 equimolar amount of the chemical sensitizer S-5 was added and stirred for 120 min., maintained at a temperature of 55° C." was eliminated.

Preparation of Light-sensitive Layer Coating Solution a

Light-sensitive layer coating solution a was prepared in the same manner except for using the above listed light-sensitive silver halide emulsion a instead of light-sensitive silver halide emulsion A of light-sensitive layer coating solution C.

Preparation of Photothermographic Material Sample 401

Sample 401 was prepared by using a commonly known extrusion type coater, applying a simultaneous coating of 3 layers, being 2 light-sensitive layers and 1 protective layer. The coating was conducted so as to obtain 0.7 g/m$^2$ of silver coverage on the upper layer of the light-sensitive layer comprising light-sensitive emulsion C, 0.3 g/m$^2$ of silver coverage of the lower layer of the light-sensitive layer comprising light-sensitive emulsion dispersion a, for a 0.5 $\mu$m dry thickness of the surface protective layer. Thereafter, hot air drying was conducted at a dry bulb temperature of 50° C. and a dew point of 10° C. for 10 min., and thus, Sample 401 was prepared.

Samples 402 through 406 were prepared similarly to Sample 401 except that the polyfunctional carbodiimide compound contained in the light-sensitive layer coating solution was replaced as described in Table 6.

In all samples, P-1 was used as a binder resin in the light-sensitive layer coating solution, and the temperature of the thermal transition point of the light-sensitive layer was adjusted to about 55° C.

Exposure, development and various evaluations were conducted in the same manner as Example 3. The results are shown in Table 6.

TABLE 6

| Sample No. | Polyfunctional Carbodiimide | Light-sensitive Emulsion Dispersion (Upper layer/Lower layer) | Silver-saving Agent in Subbing Layer | Silver Coverage ($g/m^2$) | Photographic Performance: Fogging | Photographic Performance: Relative Sensitivity | Photographic Performance: Maximum Density (Relative Value) | Storage Stability after Development: Dmin Variation (%) | Storage Stability after Development: Dmax Variation (%) |
|---|---|---|---|---|---|---|---|---|---|
| 401 (Comp. Example) | — | C/a | No | 1.0 | 0.200 | 100 | 100 | 148 | 88 |
| 402 (Comp. Example) | — | C/a | No | 2.0 | 0.240 | 100 | 135 | 178 | 67 |
| 403 (Comp. Example) | — | C/a | Present | 1.0 | 0.415 | 125 | 155 | 145 | 75 |
| 404 (Invt. Example) | CI-1 | C/a | Present | 1.0 | 0.208 | 142 | 152 | 119 | 95 |
| 405 (Invt. Example) | CI-2 | C/a | Present | 1.0 | 0.202 | 136 | 149 | 117 | 97 |
| 406 (Invt. Example) | CI-3 | C/a | Present | 1.0 | 0.199 | 131 | 150 | 111 | 96 |

Comp.: Comparative
Invt.: Inventive

As is apparent from Table 6, it was proved that the multilayered photothermographic materials of the present invention exhibited superiority of lower fogging density in spite of high sensitivity, image lasting quality after development and pre-exposure storage stability compared to the comparative examples. Further, the multilayered samples containing the silver-saving agent in the light-sensitive layer exhibited that the fogging was at the same level as comparative samples and the maximum density was significantly increased.

Effects of the Invention

According to the present invention, it is possible to provide a photothermographic material having superior high density, silver color tone and image storage stability under light irradiation, as well as a photothermographic material exhibiting high speed, lower fogging, superior pre-exposure storage stability and image lasting quality.

What is claimed is:

1. A photothermographic material comprising a support and having thereon an image forming layer containing an organic silver salt, light-sensitive silver halide grains, binder and a reducing agent, wherein the reducing agent comprises:

a reducing agent A represented by following Formula (A-1); and a reducing agent B represented by a bisphenol derivative, selected from a group consisting of bisphenol derivatives represented by following Formula (A-2) and (A-3) and the amount of reducing agent A is 5 to 45 weight % of the total weight of the reducing agent A and reducing agent B, Formula (A-1)

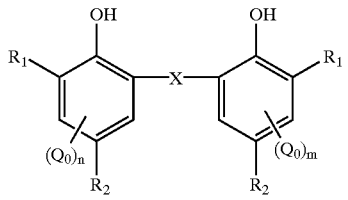

wherein each of $R_1$ is an alkyl group having 1 to 20 carbon atoms, and at least one of $R_1$ is a secondary or tertiary alkyl group; each of $R_2$ is a hydrogen atom or a group capable of being substituted on a benzene ring; $Q_0$ is a group capable of being substituted on a benzene ring; n and m are each an integer of 0 to 2; plural $R_1$s, $R_2$s or $Q_0$s may be the same or different from each other; and X is a chalcogen atom or CHR, in which R is a hydrogen atom, a halogen atom or an alkyl group Formula (A-2)

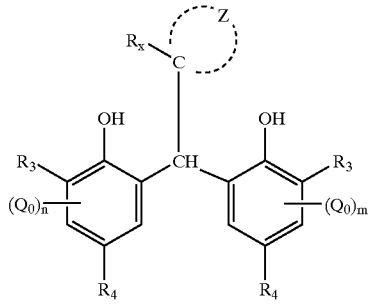

wherein Z is an atom group necessary to form a 3 to 10-membered non-aromatic ring together with a carbon atom; $R_x$ is a hydrogen atom or an alkyl group; $R_3$ and $R_4$ are a hydrogen atom, an alkyl group, an aryl group or a heterocyclic group; $Q_0$ is a group capable of being substituted on a benzene ring; n and m are each an integer of 0 to 2; and plural $R_3$s, $R_4$s or $Q_0$s may be the same or different from each other, Formula (A-3)

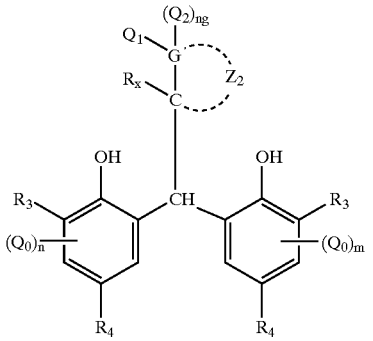

wherein $Q_1$ is a halogen atom, an alkyl group, an aryl group or a heterocyclic group; $Q_2$ is a hydrogen atom, a halogen atom, an alkyl group, an aryl group or a heterocyclic group; G is a nitrogen atom or a carbon atom; ng is 0 when G is a nitrogen atom; ng is 0 or 1 when G is a carbon atom; $Z_2$ is an atom group necessary to form a 3- to 10-membered non-aromatic ring together with a carbon atom; $R_x$ is a hydrogen atom or an alkyl group; $R_3$ and $R_4$ are a hydrogen atom, an alkyl group, an aryl group or a heterocyclic group; $Q_0$ is a group capable of being substituted on a benzene ring; n and m are each an integer of 0 to 2; and plural $R_3$s, $R_4$s or $Q_0$s may be the same or different from each other.

2. The photothermographic material of claim 1, wherein the non-aromatic ring formed by Z in Formula (A-2) is a 6-membered non-aromatic ring.

3. The phototherrnographic material of claim 1, wherein the non-aromatic ring formed by $Z_2$ in Formula (A-3) is a non-aromatic 6-membered ring.

4. The photothermographic material of claim 1, wherein the photothermographic material comprises a layer containing at least a silver-saving agent selected from the group consisting of a vinyl compound, a hydrazine derivative and a quaternary onium salt.

5. The photothermographic material of claim 1, wherein the average diameter of the silver halide grains are 10 to 35 nm.

6. The phototherrnographic material of claim 1, wherein the photothermographic material comprises silver halide grains having an average diameter of 10 to 35 nm and silver halide grains having an average diameter of 45 to 100 nm.

7. The photothermographic material of claim 1, wherein the silver halide grains are chemically sensitized by utilizing a chalcogen compound.

8. The photothermographic material of claim 1, wherein the silver amount contained in the image forming layer is 0.3 to 1.5 g/m$^2$.

9. The photothermographic material of claim 1, wherein the photothermographic material further comprises a cross-linking agent containing at least a poly-functional carbodiimide compound.

10. A photothermographic material comprising a support and having thereon an image forming layer containing an organic silver salt, light-sensitive silver halide grains, a reducing agent, a binder and a cross-linking agent, wherein the cross-linking agent contains at least a poly-functional carbodiimide compound having at least two carbodiimide groups.

11. The photothermographic material of claim 10, wherein the silver amount of the photothermographic material is 0.5 to 1.5 g/m$^2$.

12. The photothermographic material of claim 10, wherein the image forming layer has a thermal transition point of 46 to 200° C. after the photothermographic material being subjected to developing at a temperature of not less than 100° C.

13. The photothermographic material of claim 10, wherein the poly-functional carbodiimide compound is a poly-functional aromatic carbodiimide.

14. The photothermographic material of claim 10, wherein the binder is a compound having a glass transition temperature (Tg) of 70 to 105° C.

15. The photothermographic material of claim 10, wherein the organic silver salt is grains prepared in the presence of a compound functioning asa crystal growth retarder or a dispersing agent of the grains.

16. The photothermographic material of claim 15, wherein the compound functioning as a crystal growth retarder or a dispersing agent of the grains is an organic compound having a hydroxyl group or a carboxyl group.

17. The photothermographic material of claim 10, wherein the poly-functional carbodiimide compound is represented by following Formula (CI), $$R_1\text{-}J_1\text{-}N{=}C{=}N\text{-}J_2\text{-}(L)_n\text{-}(J_3\text{-}N{=}C{=}N\text{-}J_4\text{-}R_2)_v \qquad \text{Formula (CI)}$$

wherein $R_1$ and $R_2$ are each an aryl group or an alkyl group; $J_1$ and $J_4$ are each a bivalent linkage group; $J_2$ and $J_3$ are each an arylene group or an alkylene group; L is an alkyl group, an alkylene group, an aryl group, or a heterocyclic group which is (v+1)-valent, or a bond; v is an integer of 1 or more; and n is 1 or 2.

18. The photothermographic material of claim 10, wherein the photothermographic material further comprises a silver-saving agent.

19. The photothermographic material of claim 10, wherein the photothermographic material comprises plural light-sensitive layers.

* * * * *